US006843693B2

(12) United States Patent
McCarthy

(10) Patent No.: US 6,843,693 B2
(45) Date of Patent: Jan. 18, 2005

(54) METHODS FOR CREATING LARGE SCALE FOCUSED BLADE DEFLECTIONS

(76) Inventor: Peter T. McCarthy, 28305 Via Alfonse, Laguna Niguel, CA (US) 92677

( * ) Notice: Subject to any disclaimer, the term of this patent is extended or adjusted under 35 U.S.C. 154(b) by 0 days.

(21) Appl. No.: 09/852,155

(22) Filed: May 9, 2001

(65) Prior Publication Data

US 2002/0025744 A1 Feb. 28, 2002

Related U.S. Application Data

(63) Continuation-in-part of application No. 09/630,374, filed on Aug. 1, 2000, now Pat. No. 6,413,133, which is a continuation of application No. 09/311,505, filed on May 13, 1999, now Pat. No. 6,095,879.

(60) Provisional application No. 60/202,560, filed on May 10, 2000, and provisional application No. 60/085,463, filed on May 14, 1998.

(51) Int. Cl.[7] ..... A63B 31/08

(52) U.S. Cl. ..... 441/64

(58) Field of Search ..... 441/61–64; D21/806

(56) References Cited

U.S. PATENT DOCUMENTS

| | | | |
|---|---|---|---|
| 144,538 | A | 10/1873 | Harsen |
| 169,396 | A | 11/1875 | Ahlstrom |
| 234,305 | A | 5/1880 | Bovey |
| 5,384 | A | 11/1883 | Heathom |
| 476,092 | A | 12/1892 | Valente |

(List continued on next page.)

FOREIGN PATENT DOCUMENTS

| | | |
|---|---|---|
| DE | 1075997 | 2/1960 |
| DE | 3438808 | 4/1986 |
| DE | 259 353 A | 8/1988 |
| EP | 0 308 998 | 3/1989 |
| FR | 787291 | 9/1935 |

(List continued on next page.)

OTHER PUBLICATIONS

Rossier, Robert N., entitled, "Moving Forward—Getting your best kick in the water can come from a combination of design, efficiency and hydrodynamics in fins", Alert Diver, Nov.–Dec. 1997, pp. 26–28.

(List continued on next page.)

*Primary Examiner*—Ed Swinehart
(74) *Attorney, Agent, or Firm*—Knobbe Martens Olson & Bear LLP

(57) ABSTRACT

Methods are disclosed to design resilient hydrofoils (164) which are capable of having substantially similar large scale blade deflections under significantly varying loads. The methods permit the hydrofoil (164) to experience significantly large-scale deflections to a significantly reduced angle of attack under a relatively light load while avoiding excessive degrees of deflection under increased loading conditions. A predetermined compression range on the lee portion of said hydrofoil (164) permits the hydrofoil (164) to deflect to a predetermined reduced angle of attack with significantly low bending resistance. This predetermined compression range is significantly used up during the deflection to the predetermined angle of attack in an amount effective to create a sufficiently large leeward shift in the neutral bending surface with the load bearing portions of the hydrofoil (164) to permit the hydrofoil (164) to experience a significantly large increase in bending resistance as increased loads deflect the hydrofoil (164) beyond the predetermined reduced angle of attack. The shift in the neutral bending surface causes a significant increase in the elongation range required along an attacking portion of the hydrofoil (164) after the predetermined angle of attack is exceed. Methods are also disclosed for designing the hydrofoil (164) so that it has a natural resonant frequency that is sufficiently close the frequency of the reciprocating strokes used to attain propulsion in an amount sufficient to create harmonic wave addition that creates an amplified oscillation in the free end of the reciprocating hydrofoil (164). Methods are also disclosed for focusing energy storage and blade deflections along focused regions of load bearing members and the hydrofoil (164). Methods are also disclosed for reducing induced drag vortex formation along the lee surface of the hydrofoil (164), reducing drag and increasing the formation of lift forces.

170 Claims, 20 Drawing Sheets

U.S. PATENT DOCUMENTS

| | | | |
|---|---|---|---|
| 783,012 | A | 2/1905 | Biedermann et al. |
| 787,291 | A | 4/1905 | Michiels |
| 871,059 | A | 11/1907 | Douse |
| 998,146 | A | 7/1911 | Alfier et al. |
| 1,324,722 | A | 12/1919 | Bergin |
| 1,607,857 | A | 5/1926 | Zukal |
| 1,684,714 | A | 9/1928 | Perry |
| 2,241,305 | A | 5/1941 | Hill, Jr. |
| 2,321,009 | A | 6/1943 | Churchill |
| 2,343,468 | A | 3/1944 | Messinger |
| 2,423,571 | A | 7/1947 | Wilen |
| 2,588,363 | A | 3/1952 | Corlieu |
| 2,850,487 | A | 9/1958 | D'Alello |
| 2,865,033 | A | 12/1958 | Jayet |
| 2,889,563 | A | 6/1959 | Lamb et al. |
| 2,903,719 | A | 9/1959 | Wozencraft |
| 2,950,487 | A | 8/1960 | Woods |
| 3,019,458 | A | 2/1962 | Barbieri et al. |
| 3,055,025 | A | 9/1962 | Ferraro et al. |
| 3,082,442 | A | 3/1963 | Cousteau et al. |
| 3,084,355 | A | 4/1963 | Ciccotelli |
| 3,086,492 | A | 4/1963 | Holley |
| 3,112,503 | A | 12/1963 | Girden |
| 3,171,142 | A | 3/1965 | Auzols |
| 3,239,857 | A | 3/1966 | Gwynne |
| 3,256,540 | A | 6/1966 | Novelli |
| 3,411,165 | A | 11/1968 | Murdoch |
| 3,422,470 | A | 1/1969 | Mares |
| 3,453,981 | A | 7/1969 | Gause |
| 3,491,997 | A | 1/1970 | Winters |
| 3,665,535 | A | 5/1972 | Picken |
| 3,773,011 | A | 11/1973 | Gronier |
| 3,922,741 | A | 12/1975 | Semeia |
| 3,934,290 | A | 1/1976 | Le Vasseur |
| 4,007,506 | A | 2/1977 | Rasmussen |
| 4,025,977 | A | 5/1977 | Cronin |
| 4,083,071 | A | 4/1978 | Forjot |
| 4,193,371 | A | 3/1980 | Baulard-Caugan |
| 4,197,869 | A | 4/1980 | Moncrieff-Yeates |
| 4,209,866 | A | 7/1980 | Loeffler |
| 4,342,558 | A | 8/1982 | Wilson |
| D278,165 | S | 3/1985 | Evans |
| 4,521,220 | A | 6/1985 | Schoofs |
| 4,541,810 | A | 9/1985 | Wenzel |
| 4,657,515 | A | 4/1987 | Ciccotelli |
| 4,689,029 | A | 8/1987 | Ciccotelli |
| 4,738,645 | A | 4/1988 | Garofalo |
| 4,752,259 | A | 6/1988 | Tackett et al. |
| 4,773,885 | A | 9/1988 | Ciccotelli |
| 4,775,343 | A | 10/1988 | Lamont et al. |
| 4,781,637 | A | 11/1988 | Caires |
| 4,820,218 | A | 4/1989 | Van de Pol |
| D302,999 | S | 8/1989 | McCredie |
| 4,857,024 | A | 8/1989 | Evans |
| 4,869,696 | A | 9/1989 | Ciccotelli |
| 4,895,537 | A | 1/1990 | Ciccotelli |
| 4,929,206 | A | 5/1990 | Evans |
| 4,934,971 | A | 6/1990 | Picken |
| 4,940,437 | A | 7/1990 | Piatt |
| 4,944,703 | A | 7/1990 | Mosier |
| 4,954,111 | A | 9/1990 | Cressi |
| 4,954,112 | A | 9/1990 | Negrini et al. |
| D327,933 | S | 7/1992 | Evans |
| D327,934 | S | 7/1992 | Evans |
| D327,935 | S | 7/1992 | Evans |
| D328,118 | S | 7/1992 | Evans |
| 5,163,859 | A | 11/1992 | Beltrani et al. |
| D340,272 | S | 10/1993 | Evans |
| 5,304,081 | A | 4/1994 | Takizawa |
| 5,324,219 | A | 6/1994 | Beltrani et al. |
| 5,356,323 | A | 10/1994 | Evans |
| 5,358,323 | A | 10/1994 | Ripley |
| 5,358,439 | A | 10/1994 | Paolo |
| D353,181 | S | 12/1994 | Evans |
| 5,387,145 | A | 2/1995 | Wagner |
| 5,417,599 | A | 5/1995 | Evans |
| 5,429,536 | A | 7/1995 | Evans |
| 5,435,764 | A | 7/1995 | Testa et al. |
| 5,443,593 | A | 8/1995 | Garofalo |
| 5,522,748 | A | 6/1996 | Cressi |
| 5,527,197 | A | 6/1996 | Evans |
| 5,533,918 | A | 7/1996 | Sanders |
| 5,595,518 | A | 1/1997 | Ours |
| 5,597,336 | A | 1/1997 | Evans |
| D393,684 | S | 4/1998 | Lin |
| 5,746,631 | A | 5/1998 | McCarthy |
| D396,897 | S | 8/1998 | Evans |
| 5,810,629 | A | 9/1998 | Parr |
| D404,456 | S | 1/1999 | Evans |
| 6,050,868 | A | 4/2000 | McCarthy |
| 6,095,879 | A | 8/2000 | McCarthy |
| 6,126,503 | A | 10/2000 | Viale et al. |
| 6,146,224 | A | 11/2000 | McCarthy |
| 6,364,728 | B1 * | 4/2002 | Viale et al. ..... 441/64 |

FOREIGN PATENT DOCUMENTS

| | | |
|---|---|---|
| FR | 1245395 | 1/1960 |
| FR | 1208636 | 2/1960 |
| FR | 1.245.395 | 9/1960 |
| FR | 1501208 | 11/1967 |
| FR | 2 058 941 | 5/1971 |
| FR | 2 213 072 | 8/1974 |
| FR | 2 543 841 | 4/1983 |
| FR | 2574 748 A | 6/1986 |
| GB | 1284765 | 8/1972 |
| GB | 17033 | 10/1980 |
| IT | 553307 | 4/1956 |
| IT | 625377 | 9/1961 |
| JP | 61-6097 | 1/1986 |
| JP | 62 134395 | 6/1987 |
| SU | 1323 463 A | 3/1986 |

OTHER PUBLICATIONS

Triantafyllou, Michael S. and Triantafyllou George S., entitled, "An Efficient Swimming Machine", Scientific American, Mar. 1995, pp. 64–70.

"3302 of 1880" (Picture From Book–Found in US PTO).

"Test Dive" Article in Jan./Feb. 1996 issue of *Sport Diver Magazine*.

"Oceanic V–Drive Fins" in May/Jun. 1996 Issue of *Sport Diver Magazine*.

Walton and Katz "Application of Leading–Edge Vortex Manipulations to Reduce Wing Rock Amplitudes" *Journal of Aircraft* vol. 30, No. 4, pp. 555–559.

Traub and Nurick "Effects of Wing–Tip Vortex Flaps" *Journal of Aircraft* vol. 30, No. 4, pp. 557–559.

Grantz and Marchman III" Trailing Edge Flap Influence on Leading Edge Vortex Flap Aerodynamics", *Journal of Aircraft* vol. 20, No. 2, pp. 165–169.

Rao "An Exploratory Study of Area–Efficient Vortex Flap Concepts" *Journal of Aircraft*, vol. 20, No. 12, pp. 1062–1067.

Lamar and Campbell "Vortex Flaps–Advanced Control Devices for Supercruise Fighters" Jan. 1984, Aerospace America.

"BZ" bodysurfing fin (Picture), 1st production in 1990.

"Blade Pro" bodysurfing fin (Picture), 1st production 1991.

"Wave Rebel" bodysurfing fin (Picture), 1st production 1994.

Art. 1400 Pinna "Professional" Fin (1989).

* cited by examiner

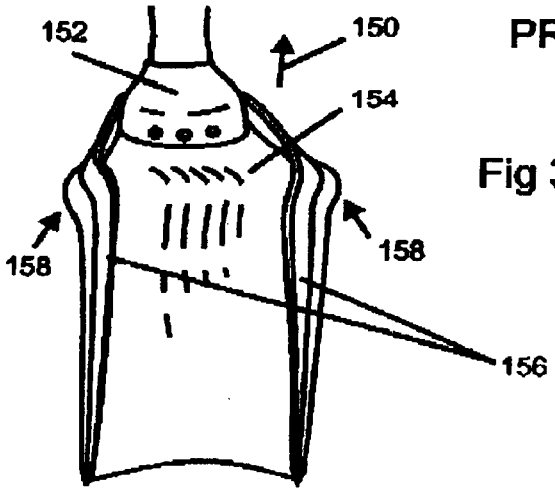
PRIOR ART
Fig 3
Fig 4 PRIOR ART
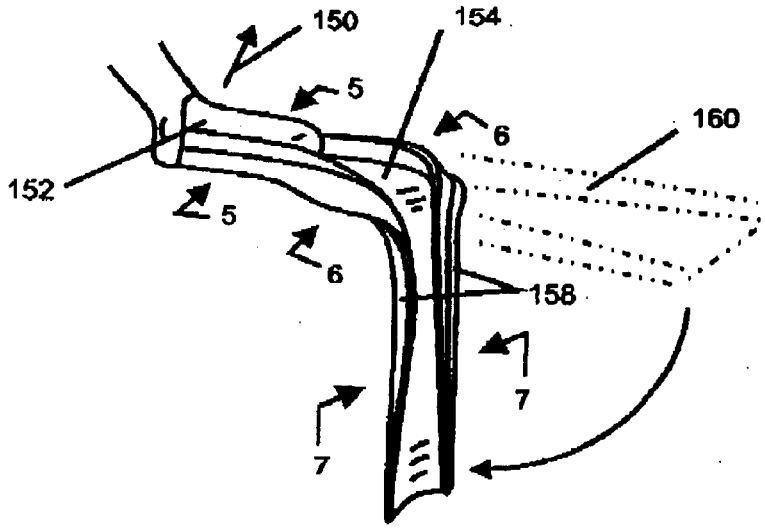
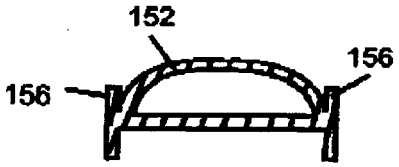
Fig 5 PRIOR ART
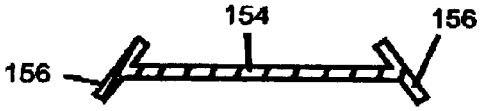
Fig 6 PRIOR ART
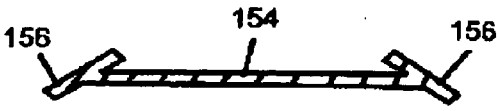
Fig 7 PRIOR ART

METHODS FOR CREATING LARGE SCALE FOCUSED BLADE DEFLECTIONS

RELATED APPLICATIONS

This application claims priority to U.S. Provisional Patent Application Ser. No. 60/202,560, filed May 10, 2000, entitled METHODS FOR CREATING LARGE SCALE FOCUSED BLADE DEFLECTIONS. This application is a continuation-in-part of U.S. patent application Ser. No. 09/630,374, filed Aug. 1, 2000, now U.S. Pat. No. 6,413, 133, entitled METHODS FOR CREATING CONSISTENT LARGE SCALE BLADE DEFLECTIONS, which is a continuation of U.S. patent application Ser. No. 09/311,505, filed May 13, 1999, now U.S. Pat. No. 6,095,879, which claims priority to U.S. Provisional Patent Application Serial No. 60/085,463, filed May 14, 1998.

BACKGROUND

1. Field of Invention

This invention relates to hydrofoils, specifically to such devices which are used to create directional movement relative to a fluid medium, and this invention also relates to swimming aids, specifically to such devices which attach to the feet of a swimmer and create propulsion from a kicking motion.

2. Description of Prior Art

None of the prior art fins provide methods for maximizing the storage of energy during use or maximizing the release of such stored energy in a manner that produces significant improvements in efficiency, speed, and performance.

No prior fin designs employ adequate or effective methods for reducing the blade's angle of attack around a transverse axis sufficiently enough to reduce drag and create lift in a significantly consistent manner on both relatively light and relatively hard kicking strokes.

Prior art beliefs, convictions, and design principles teach that highly flexible blades are not effective for producing high swimming speeds. Such prior principles teach that high flexibility wastes energy since it permits kicking energy to be wasted in deforming the blade rather than pushing water backward to propel the swimmer forward. A worldwide industry convention among fin designers, manufactures, retailers and end users is that the more flexible the blade, the less able it is to produce power and high speed. The industry also believes that the stiffer the blade, the less energy is wasted deforming on the blade and the more effective the fin is at producing high speeds. The reason the entire industry believes this to be true is that no effective methods have existed for designing blades and load bearing ribs that exhibit large levels of blade deflection around a transverse axis in a manner that is capable of producing ultra-high swimming speeds. Prior fin design principles also teach that the greater the degree of blade deflection around a transverse axis on each opposing kicking stroke, the greater the degree of lost motion that occurs at the inversion point of each stroke where the blade pivots loosely from the high angle of deflection on one stroke, through the blade's neutral position, and finally to the high angle of deflection on the opposite stroke. Prior principles teach that lost motion wastes kicking energy throughout a significantly wide range of each stroke because kicking energy is expended on reversing the angle of the blade rather that pushing water backward. Also, prior principles teach that the greater the degree of flexibility and range of blade deflection, the greater the degree of lost motion and the larger the portion of each kicking stroke that is wasted on deflecting the blade and the smaller the portion of the stroke that is used for creating propulsion. Furthermore, prior principles teach that such highly deflectable blades are vulnerable to over deflection during hard kicks when high swimming speeds are required. Although it is commonly known that highly deflectable blades create lower strain and are easier to use at slow speeds, such highly deflectable blades are considered to be undesirable and unmarketable since prior versions have proven to not work well when high swimming speeds are required.

Because prior fins are made significantly stiff to reduce lost motion between strokes as well as to reduce excessive blade deflection during hard kicks, prior fins place the blade at excessively high angles of attack during use. This prevents water from flowing smoothly around the low-pressure surface or lee surface of the blade and creates high levels of turbulence. This turbulence creates stall conditions that prevent the blade from generating lift and also create high levels of drag.

Since the blade remains at a high angle of attack that places the blade at a significantly horizontal orientation while the direction of kicking occurs in a vertical direction, most of the swimmer's kicking energy is wasted pushing water upward and downward rather that pushing water backward to create forward propulsion. When prior fins are made flexible enough to bend sufficiently around a transverse axis to reach an orientation capable of pushing water in a significantly backward direction, the lack of bending resistance that enables the blade to deflect this amount also prevents the blade from exerting a significant backward force upon the water and therefore propulsion is poor. This lack of bending resistance also subjects the blade to high levels of lost motion and enables the blade to deflect to an excessively low angle of attack during a hard kick that is incapable of producing significant lift. In addition, prior fin design methods that could permit such high deflections to occur do not permit significant energy to be stored in the fin during use and the fin does not snap back with significant energy during use. Again, a major dilemma occurs with prior fin designs: poor performance occurs when the fin is too flexible and when it is too stiff.

One of the major disadvantages that plague prior fin designs is excessive drag. This causes painful muscle fatigue and cramps within the swimmer's feet, ankles, and legs. In the popular sports of snorkeling and SCUBA diving, this problem severely reduces stamina, potential swimming distances, and the ability to swim against strong currents. Leg cramps often occur suddenly and can become so painful that the swimmer is unable to kick, thereby rendering the swimmer immobile in the water. Even when leg cramps are not occurring, the energy used to combat high levels of drag accelerates air consumption and reduces overall dive time for SCUBA divers. In addition, higher levels of exertion have been shown to increase the risk of attaining decompression sickness for SCUBA divers. Excessive drag also increases the difficulty of kicking the swim fins in a fast manner to quickly accelerate away from a dangerous situation. Attempts to do so, place excessive levels of strain upon the ankles and legs, while only a small increase in speed is accomplished. This level of exertion is difficult to maintain for more than a short distance. For these reasons scuba divers use slow and long kicking stokes while using conventional scuba fins. This slow kicking motion combines with low levels of propulsion to create significantly slow forward progress.

Another problem with many prior fin designs is that they exhibit severe performance problems when they are used for swimming across the surface of the water. While kicking the fins at the water's surface, they break through the surface on the up stroke, and then on the down stroke they "catch" or "slap" on the surface as they re-enter the water at a high angle of and downward movement is abruptly stopped. This instantaneous deceleration creates high levels of strain and discomfort for the user's ankles and lower leg muscles. Because downward movement ceases upon impact with the water, this energy is wasted and is not converted into forward propulsion. Over large distances, this problem can create substantial fatigue for snorkeling skin divers, body surfers, and body board surfers who spend most of their time kicking their fins along the water's surface. It is also a problem for SCUBA divers who swim along the surface to and from a dive site in an attempt to conserve their supply of compressed air. Fatigue and muscle strain to SCUBA divers during surface swims is particularly high because prior SCUBA type fins have significantly long lengthwise dimensions and high angles of attack. This causes increased levels of torque to be applied to the diver's ankles and lower legs as the blade slaps the surface of the water. Because such longer fins create high levels of drag from a decreased aspect ratio, prior SCUBA type fins are significantly slow to re-gaining downward movement after catching on the water's surface. Even below the surface, such prior fins offer poor propulsion and high levels of drag that severely detract from overall diving pleasure.

Prior art fin designs do not employ efficient and methods for enabling the blade to bend around a transverse axis to sufficiently reduced angles of attack that are capable of generating lift while also providing efficient and effective methods for enabling such reduced angles of attack to occur consistently on both light and hard kicking strokes.

Prior art fins often allow the blade to flex or bend around a transverse axis so that the blade's angle of attack is reduced under the exertion of water pressure. Although prior art blades are somewhat flexible, they are usually made relatively stiff so that the blade has sufficient bending resistance to enable the swimmer to push against the water without excessively deflecting the blade. If the blade bends too far, then the kicking energy is wasted on deforming the blade since the force of water applied to the blade is not transferred efficiently back to the swimmers foot to create forward movement. This is a problem if the swimmer requires high speed to escape a dangerous situation, swim against a strong current, or to rescue another swimnmer. If the blade bends too far on a hard kick, the swimmer will have difficulty achieving high speeds. For this reason, prior fins are made sufficiently stiff to not bend to an excessively low angle of attack during hard and strong kicking stokes.

Because prior fin blades are made stiff enough so that they do not bend excessively under the force of water created during a hard kick, they are too stiff to bend to a sufficiently reduced angle of attack during a relatively light stroke used for relaxed cruising speeds. If a swim fin blade is made flexible enough to deflect to a sufficiently reduced angle of attack during a light kick, it will over deflect under the significantly higher force of water pressure during a hard kick. Prior fins have been plagued with this dilemma. As a result, prior fins are either too stiff during slower cruise speeds in order to permit effectiveness at higher speeds, or fins they are flexible and easy to use at slow speeds but lack the ability to hold up under the increased stress of high speeds. This is a major problem since the goal of scuba diving is mainly to swim slowly in order to relax, conserve energy, reduce exertion, and conserve air usage. Because of this, prior fins that are stiff enough to not over deflect during high speeds will create muscle strain, high exertion, discomfort, and increased air consumption during the majority of the time spent at slow speeds.

Because prior art fins attempt to use significantly rigid materials within load bearing ribs and blades to prevent over deflection, the natural resonant frequency of these load bearing members is significantly too high to substantially match the kicking frequency of the swimmer. None of the prior art discloses that such a relationship is desirable, that potential benefits are known, or that a method exists for accomplishing this in an efficient manner that significantly improves performance.

Some prior designs attempt to achieve consistent large scale blade deflections by connecting a transversely pivoting blade to a wire frame that extends in front of the foot pocket and using either a yieldable or non-yieldable chord that connects the leading edge of the blade to the foot pocket to limit the blade angle. This approach requires the use of many parts that increase difficulty and cost of manufacturing. The greater the number of moving parts, the greater the chance for breakage and wear. Many of these designs use metal parts that are vulnerable to corrosion and also add undesirable weight. Variations of this approach are seen in U.S. Pat. No. 3,665,535 (1972) and U.S. Pat. No. 4,934,971 (1988) to Picken, and U.S. Pat. No. 4,657,515 (1978), and U.S. Pat. No. 4,869,696 (1989) to Ciccotelli. U.S. Pat. No. 4,934,971 (1988) to Picken shows a fin which uses a blade that pivots around a transverse axis in order to achieve a decreased angle of attack on each stroke. Because the distance between the pivoting axis and the trailing edge is significantly large, the trailing edge sweeps up and down over a considerable distance between strokes until it switches over to its new position. During this movement, lost motion occurs since little of the swimmer's kicking motion is permitted to assist with propulsion. The greater the reduction in the angle of attack occurring on each stroke, the greater this problem becomes. If the blade is allowed to pivot to a low enough angle of attack to prevent the blade from stalling, high levels of lost motion render the blade highly inefficient. This design was briefly brought to market and received poor response from the market as well as ScubaLab, an independent dive equipment evaluation organization that conducts evaluations for Rodale's Scuba Diving magazine. Evaluators stated that the fin performed poorly on many kick styles and was difficult to use while swimming on the surface. The divers reported that they had to kick harder with these fins to get moving in comparison to other fin designs. The fins created high levels of leg strain and were disliked by evaluators. A major problem with this design approach is that swimmers disliked the snap or click of the blade reaching its limits at the end of each fin stroke.

This design approach produces poor performance for several reasons. The large range of motion of the blade creates lost motion at the inversion point of each stroke where the fins produces little or no propulsion until it reverses its angle of attack and reaches its limit of pivotal movement. The pivotal hinge approach with abrupt limits in motion creates an unsteady and jerky movement and large gaps in the kick cycle where propulsion is missing. The sudden impact of water pressure created as the blade reaches its limits creates a shock to the user's muscles and joints that increases strain, fatigue, and tendency of cramping.

Because the blade hinges near its leading edge and the restraining chord is connected to this leading edge, the moment arm is very short between the hinging axis and the connecting point of the restraining chord. The force of water exerted on the blade between the hinging axis and the trailing edge of the blade is multiplied many times as it is applied to the restraining chord due to the much shorter leading edge moment arm. A heavy kick can produce extremely high stress on the restraining chord. If the chord is elastic, such a high strain can overextend the chord beyond its yielding point so that the blade's angle of attack increases beyond the desired level. The high level of force created by the short moment arm can suddenly extend a relatively small elastic chord (as shown in many of these design approaches) to its inelastic limit to create an abrupt stop in motion that creates a shock to the user's foot and leg. The chord's vulnerability for over extending is increased because of the relatively small cross-section of the restraining chords used in these examples. Repeated use can cause the chord to stretch out over time so that the blade's range of motion further increases over time to inhibit performance. If a larger size chord is used, the blade will not rotate enough under a light kicking stroke. If the chord is small enough to enable the blade to rotate enough during a light kicking stroke, it will abruptly stop at the outer pivotal limit and transfer a sudden shock to the user's leg during a hard kick.

The large distance the chord must stretch during use in order to restrain the blade further inhibits performance. Because the leading edge rotates up and down relative to the foot pocket during use, the chord must stretch vertically over large distances if the blade is to rotate to significantly reduced angles of attack. Because the chord is short at the neutral position, it must stretch and elongate by several times its original length in order to permit the blade to pivot to significantly reduced angles of attack. For this to occur under the low levels of force created during light kicking strokes, the chord must be extraordinarily elastic and have a very low modulus of elasticity (ratio of stress to strain, or load to deflection). The lower the modulus of elasticity, the weaker the material and therefore the less reliable the holding power of the material. Because stronger materials are less elastic, a stronger material capable of holding well under hard kicks will not permit sufficient deflection under light kicks. No effective methods for solving this issue are disclosed.

Because the chord is significantly short at the neutral position in an effort to reduce the occurrence of slack within the chord, the total volume of the chord's material is relatively small. This causes the high stresses in the chord to be distributed over a very small volume of material. This increases vulnerability to over extension and deformation of the material. The small material volume severely limits energy storage within the material. At the inversion point of the kick cycle, the chord provides poor snap back because its energy storage is significantly low and its moment arm is small.

Another problem is that significant levels of slack exist in the chord as the blade pivots close to the neutral position. As the leading edge pivots back toward the neutral position, the alignment of the restraining chord becomes more horizontal and less vertical. This substantially reduces the chord's ability to apply vertical tension to restrain the blade or control its movement. This reduces the ability for energy stored in the elastic chord to be transferred to the blade for effective propulsion. The chord becomes less able to apply propulsive force as it moves the blade from the pivotal limit back to the neutral position. This is highly undesirable and causes energy to be wasted. The lack of vertical tension near the neutral position also permits the blade to move without restraint or control. This increases the severity of the sudden click created as the tension suddenly abruptly increases at the limit of pivotal range. The lack of tension near the neutral position also prevents energy from being stored in this region and the kinetic energy of the blade is wasted. Because the chord has a significant horizontal inclination throughout the entire range of rotation, a significant portion of the tension within the chord is directed in a horizontal direction that does not assist with the vertical restraint or return movement of the blade. This wastes stored energy and destroys efficiency.

If non-elastic chords are used then there is zero snap back energy at the inversion point of each kick and the blade stops with increased shock at the limits of pivoting. Lost motion is extremely high in this situation and performance is exceptionally poor.

Prior fin designs using longitudinal load bearing ribs for controlling blade deflections around a transverse axis do not employ adequate methods for reducing the blade's angle of attack sufficiently enough to reduce drag and create lift in a significantly consistent manner on both relatively light and relatively hard kicking strokes. Many prior art fins use substantially longitudinal load bearing support ribs to control the degree to which the blade is able to bend around a transverse axis. These ribs typically connect the foot pocket to the blade portion and extend along a significant length of the blade. The ribs usually extend vertically above the upper surface of the blade and/or below the lower surface of the blade and taper from the foot pocket toward the trailing edge of the blade. Hooke's Law states that strain, or deflection, is proportional to stress, or load placed on the rib. Therefore the deflection of a flexible rib the load varies in proportion to the load placed on it. A light kick produces a minimal blade deflection, a moderate kick produces a moderate blade deflection, and a hard kick produces a maximum blade deflection. Because of this, prior art design methods for designing load supporting ribs do produce significantly consistent large-scale blade deflections from light to hard kicks.

Prior fin designs using longitudinal load bearing ribs for controlling blade deflections around a transverse axis do not employ adequate methods for reducing the blade's angle of attack sufficiently enough to reduce drag and create lift in a significantly consistent manner on both relatively light and relatively hard kicking strokes.

These ribs are designed to control the blade's degree of bending around a transverse axis during use. Because of the need for the blade to not over deflect during hard kicking strokes, the ribs used in prior fin designs are made relatively rigid. This prevents the blade from deflecting sufficiently during a light kick. This is because the rib acts like a spring that deflects in proportion to the load on it. Higher loads produce larger deflections while lower loads produce smaller deflections. Because prior fins cannot achieve both of these performance criteria simultaneously, prior designs provide stiff ribs to permit hard kicks to be used. The ribs often use relatively rigid thermoplastics such as EVA (ethylene vinyl acetate) and fiber reinforced thermoplastics that have short elongation ranges that are typically less than 5% under high strain and compression ranges that are much smaller. When rubber ribs are used, harder rubbers having large cross sections are used to provide stiff blades that under deflect during hard kicks so that they do not over deflect during hard kicks.

Even if more flexible materials are substituted in the ribs to enable the blade to deflect more under a hard kick, no prior art method discloses how to efficiently prevent the blade from over deflecting on a hard kick.

The vertical height of prior stiffening ribs often have increased taper near the trailing edge of the blade to permit the tip of the blade to deflect more during use. Flexibility is achieved by reducing the vertical height of the rib since this lowers the strain on the material and therefore reduces bending resistance. Again, no method is used to provide consistent deflections across widely varying loads. The approach of reducing the vertical height of a rib to increase flexibility is not efficient since it causes this portion of the rib to be more susceptible to over deflection and also reduces performance by minimizing energy storage within the rib. U.S. Pat. No. 4,895,537 (1990) to Ciccotelli reduces the height of a narrow portion on each of two longitudinal support beams to focus flexing in this region. This makes the ribs more susceptible to over deflection and minimizes energy storage.

Another problem is that prior fin design methods teach that in order to create a high powered snap-back effect the ribs must attain efficient spring characteristics by using materials that have good flexibility and memory but have relatively low ranges of elongation. Elongation is considered to be a source of energy loss while less extensible thermoplastics such as EVA and hi-tech composites containing materials such as graphite and fiberglass are considered to be state of the art for creating snap back qualities. These materials do not provide proper performance because they provide substantially linear spring deflection characteristics that cause the blade to either under deflect on a light kick or over deflect on a hard kick. Furthermore, these materials require that a small vertical thickness be used in order for significant bending to occur during use. This greatly reduces energy storage and reduces the power of the desired snap back.

The highly vertical and narrow cross-sectional shape of prior ribs makes them highly unstable and vulnerable to twisting during use. When the vertical rib is deflected downward, tension is created on the upper portion of the rib as well as compression on the lower portion of the rib. Because the material on the compression side must go somewhere, the lower portion of the rib tends to bow outward and buckle. This phenomenon can be quickly observed by holding a piece of paper on edge as a vertical beam and applying a downward bending force to either end of the paper. Even if the paper is used to carry a force over a small span, it will buckle sideways and collapse. This is because the rib's resistance to bending is greater than its resistance to sideways buckling. If more resilient materials are used in prior art rails, then the rails will buckle sideways and collapse. This causes the blade to over deflect.

Some prior art ribs have cross-sectional shapes that are less vulnerable to collapsing, however, none of these prior art examples teach how to create similar large-scale blade deflections on both light and hard kicking strokes.

U.S. Pat. No. 5,746,631 to McCarthy shows load bearing ribs that have a rounded cross-section, no methods are disclosed that permit such rails to store increased levels of energy or experience substantially consistent blade deflections on both light and hard kicking strokes. Although it is stated that alternate embodiments may permit the lengthwise rails to pivot around a lengthwise axis where the rails join the foot pocket so that the rails can flex near the foot pocket, no method is identified for creating consistent deflections on light and hard kicks. It is mentioned that the blades can be pivotally attached to the foot pocket to permit pivoting around a transverse axis and that once the blades have pivoted to their desired range limit, a suitable stopping device can be use to halt all other movement either gradually or immediately, and that such a stopping device may also provide some spring-like tension to snap the blades back to a neutral orientation at the end of a stroke. No specific and efficient type of stopping device, spring system, or efficient method of pivotally attaching the blades to the foot pocket is stated. It is mentioned that a small zone of decreased thickness may be created near the foot pocket to permit the base of the stiffening members, or side rails, to achieve some degree of backward bending around a transverse axis near the foot pocket. No mention is given as to which dimension such a reduction in thickness occurs. Also, the rails are stated as being significantly rigid and this prevents a reduction in the thickness of the rails from permitting the blade to bend to a substantially large reduced angle of attack around a transverse axis on a light kick while preventing the blade from over deflecting or collapsing during a hard kick. The preference for having spring tension to return the blade to a neutral blade position does not include methods for increasing energy storage and return during use.

U.S. Pat. No. 4,689,029 (1987) to Ciccotelli shows two flexible longitudinal ribs extending from the foot pocket to a blade spaced from the foot pocket. Although Ciccotelli states that these ribs have elliptical cross-sections to prevent twisting, he also states that these flexible ribs are made sufficiently rigid enough to no over deflect on hard kicks. The patent states that the "flexible beams are made of flexible plastic and graphite or glass fibers may be added to increase the stiffness and strength. The flexible beams have to be stiff enough to prevent excessive deflection of the blade on a hard kick by the swimmer otherwise a loss of thrust will result." This shows that he believes that stiffer ribs are required to provide maximum speed. This also shows that Ciccotelli believes that the use of softer and highly extensible materials in the ribs will cause over deflection to occur during hard kicks and therefore unsuitable for use when high swimming speeds are needed. FIG. 2 shows that the range of deflection (17) is quite small and does not produce a sufficiently large enough reduction in the angle of attack to create proper lift and to prevent stall conditions. This shows that Ciccotelli is not aware of the value of larger blade deflections. This limited range of deflection shows that the flexible beams he uses are only slightly flexible and relatively rigid. In addition to providing insufficient deflection, no method is given for creating such deflections in a consistent manner on both light and hard kicks. Ciccotelli also states that the elliptical cross-section of the beams near the foot pocket is approximately 1.500 by 0.640, and that a larger cross section would be required for stiffer models. The cross-sectional measurements are at a height to width ratio of approximately 3 to 1. If this ratio were used with soft and highly extensible materials, the ribs would buckle sideways and collapse during use. Also, the top view in FIG. 1 shows that the ribs bend around a slight corner before connecting to the wire frame. This corner creates high levels of instability within the rib and makes the rib even more vulnerable to buckling, especially when more extensible materials are used. No adequate methods or structure are disclosed that describe how to avoid buckling on softer materials or how to obtain consistent large-scale deflections on both light and hard kicks. No methods are disclosed for storing large sums of energy within the ribs and then releasing such energy during use.

U.S. Pat. No. 4,773,885 (1988) to Ciccotelli is a continuation-in-part of U.S. Pat. No. 4,689,029 (Ser. No. 842,282) to Ciccotelli that is described above. U.S. Pat. No. 4,689,029 displays that Ciccotelli still does not disclose a method for creating large scale blade deflections on light kicks while simultaneously preventing over deflection on hard kicks. Although U.S. Pat. No. 4,773,885 describes flexible beams that are made of a rubber-like thermoplastic elastomer, the purpose of these flexible beams are to enable to beams to flex sufficiently enough to enable a diver to walk across land or through heavy surf. No method is disclosed to for designing such beams to create consistent large-scale blade deflections on varying loads. No mention is made of any attempts to create large-scale blade deflections on light kicks. The only benefit listed to having flexible beams is to enable the diver to walk across land while carrying equipment. No mention is made of methods for creating and controlling specific blade deflections and no mention is made for optimizing the storage of energy. This shows that Ciccotelli is not aware that such benefits are possible and is not aware of any methods or processes for creating and optimizing such benefits. Furthermore, Ciccotelli states in column 3 lines 20 through 37 that "The beams 2 are sufficiently flexible to bend enough so that the wearer, with his foot in the pocket 1 can walk along a beach in a normal fashion, with his heel raising as his foot rolls forward on its ball. Nevertheless, beams 2 are sufficiently stiff that during swimming, the flexible beams 2 flex only enough to provide good finning action of the blade 4, in accordance with the principles described in the above-referenced application Ser. No. 842,282." He states that the beams must be stiff in accordance with the principles of Ser. No. 842,282 (U.S. Pat. No. 4,689,029) which only shows a substantially small range of blade deflection (17) in FIG. 2 of the drawings. U.S. Pat. No. 4,773,885 shows no desired range of blade deflection in the drawings and specifically states that during swimming the beams act in accordance with what is now U.S. Pat. No. 4,689,029 which shows in FIG. 2 the small range of flexibility Ciccotelli believes is ideal. This range is too small since it does not permit the blade to reach a sufficiently reduced angle of attack to efficiently create lift and reduce stall conditions. Because he states that the beams should be stiff enough to not over deflect during a hard kick and only shows a small range of deflection (17) in FIG. 2, it is evident that Ciccotelli believes that deflections in excess of range 17 in FIG. 2 is an "excessive deflection" that will cause a "loss of thrust". He discloses no other information to specify what he believes to be an excessive angle of deflection. This shows that shows that Ciccotelli does not intend his flexible beams to be used in a manner that enables the blade to experience significantly high levels of deflection. This also shows that Ciccotelli is unaware of any benefits of large-scale blade deflections and is unaware of methods for designing ribs in a manner that create new benefits or new unexpected results from large-scale blade deflections.

Another problem with U.S. Pat. No. 4,773,885 is that the cross sectional shape of the rail creates vulnerability to twisting and buckling. Ciccotelli admits that the beams tend to buckle and twist when the blade deflects while walking on land. If the beams buckle and twist under the larger deflections occurring while walking, the beams will also buckle and twist if the beams are made with sufficiently flexible enough grades of elastomeric materials to exhibit high levels of blade deflections during use. The reason the rails are vulnerable to buckling is that the first stages of twisting causes the rectangular cross-section to turn to a tilted diamond shape relative to the direction of bending. The upper and lower corners of this portion of the beam are off center from the beam axis (the axis passing through the cross-sectional geometric center of the beam) of the beam during bending. These corners also extend higher above and below the beam axis relative to bending than the upper and lower surfaces of the rectangular cross section that existed before twisting. Because stresses are greatest at the highest points above and below the beam's neutral surface (a horizontal plane within the beam relative to vertical bending, in which zero bending stress exists), these tilted corners have the highest levels of strain in the form of tension and compression. Because these corners and the high strain within them are oriented off center from the beam axis, a twisting moment is formed which cause the beams to buckle prematurely while bending. As the beam twists along its length, bending resistance and twisting moments vary along the length of the beam. This causes the beams to bend unevenly and forces energy to be lost in twisting the beam rather than creating propulsion. Although Ciccotelli provides extra width at the lower end of the beam to reduce the bulking there under compression, he states that this is done to reduce buckling if the blade jams into the ground while walking. He does not state that he this is done to create any benefits while swimming. He does not use cross sectional thickness to create new and unobvious benefits while swimming. Because desires small ranges of blade deflection, he does not disclose a method for using cross-sectional shape in a manner that enables high levels of deflection to occur on light kicks while preventing excessive deflection on hard kicks. He also does not disclose any methods for using cross-sectional shapes to provide increased energy storage.

None of the prior art discloses methods for designing longitudinal load bearing ribs that are able to permit the blade to reach high levels of provide specific minimum and maximum reduced angles of attack around a transverse axis that are desired at slow swimming speeds and maximum reduced angles of attack that are desired at high swimming speeds along with an efficient and effective method for achieving these minimum and maximum angles regardless of swimming speeds.

U.S. Pat. No. 2,950,487 to Woods (1954) uses a horizontal blade mounted on the upper surface of the foot which rotates around a transverse axis to achieve a reduced angle of attack on both the upstroke and the down stroke. This design suffers from high levels of lost motion and creates a shock to the users foot and leg as the blade reaches its limits on each kick. No adequate method is used to store energy during use.

U.S. Pat. No. 3,084,355 to Ciccotelli (1963) uses several narrow hydrofoils that rotate along a transverse axis and are mounted parallel to each other in a direction that is perpendicular to the direction of swimming. The blades rotate loosely in a manner that creates lost motion and no method is used to efficiently store and release energy.

U.S. Pat. No. 3,411,165 to Murdoch (1966) displays a fin which uses a narrow stiffening member that is located along each side of the blade, and a third stiffening member that is located along the central axis of the blade. Although oval shaped ribs are shown, the use of metal rods within the core of these ribs prevents bending from occurring. No method is disclosed for optimizing the storage and recovery of energy. A major problem with scoop designs is that the angle of attack is high and significant backpressure develops within each pocket causing water to spill around the side edges of the pocket like an overfilled cup. Induced drag is high, propulsion is poor and only a small amount of water is discharged aftward.

French patent 1,501,208 to Barnoin (1967) employs two side by side blades that are oriented within a horizontal plane and extend from the toe of the foot compartment. Each of the blades have a triangular wedge shaped transverse cross-section with the thicker portion existing along the outer edge and the thinner portion on the inside edge. The cross-sectional or end view shown displays that no load bearing ribs are used. No methods are disclosed for creating consistent large-scale deflections under varying loads or for creating increased energy storage.

German patent 259,353 to Braunkohlen (1987) suffers from many of the same problems and structural inadequacies as Barnoin's fin discussed above Each of the blades have a triangular wedge shaped transverse cross-section with the thicker portion existing along the outer edge and the thinner portion on the inside edge. The cross-sectional or end view shown displays that no load bearing ribs are used. No methods are disclosed for creating consistent large-scale deflections under varying loads or for creating increased energy storage.

U.S. Pat. No. 4,007,506 to Rasmussen (1977) uses a series of rib-like stiffeners arranged in a lengthwise manner along the blade of a swim fin. The ribs are intended to cause the blade to deform around a transverse axis so that the trailing portions of the blade curl concavely in the direction of the kicking stroke. The blade employs no method for adequately decreasing induced drag. The blade's high angle of attack stalls the blade and prevents smooth flow from occurring along its low-pressure surface. No methods are disclosed for creating consistent large-scale deflections under varying loads or for creating increased energy storage.

U.S. Pat. No. 4,025,977 to Cronin (1977) shows a fin in which the blade is aligned with the swimmers lower leg. This design is highly inefficient on the upstroke and creates high levels of lost motion. No methods are disclosed for creating for reducing lost motion or for creating increased energy storage.

U.S. Pat. No. 4,541,810 to Wenzel (1985) employs load supporting ribs that have a cross-section that is wide in its transverse dimension and thin in its vertical dimension. The rib is intended to twist during use. The thin vertical height of the rib prevents efficient energy storage and no methods are disclosed for creating consistent large-scale blade deflections with the ribs.

U.S. Pat. No. 4,738,645 to Garofalo (1988) employs a single blade that deforms under water pressure to form a concave channel for directing water toward the trailing edge. The load bearing ribs are made of rigid material that place the blade at excessively high angles of attack. The rib's cross section has a thin horizontal dimension and a tall vertical dimension that make the blade vulnerable to twisting and buckling during use. No methods are disclosed for creating consistent large-scale deflections under varying loads or for creating increased energy storage.

U.S. Pat. No. 4,781,637 to Caires (1988) shows a single fin designed to be used by both feet in a dolphin style kicking motion. It uses a transversely aligned hydrofoil that extends from both sides of a centrally located foot pocket and rotates around a transverse stiffening rod. The central portion of the blade is fixed to a metal plate to prevent variation in the angle of attack there while the outer tip portions are described as being free to rotate throughout an arc of approximately 90 degrees. This creates a twist along the transverse length of the blade that creates stress forces of tension and compression that can prevent the tips from twisting to a substantially reduced angle of attack. In order for the tips to twist, the blade material must succumb to these stress forces of tension and compression that extend diagonally across the transverse length of each half of the blade. Because this forms a complex stress field over a large volume of material within the large transverse dimension of the blade, the blade material exhibits high levels of bending resistance and tends to buckle to avoid succumbing to these forces. The portion of the blade that tends to buckle exists between the trailing edge and an imaginary line drawn from the trailing portion of the central stiffening plate to the outer tips of the transverse stiffening rod. Such buckling enables the tip regions of the blade to deflect to an excessively low angle of attack during use that is incapable of producing lift. If the blade material is rigid enough to avoid buckling during use it will not deflect sufficiently enough at the tips to efficiently create lift and the majority of the blade stalls and creates drag. If the material is flexible enough to avoid the transversely diagonal stress forces, the blade buckles under strain and the buckled portion of the blade pivots loosely and lost motion is created. If material is chosen that is flexible enough to bend gradually during use to reach the desired 90-degree pivot range stated during a hard kick, the blade will under deflect during a light kick. If the blade is loose enough to deflect to the desired 90 degree angle during a light kick, it will over deflect during a hard kick. This design creates lost motion and no methods are disclosed for creating consistent large-scale deflections under varying loads or for creating increased energy storage.

U.S. Pat. No. 4,857,024 to Evans (1989) shows a fin that has a relatively thin flexible blade and uses no load bearing ribs. The center portion of the blade is made thicker to create increased bending resistance along the center. The drawings show that during use the stiffer central portion of the blade arches back around a transverse axis to an excessively reduced angle of attack where the blade then slashes back at the end of the stroke in a snapping motion to propel the swimmer forward. The blade deflects to an excessively low angle of attack to efficiently generate lift. The thin blade offers poor energy storage and snap back energy is low. Underwater tests conducted by ScubaLab, an independent dive equipment evaluation organization, utilized men and women divers wearing full scuba gear that swam numerous test runs over a measured 300-foot open ocean course. These tests found that this design consistently produced the lowest top end speeds of any production fins tested. No methods are disclosed for creating consistent large-scale deflections under varying loads or for creating increased energy storage.

Although the specification and drawings mention the formation of a snap back motion, no S-shaped substantially longitudinal sinusoidal waves are displayed in the drawings or described in the specification. Although the blade has a thicker central portion, this thicker portion is significantly too thin to permit the use of substantially soft materials that have significantly high elongation and compression rates since such flexibility would cause the blade to deflect excessively. As a result, this design is forced to use stiffer materials having significantly lower elongation and compression ranges under the loads created during kicking strokes. These types of materials support a natural resonant frequency that is significantly higher than the kicking frequency of a swimmer's strokes. No mention is made to suggest that such a condition is anticipated or desired. Although the tip regions are designed to flex relative to the thicker blade portion along the fin's center axis, the drawings and specification do not disclose a method for simultaneously creating opposing oscillation phases in an S-shaped manner along the length of the blade in general or along the length of the more flexible side regions of the blade.

The open toe foot pocket that encloses only the upper portion of the foot and permits the lower portion of the foot to pivot freely and independently of the blade, prevents efficient longitudinal wave generation along the blade because the forward portion of the foot near the toes is unable to exert a pivotal motion on the blade as opposing leverage is applied by the foot between the upper portion of the foot near the heel and the lower portion of the foot near the toes. This prevents the swimmer from applying leverage from the forward portions of the foot to effectively create a pivoting motion to the blade with rotations of the ankle. Because Evans' foot pocket is described as permitting free rotation of the lower portion of the foot relative to the blade in an effort to reduce ankle strain, it is evident that Evans is not aware of a method for effectively reducing ankle strain while significantly minimizing or eliminating movement of the lower portion of the foot relative to the blade.

U.S. Pat. No. 2,423,571 to Wilen (1944) shows a fin that has a stiffening member along the central axis of the blade that has a thin and highly flexible membrane extending to either side of the central stiffening member. The thin and flexible membrane is shown to undulate during use and have opposing oscillation phases along the length of the blade's side edges, in which a sinusoidal wave has adjacent peaks and troughs displayed by convex up and convex down ripples. The central stiffening member, or load bearing member does not have opposing oscillation phases and therefore Wilen does not anticipate the need for this to occur or provide an effective manner for permitting this to occur in a manner that prevents the member from over deflecting during a hard kicking stroke. Although it is mentioned that a more flexible material may be used at the blade of the central stiffening member to provide limited movement and pivoting near the foot pocket, no effective method is disclosed for permitting this more flexible material to allow significantly large scale blade deflections to occur during a light kick while preventing over deflection during a hard kick.

The thin membrane used in this fin is far too thin to effectively propagate a lengthwise wave having opposing phases of oscillation since the dampening effect of the surrounding water quickly dissipates the small amount of wave energy stored in this thin material. Instead of creating propulsion, the thin blade will flop loosely without having enough bending resistance to accelerate water. Rather than moving water, the thin membrane will over deflect and stay substantially motionless while the foot and stiffening member move up and down. Even though it is mentioned that stiffening members can be used to reinforce the side portions of the blade no method is disclosed for effectively preventing these portions from over deflecting during hard kicking strokes while also permitting large scale blade deflections to occur during light kicking strokes. No methods are disclosed that permit significantly increased energy to be stored and then released in the blade. Because such methods are not used or disclosed, this fin does not produce significant propulsion and is not usable.

From both the top view and the side view of FIG. 15 and FIG. 16, it can be seen that Wilen's fin creating a longitudinal wave that has many peaks and troughs across the length of the blade. This means that the frequency of the propagated wave is significantly higher than the frequency of kicking strokes. Wilen does not disclose methods for correlating blade undulation frequency, wavelength, amplitude, and period with the swimming stroke that creates new levels of performance and unexpected results.

A book reference found in the United States Patent and Trademark Office in class 115/subclass 28 labeled "3302 of 1880" shows a horizontally aligned reciprocating propulsion blade. The blades flex backward around a transverse axis in response to water pressure. No methods are disclosed for creating consistent large-scale deflections under varying loads or for creating increased energy storage.

U.S. Pat. No. 3,453,981 to Gause (1969) uses a series of horizontally aligned propulsion blades that are intended to convert wave energy into forward motion on a boat. No methods are disclosed for creating consistent large-scale deflections under varying loads or for creating increased energy storage.

OBJECTS AND ADVANTAGES

The methods for designing load bearing ribs that control blade deflections around a transverse axis that are provided by the present invention enable such ribs to function differently than the prior art while creating new and unexpected results. Not only are the methods of the present invention not disclosed by the prior art, the unexpected results achieved by these methods actually contradict the teachings of the prior art.

Where the prior art teaches that highly flexible blades perform poorly when a swimmer uses a strong kick while attempting to reach high speeds, the methods of the present invention enables a highly flexible blade to produce significantly higher speeds that any prior art fin.

Where the prior art teaches that high levels of blade deflection create high levels of lost motion and lost propulsion at the inversion point between, the methods of the present invention disclose how to create high levels of blade deflection in a manner that significantly reduces or even eliminates lost motion.

Where the prior art teaches that the inversion point of the kicking stroke is a source of energy loss that does not produce propulsion, the methods of the present invention show how to create levels of propulsion and speed that far exceed that of all prior art during the inversion portion of the stroke.

Where the prior art teaches that propulsion is lost as the blade reverses its deflection at the inversion point of each stroke and propulsion is only created after the blade is fully deflected, the methods of the present invention enable swimmers to create ultra-high levels of propulsion and speed even if the swimmer only uses the inversion portion of the stroke by continuously inverting the stroke before the blade is fully deflected.

Where prior art teaches that a blade that experiences high levels of deflection on a light kick will experience excessive levels of deflection on a hard kick, the methods of the present invention disclose how to design load bearing ribs that are capable of creating high levels of blade deflection during light kicks while preventing excessive deflection during hard kicks.

Where the prior art teaches that load bearing ribs made of significantly rigid and strong materials that have low levels of extensibility permit the blade to have an efficient snap back to neutral position at the end of a kick, the methods of the present invention show how load bearing ribs can be made with significantly soft and deformable materials to produce significantly increased levels of snap back over the prior art.

Where the prior art teaches that high levels of blade flexibility cause energy to be wasted in deforming the blade rather than creating a strong opposing force for pushing the water backward to create propulsion, the methods of the present invention show how energy used to deform the blade to a large-scale deflection can be efficiently stored within the material of the rib through high level elongation and compression, and then released at the end of the kick for increased energy return.

Accordingly, several objects and advantages of the present invention are:

(a) to provide hydrofoil designs that significantly reduce the occurrence of flow separation their low pressure surfaces (or lee surfaces) during use;

(b) to provide swim fin designs that significantly reduce the occurrence of ankle and leg fatigue;

(c) to provide swim fin designs which offer increased safety and enjoyment by significantly reducing a swimmer's chances of becoming inconvenienced or temporarily immobilized by leg, ankle, or foot cramps during use;

(d) to provide swim fin designs that are as easy to use for beginners as they are for advanced swimmers;

(e) to provide swim fin designs which do not require significant strength or athletic ability to use;

(f) to provide swim fin designs which can be kicked across the water's surface without catching or stopping abruptly on the water's surface as they re-enter the water after having been raised above the surface;

(g) to provide swim fin designs which provide high levels of propulsion and low levels of drag when used at the surface as well as below the surface;

(h) to provide swim fin designs which provide high levels of propulsion and low levels of drag even when significantly short and gentle kicking strokes are used;

(i) to provide methods for substantially reducing the formation of induced drag type vortices along the side edges of hydrofoils; to provide methods for reducing the blade's angle of attack around a transverse axis sufficiently enough to reduce drag and create lift in a significantly consistent manner on both relatively light and relatively hard kicking strokes;

(j) to provide methods for significantly increasing the degree to which the material within a load bearing rib experiences elongation and compression under the bending stresses created as the rib deflects to a significantly reduced angle of attack during a light kicking stroke;

(k) to provide methods for increasing elongation and compression within the rib's material by providing the rib's cross-section with sufficient vertical height above and below the rib's neutral surface to force high levels of elongation and compression to occur at the upper and lower portions of the rib as the blade deflects to a significantly reduced angle of attack during use, and by providing the rib with a sufficiently low modulus of elasticity to experience significantly high elongation and compression rates under significantly low tensile stress in an amount effective to permit the blade to deflect to a significantly low angle of attack under the force of water created on the blade during a substantially light kicking stroke;

(l) to provide methods for designing load bearing ribs to create consistent large-scale blade deflections on light kicks to a predetermined minimum angle of attack by matching rib cross-sectional geometry with the elongation and compression ranges and load conditions of highly extensible rib materials so that the rib's dimension require a specific elongation and compression rate to the blade to experience a large-scale deflection to a predetermined minimum angle of attack, and the rib's material is sufficiently extensible to reach such specific elongation and compression rates so that the blade is able to quickly reach this minimum angle of attack during a significantly light kick;

Still further objects and objectives will become apparent from a consideration of the ensuing description and drawings.

DRAWING FIGURES

FIGS. 1*a,* 1*b,* and 1*c,* show side views of prior art fins having lengthwise tapering blades or load bearing ribs that focus bending at the outer half of the blade and either under deflect on a light kick or over deflect during a hard kick.

FIGS. 2*a* and 2*b* show side views of prior art fins having blades that are able to experience bending between the foot pocket and the first half of the blade and tend to either under deflect during a light kick or over deflect during a hard kick.

FIGS. 2*a* and 2*b* show side view of prior art fins that have blades that are able to bend close to the foot pocket and tend to either under deflect during a light kick or over deflect during a hard kick.

FIG. 3 shows a front perspective view of a prior art fin that is being kicked forward and has tall and thin load bearing ribs that are buckling and twisting during use.

FIG. 4 shows a side perspective view of the same prior art fin shown in FIG. 3 that has rails that are twisting and collapsing.

FIG. 5 shows a cross sectional view taken along the line 5—5 from FIG. 4.

FIG. 6 shows a cross sectional view taken along the line 6—6 from FIG. 4.

FIG. 7 shows a cross sectional view taken along the line 7—7 from FIG. 4.

Figure 8:
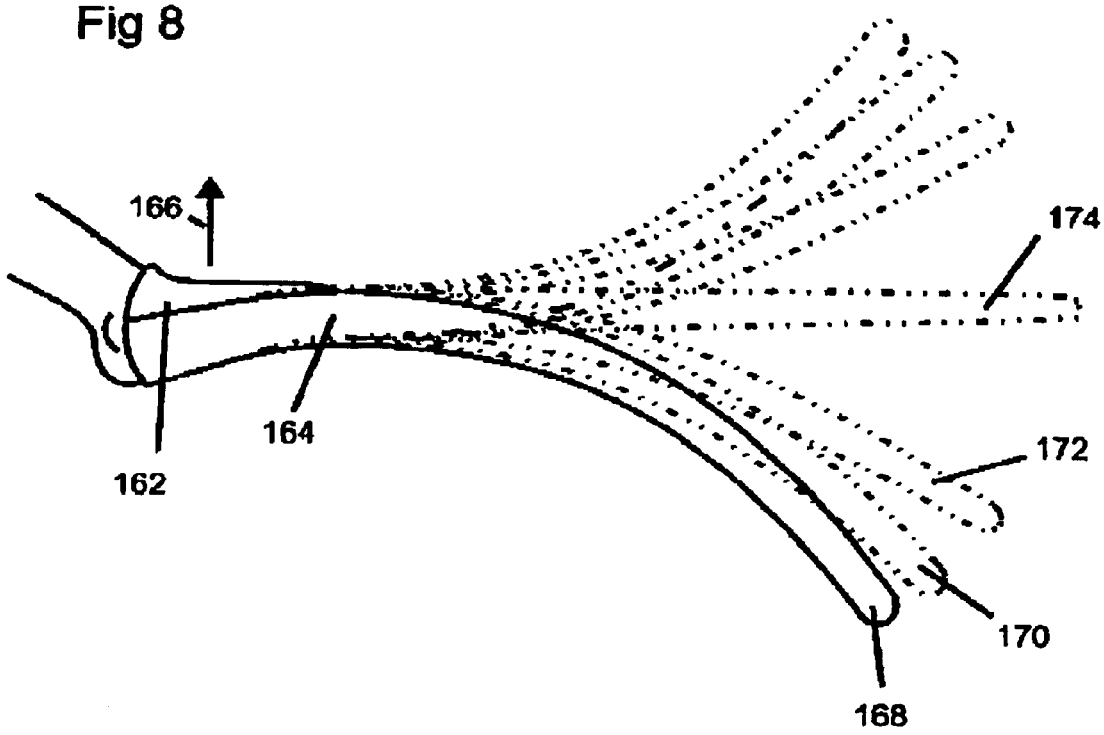
FIG. 8 shows a side view of a swim fin using the methods of the present invention to permit significantly consistent large scale blade deflections to occur on light, medium, and hard kicking strokes.
Figure 9:
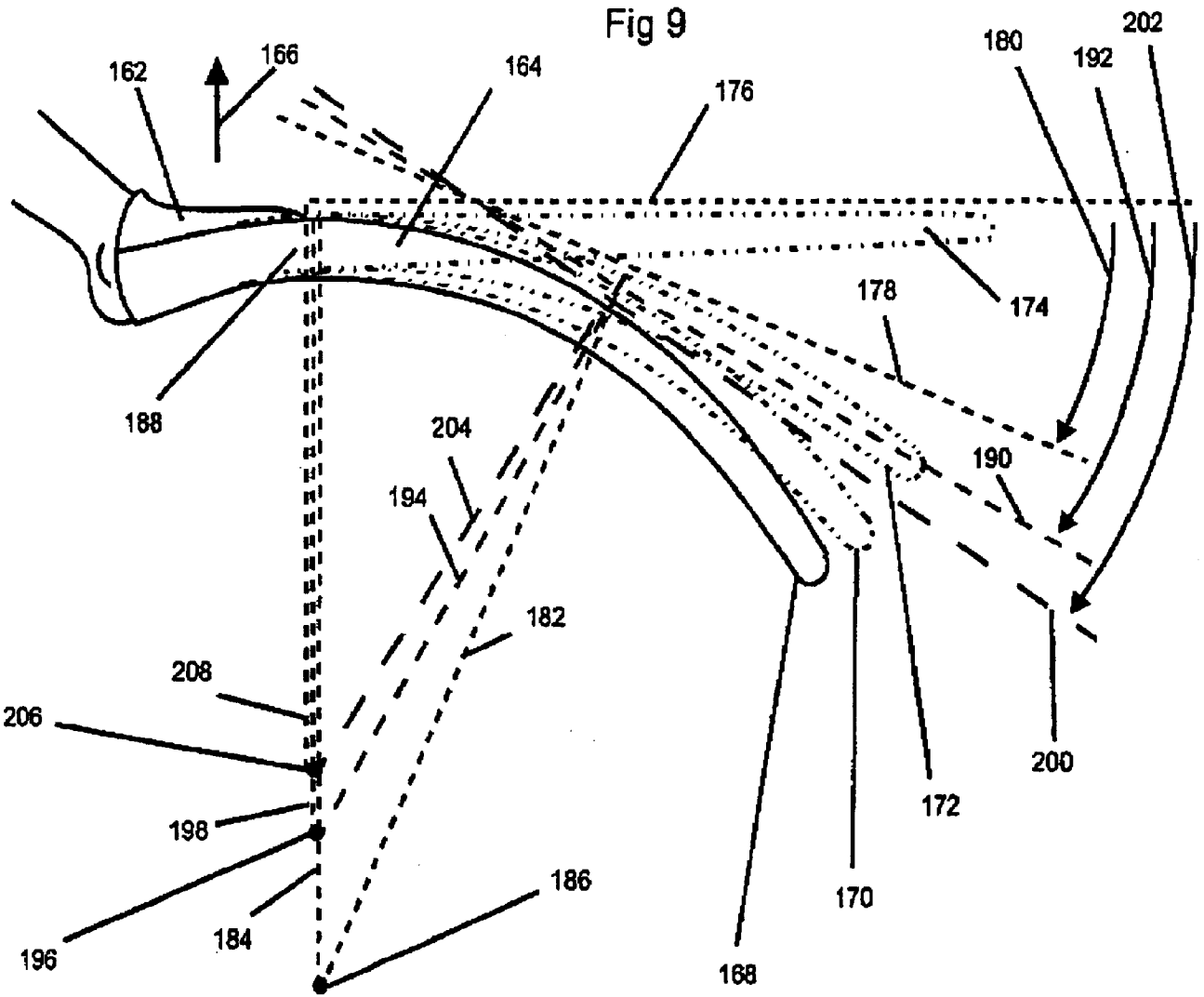
FIG. 9 shows an enlarged side view of the same swim fin shown in FIG. 8.
Figure 10A:
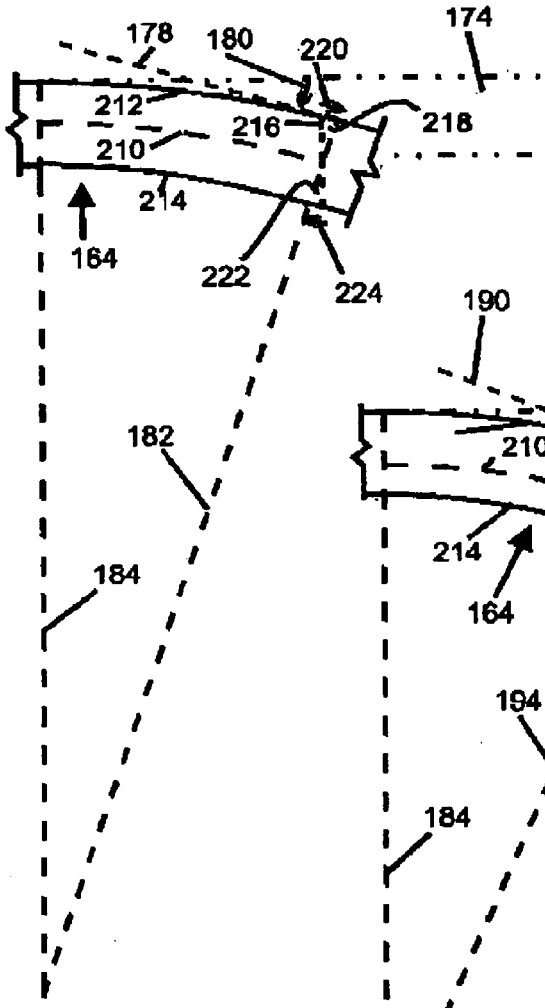

FIGS. 10*a,* 10*b,* and 10*c* show three close up detailed side views of the rib shown in FIGS. 8 and 9 in which the rib is experiencing 3 different deflections created by water pressure during use.

FIG. 11 shows seven sequential side views of the same fin shown in FIGS. 8–10 displaying the inversion portion of a kick cycle where the direction of kick changes. FIG. 11 displays the methods of the present invention that permit the blade to support a natural resonant frequency that has a significantly long wave length, large amplitude, and low frequency that significantly coincides with the frequency of the swimmer's kick cycle.

Figure 12:
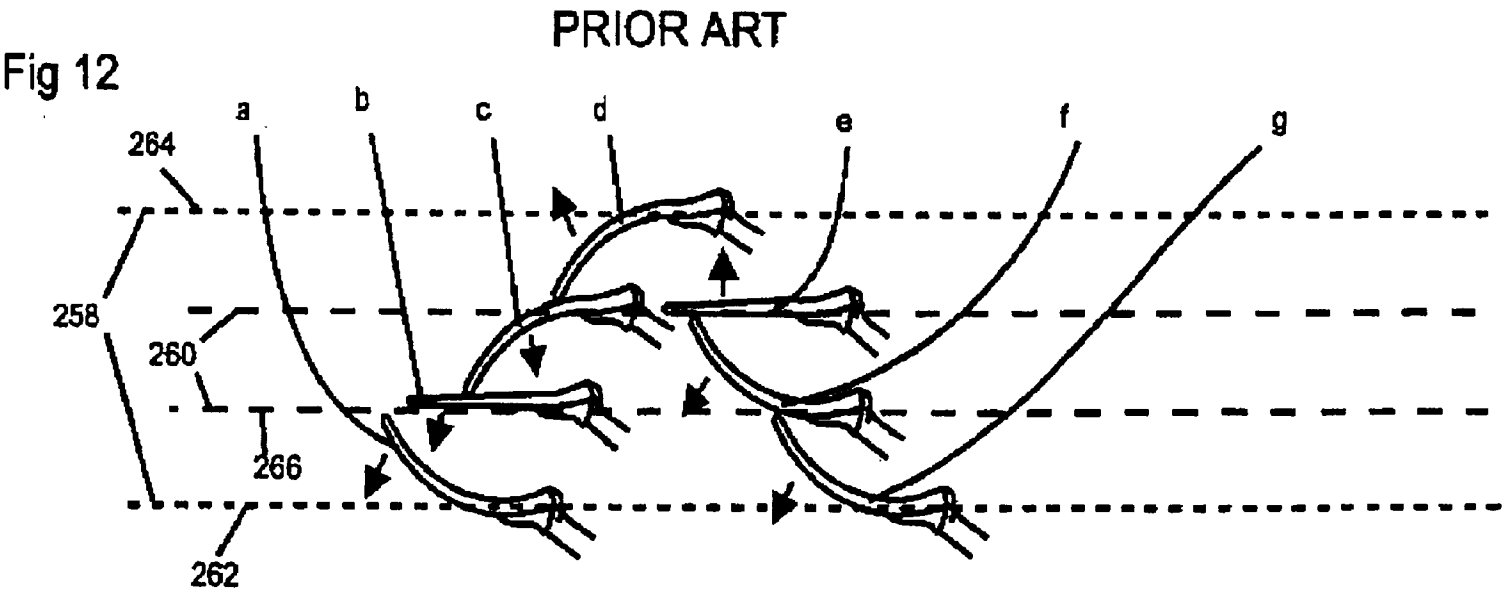

FIG. 12 shows a sequence of seven different side views a to g of the kick cycle of a prior art swim fin having a load bearing blade that is using highly flexible and soft material that permits high levels of blade deflection to occur during light kicking strokes but lacks the methods of the present invention and therefore exhibits high levels of lost motion, wasted energy, and poor propulsion.

Figure 13:
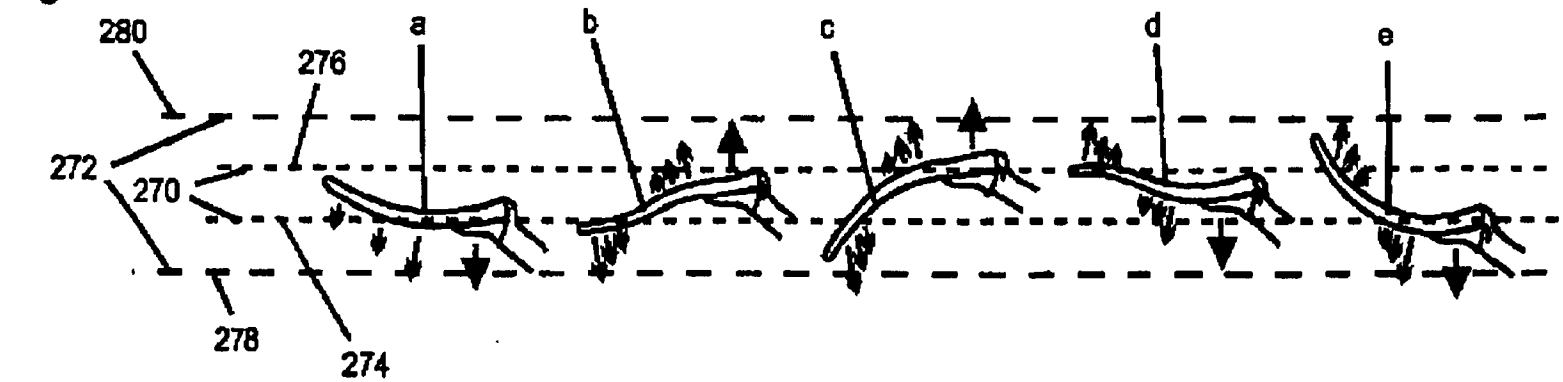

FIG. 13 shows five sequential side view a to e of a fin having a significantly flexible blade that employs the methods of the present invention.

Figure 14:
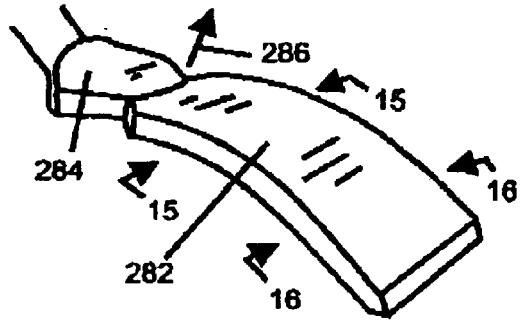

FIG. 14 shows a perspective view of a swim fin being kicked upward and the blade is seen to have a significantly large vertical thickness that is substantially consistent across the width of the blade.

Figure 15:
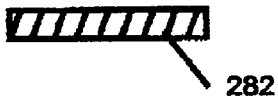

FIG. 15 shows a cross-sectional view taken along the line 15—15 in FIG. 14.

Figure 16:
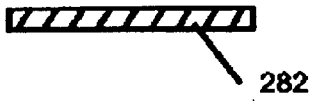

FIG. 16 shows a cross-sectional view taken along the line 16—16 in FIG. 14.

Figure 17:
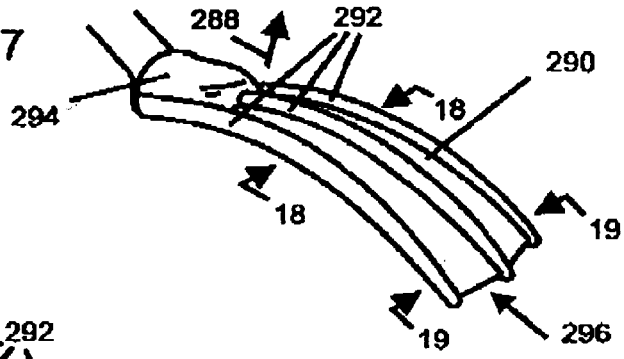

FIG. 17 shows a perspective view of a fin being kicked upward and the blade is seen to have three longitudinal load bearing ribs.

Figure 18:
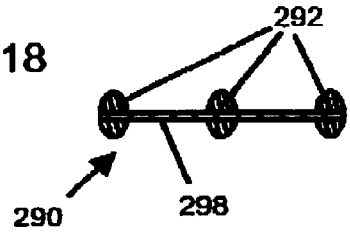

FIG. 18 shows a cross-sectional view taken along the line 18—18 in FIG. 17.

Figure 19:
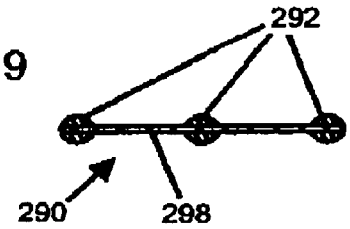

FIG. 19 shows a cross-sectional view taken along the line 19—19 in FIG. 17.

Figure 20:
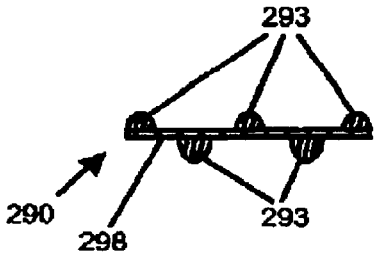

FIG. 20 shows an alternate embodiment of the cross sectional view shown in FIG. 18, in which half round load bearing ribs are used on the upper and lower surfaces of the blade.

Figure 21:
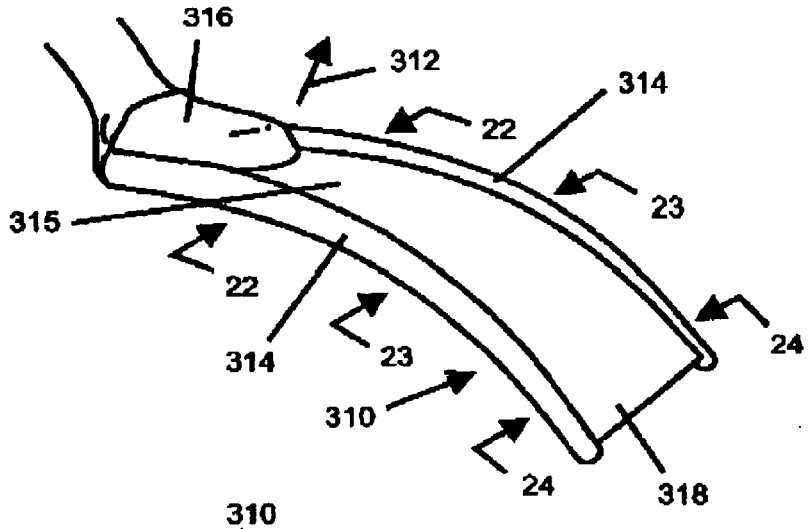

FIG. 21 shows a perspective view of a swim fin being kicked upward in which a significantly large longitudinal load bearing rib is located along each side edge of the blade.

Figure 22:
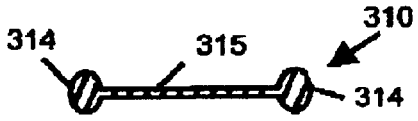

FIG. 22 shows a cross-sectional view taken along the line 22—22 in FIG. 21.

Figure 23:
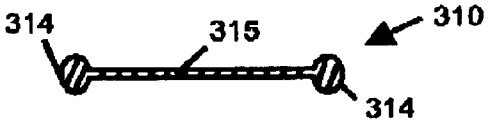

FIG. 23 shows a cross-sectional view taken along the line 23—23 in FIG. 21.

Figure 24:
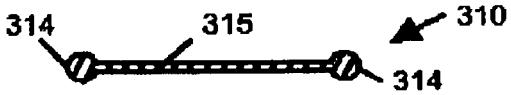

FIG. 24 shows a cross-sectional view taken along the line 24—24 in FIG. 21.

Figure 25:
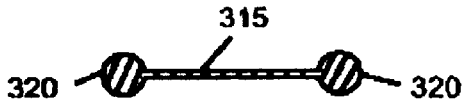

FIG. 25 shows an alternate embodiment of the cross-sectional view shown in FIG. 22, which uses round load bearing ribs.

Figure 26:
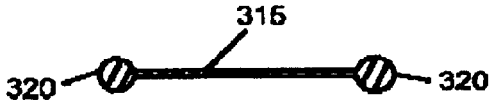

FIG. 26 shows an alternate embodiment of the cross-sectional view shown in FIG. 23, which uses round load bearing members.

Figure 27:
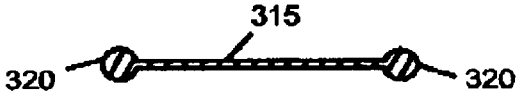

FIG. 27 shows an alternate embodiment of the cross-sectional view shown in FIG. 24, which has round load bearing members that are larger than those shown in FIG. 23.

Figure 28:
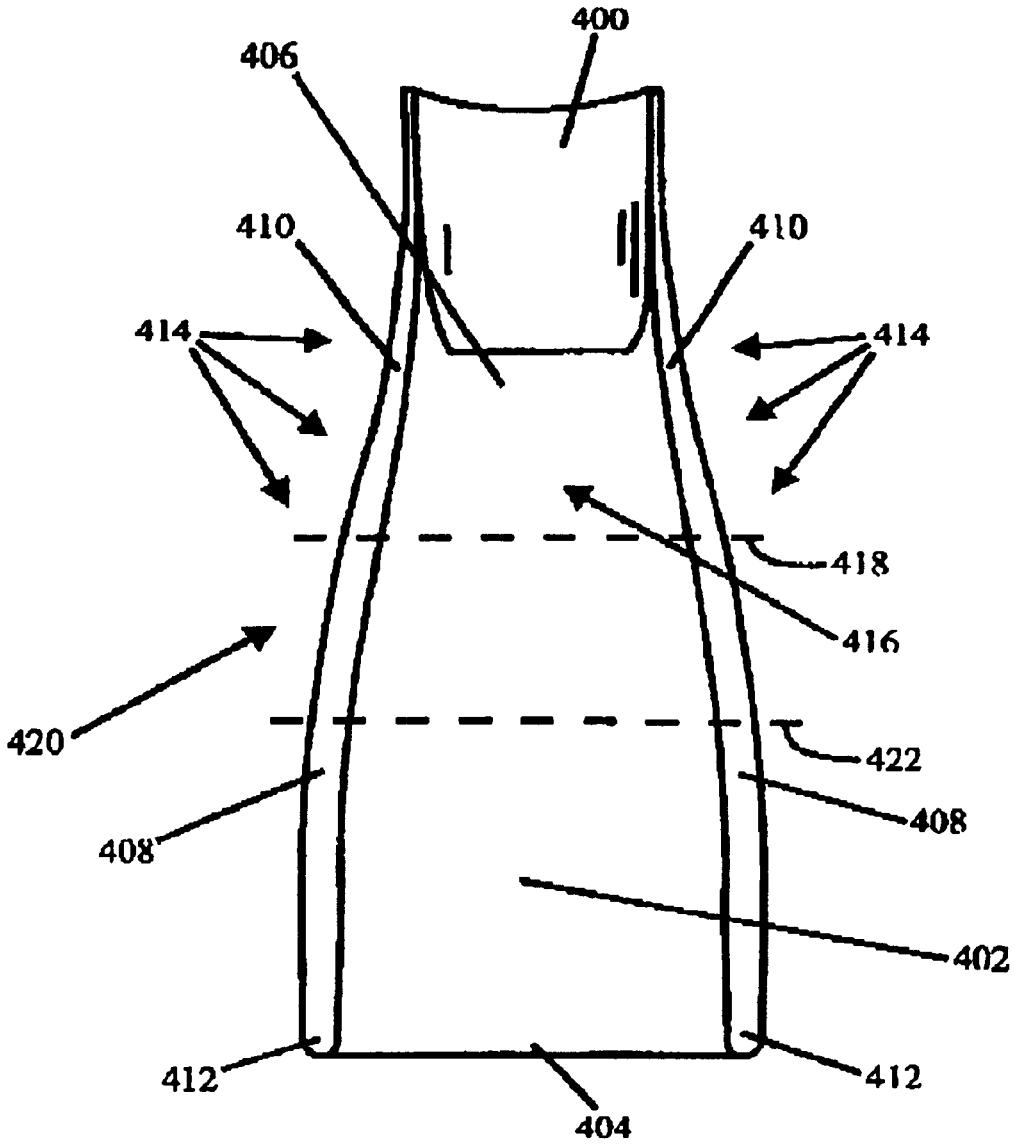

FIG. 28 shows a top view of a swim fin having side rails with reduced transverse dimension adjacent the root portion of the swim fin.

Figure 29:
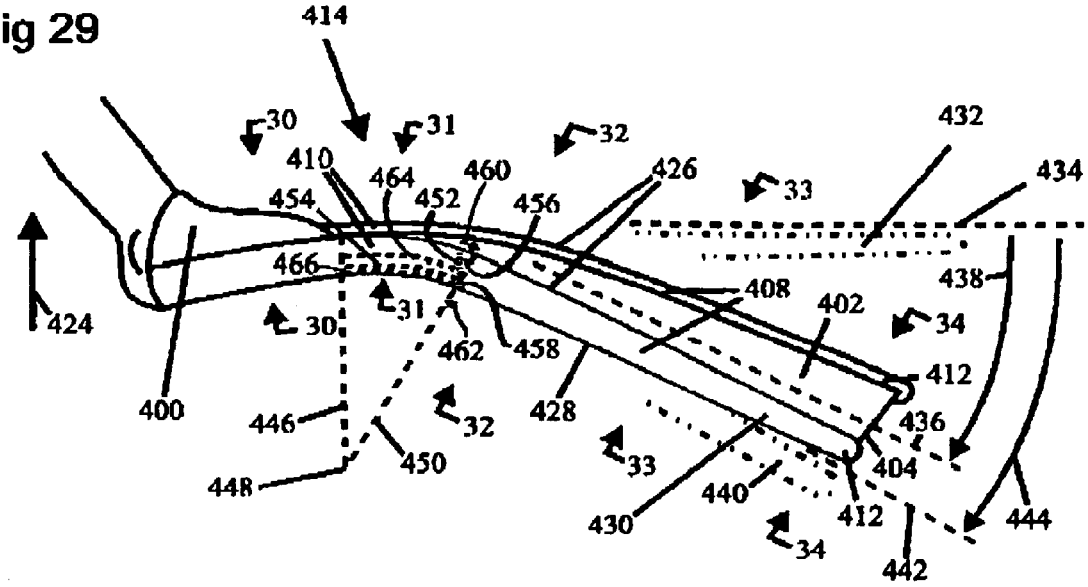

FIG. 29 shows a side view of the same swim fin shown in FIG. 28 while flexing during a kicking stroke.

FIGS. 30 to 34 show cross sectional views of the fin shown in FIG. 29 taken along the lines 30—30, 31—31, 32—32, 33—33, and 34—34, respectively.

Figure 35A:
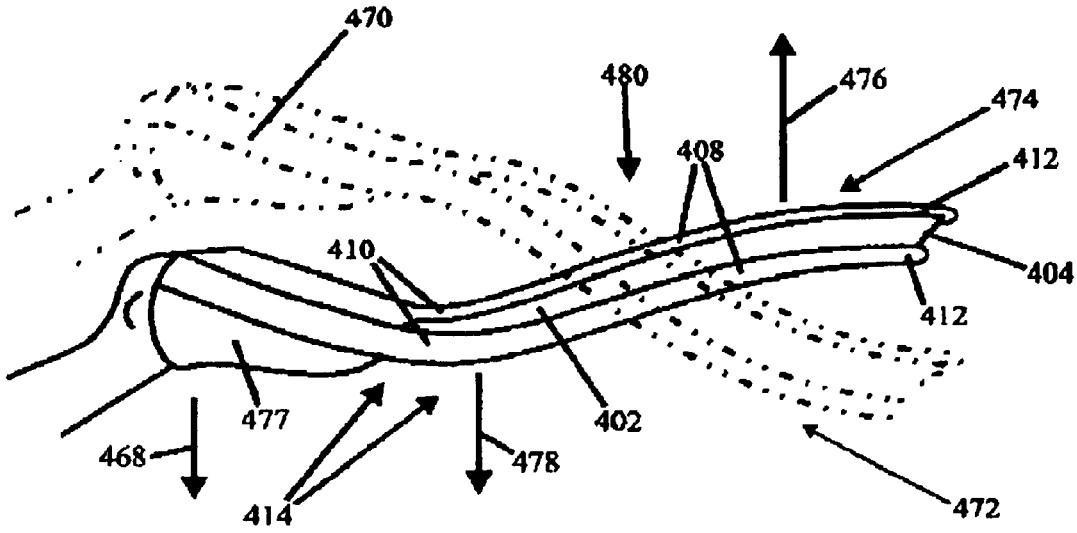
Figure 35B:
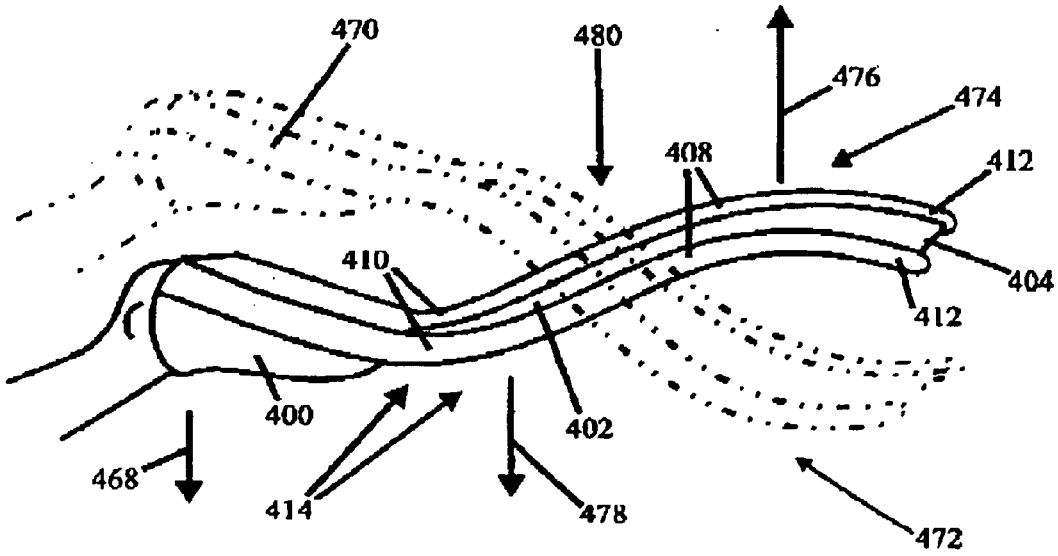

FIGS. 35*a* and 35*b* show a side perspective view of the swim fin shown in FIGS. 28 and 29 while it is forming an S-shaped sine wave during reciprocating kicking strokes.

Figure 36:
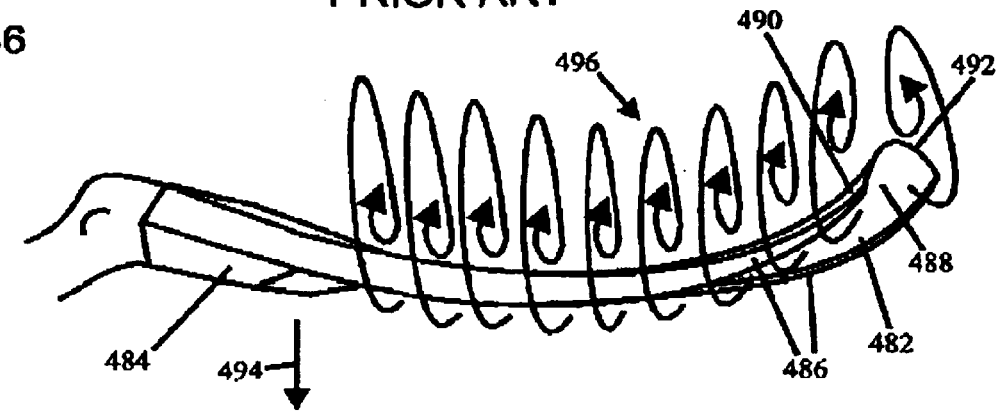
Fig 36 PRIOR ART

FIG. 36 shows a side view of a prior art swim fin.

Figure 37:
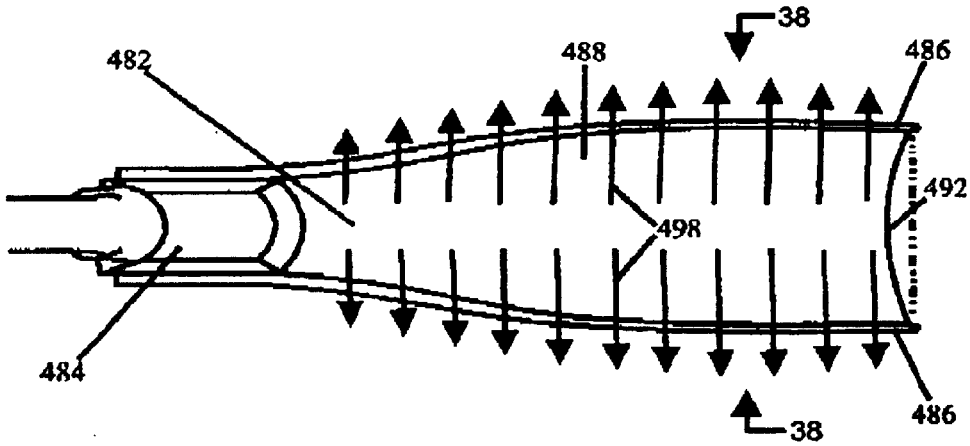
Fig 37 PRIOR ART

FIG. 37 shows a top view of the same prior art swim fin shown in FIG. 36.

Figure 38:
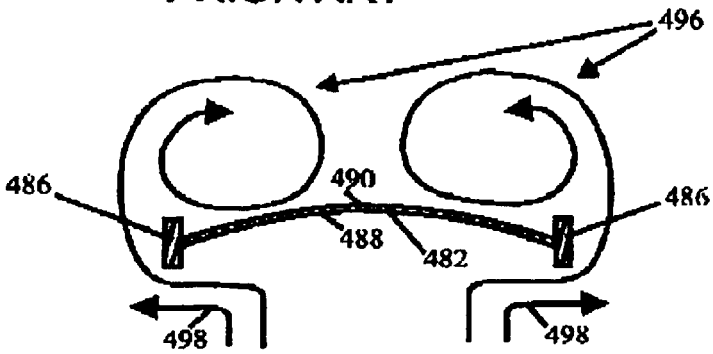
Fig 38 PRIOR ART

FIG. 38 shows cross sectional view of the same prior art fin shown in FIG. 37 taken along the line 38—38 in FIG. 37.

Figure 39:
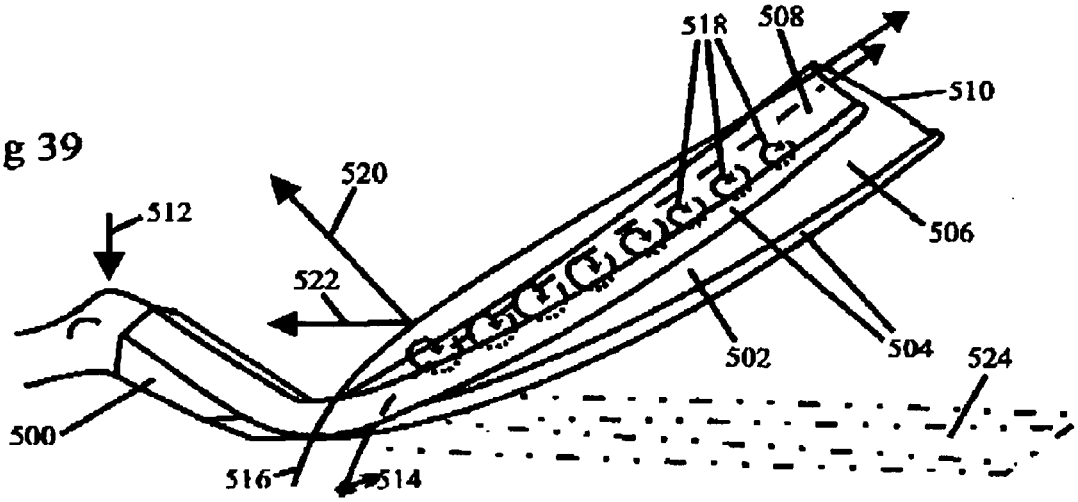

FIG. 39 shows a perspective side view of a swim fin.

Figure 40:
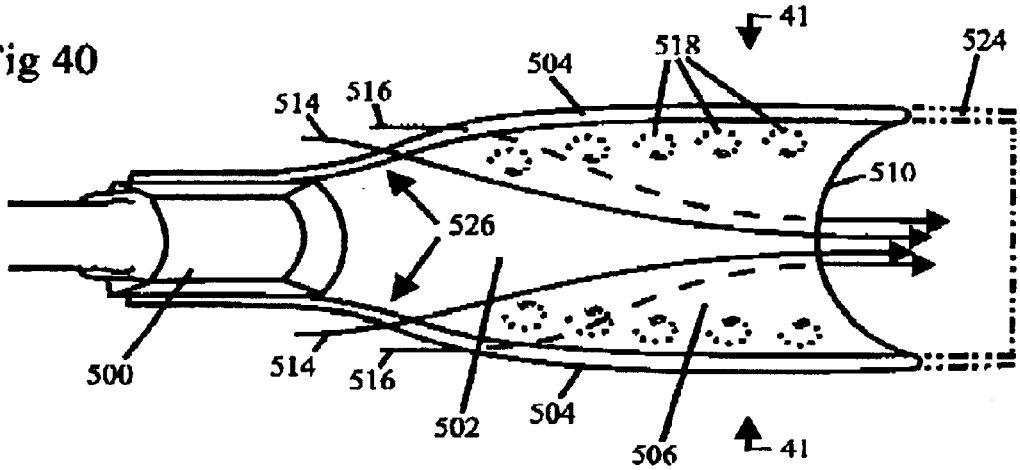

FIG. 40 shows a top view of the swim fin shown in FIG. 39.

Figure 41:
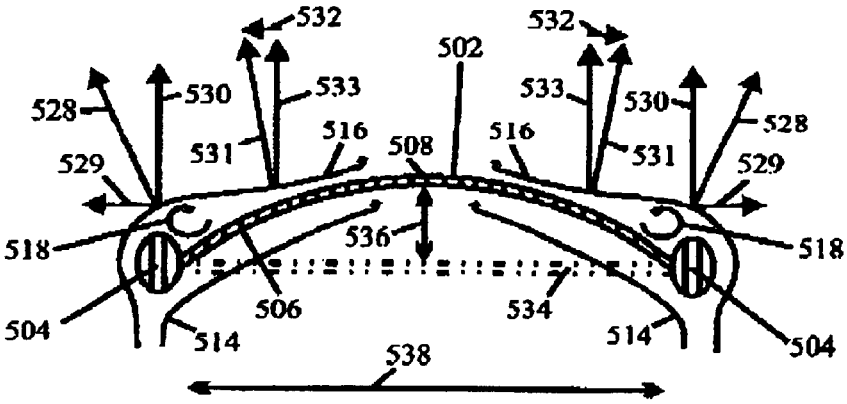

FIG. 41 shows cross sectional view taken along the line 41—41 in FIG. 40.

Figure 42:
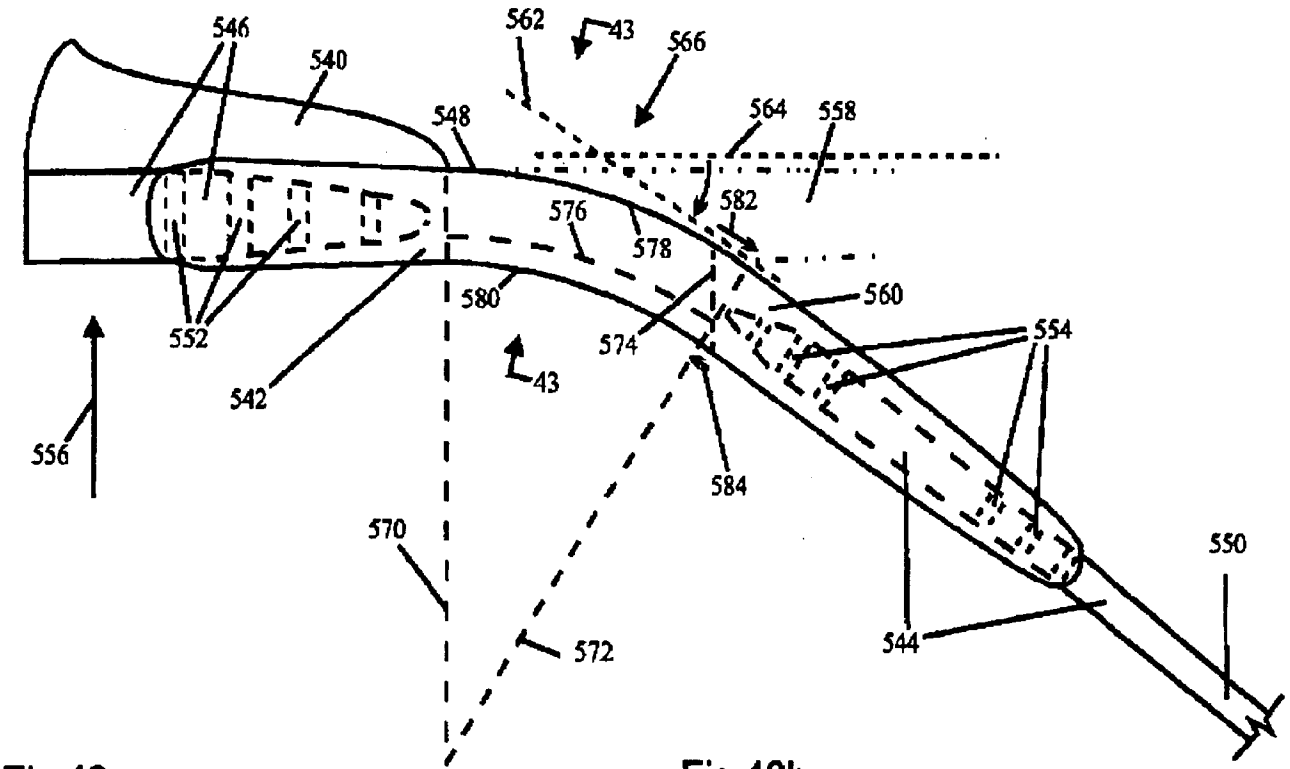

FIG. 42 shows a side view of an alternate embodiment swim fin.

Figure 43B:
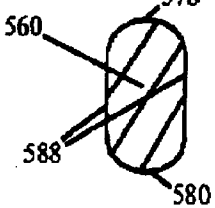
Figure 43A:
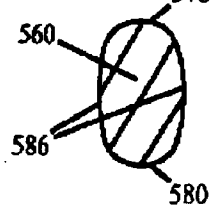

FIG. 43*a* shows a cross section taken along the line 43—43 in FIG. 42.

FIG. 43*b* shows an alternate embodiment of the cross section shown in FIG. 43*a*.

FIGS. 44 to 47 show various views of a prior art swim fin.

Figure 48:
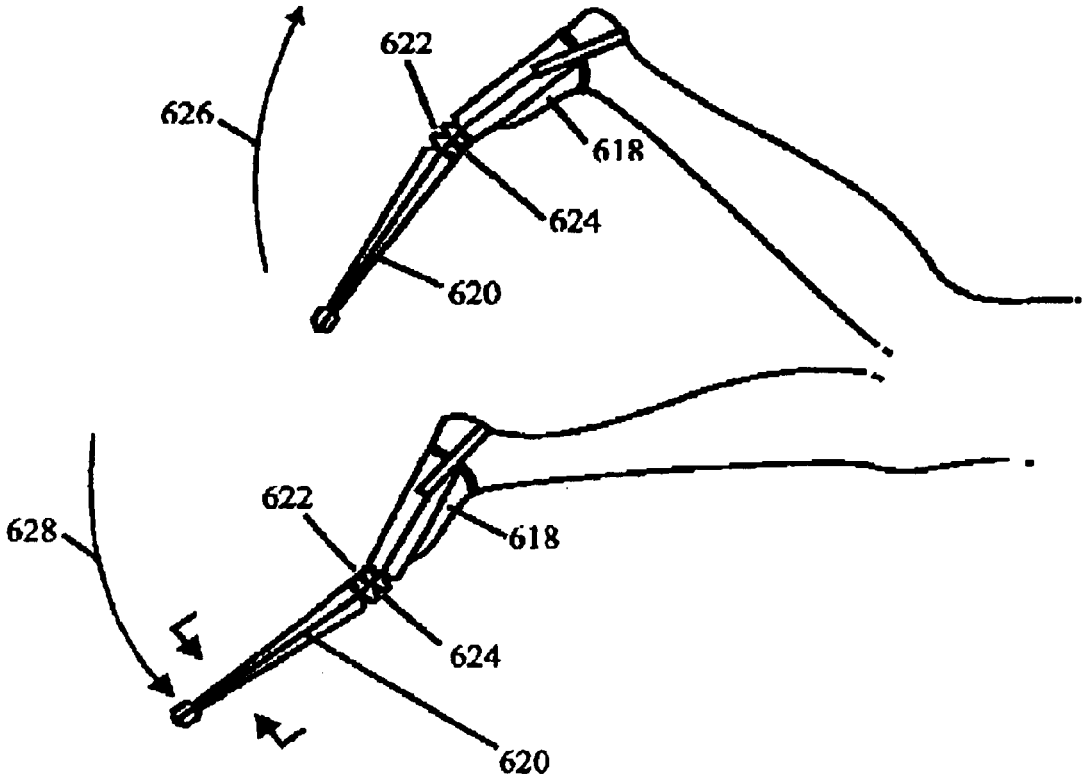
Fig 48 PRIOR ART
Figure 49:
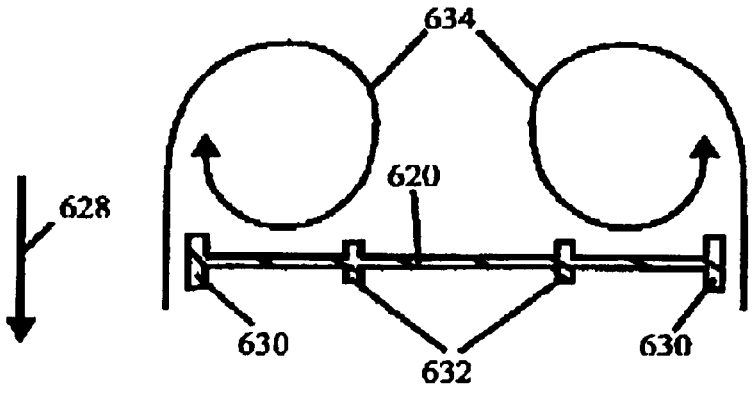
Fig 49 PRIOR ART

FIGS. 48 and 49 show various views of a prior art swim fin.

FIGS. 50 to 53 show various views of a prior art swim fin.

Figure 54:
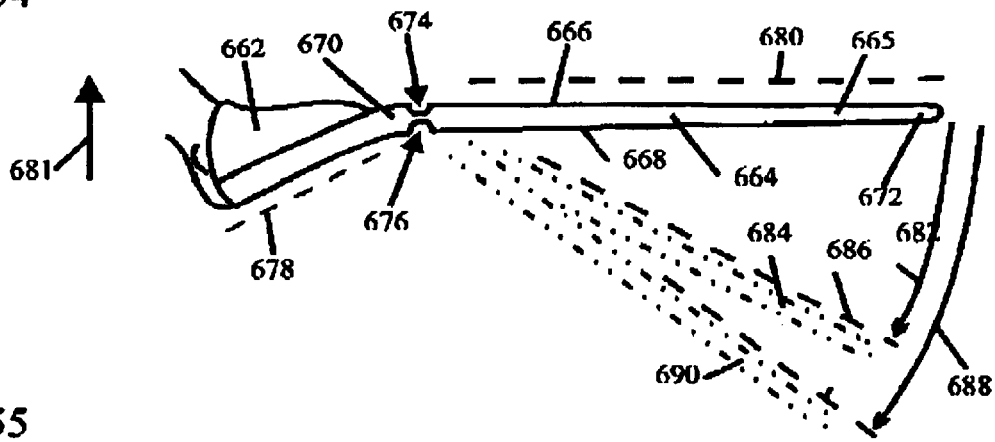

FIG. 54 shows a side view of a swim fin.

Figure 55:
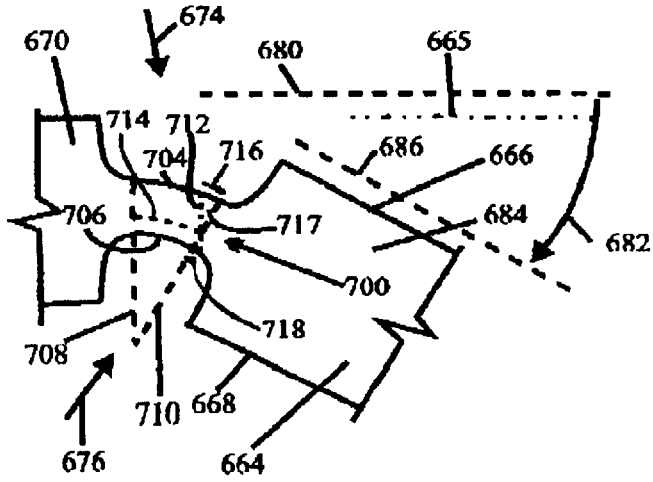
Figure 56:
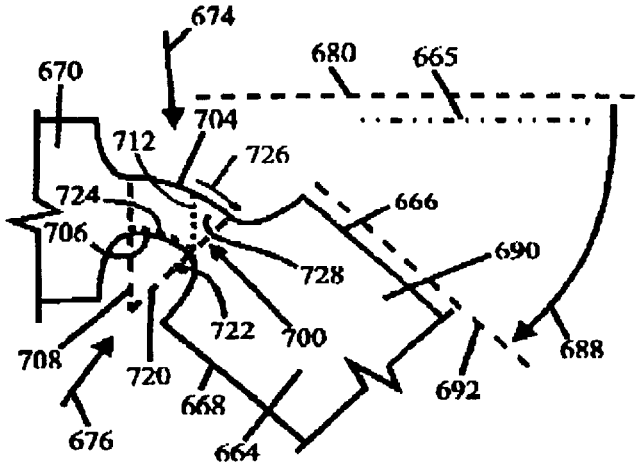

FIGS. 55 to 56 show close up side views of the swim fin shown in FIG. 54.

DESCRIPTION AND OPERATION—FIG. 1

For increased clarity and reduced repetition, the following specification will primarily refer to three different types of kicking stroke strengths that are used in attempting to reach three different types of swimnming speeds. A light kicking stroke, light kick, and light stroke, will mean a kicking stroke in which the swimmer uses relatively low levels of force to move the fin through the water in an effort to produce slow cruising speeds. A medium kicking stroke, medium kick, and medium stroke will mean a kicking stroke in which the swimmer uses relatively moderate levels of force to move the fin through the water in an effort to produce medium or moderately higher cruising speeds. A hard kicking stroke, hard kick, and hard stroke will mean a kicking stroke in which the swimmer uses relatively high levels of force to move the fin through the water in an effort to produce high swimming speeds. For a scuba diver swimming underwater with the added drag created by full scuba gear, slow cruising speed can be considered approximately 0.75 mph or 1.2 km/h, medium or moderate cruise speeds may be considered to be approximately 1 mph or 1.6 km/h, and high swimming speeds can be considered to be speeds faster than 1.25 mph or 2.0 km/h. Swimmers that are not using full scuba gear or that may be swimming along the surface may experience speeds that vary from this general guideline of speed categories. It should be understood that these definitions are used only to provide a general reference and I do not wish to be bound by them.

Also, in the following description a number of theories are presented concerning the design and operation methods utilized by the present invention. While I believe these theories to be true, I do not wish to be bound by them.

Figure 1A:
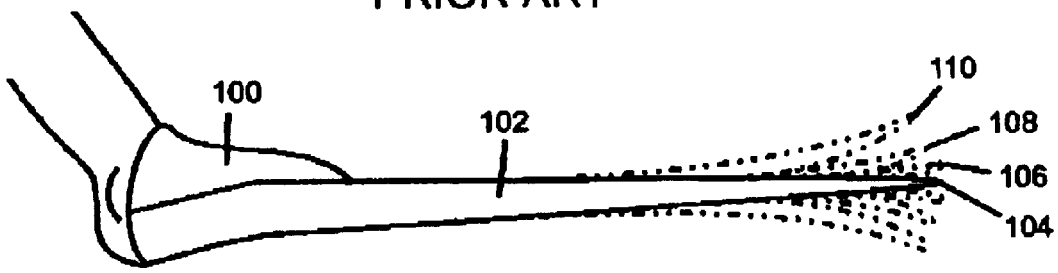
Fig 1a PRIOR ART
Figure 1B:
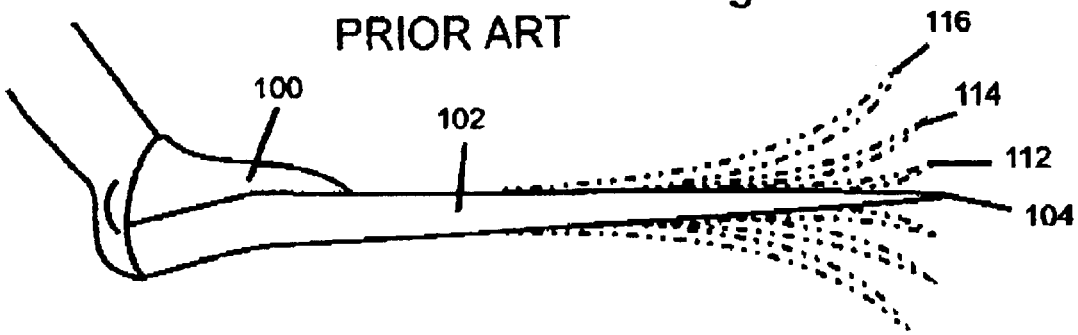
Fig 1b PRIOR ART
Figure 1C:
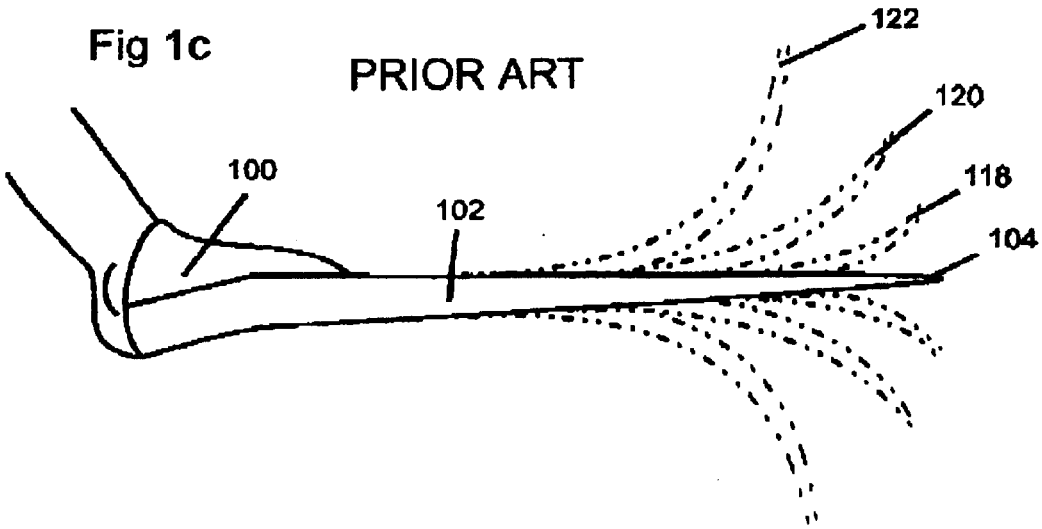
Fig 1c PRIOR ART

FIG. 1 shows three different side views of prior art fins having blades and, or load bearing ribs that taper in thickness along their length. FIG. 1*a* shows a prior art fin having a blade made from a relatively rigid material, FIG. 1*b* shows the same prior art fin having a more flexible material used within the blade, and FIG. 1*c* shows the same prior art fin having a highly flexible material used within the blade. FIG. 1*a* shows a fin having a foot pocket 100 connected to a blade 102 having a neutral position 104 while the fin is at rest. Broken lines show a light kick blade deflection 106 created as the swimmer uses a light kicking stroke, a medium kick blade deflection 108 created during a medium kicking stroke, and a hard kick blade deflection 110 created during a hard kicking stroke. Because blade 102 is made of a rigid material, deflections 106, 108, and 110 are all under deflected to produce a sufficiently reduced angle of attack to efficiently produce lift. It can be seen that deflections 106, 108, and 110 occur at significantly regular and evenly spaced intervals from neutral position 104. This shows that the relation between the degree of blade deflection to force or load on the blade is highly proportional and occurs in a significantly linear manner. This combines with the rigid blade material to prevent the blade from having consistent large scale blade deflections during use.

FIG. 1*b* shows the same prior art fin shown in FIG. 1*a* except that in FIG. 1*b* blade 102 uses a more resilient material than is used in FIG. 1*a*. In FIG. 1*b*, broken lines show blade deflections that occur as blade 102 bends away from neutral position 104 during use. A light kick blade deflection 112 is created during a light kicking stroke. A medium kick deflection 114 is created during a medium kicking stroke. A hard kick blade deflection 116 is created during a hard kicking stroke. Deflections 112, 114, and 116 are evenly spaces and demonstrate a significantly linear relationship of deflection to load. Deflections 112, 114, and 116 are under deflected to produce good performance at slow, medium, and high speeds, respectively.

FIG. 1*c* shows the same prior art fin shown in FIGS. 1*a* and 1*b*, except that in FIG. 1*c* blade 102 uses a highly resilient material. In FIG. 1*c,* broken lines show a light kick blade deflection 118 created during a light kick, a medium kick blade deflection 120 created during a medium kick, and a hard kick blade deflection created during a hard kick. Deflection 118 is under deflected while deflection 122 is over deflected.

FIGS. 1*a,* 1*b,* and 1*c* demonstrate that prior art fins tend to either under deflect on light kicks or over deflect on hard kicks. Large scale blade deflections are not significantly consistent between light and heavy strokes.

Description and Operation—FIG. 2

Figure 2A:
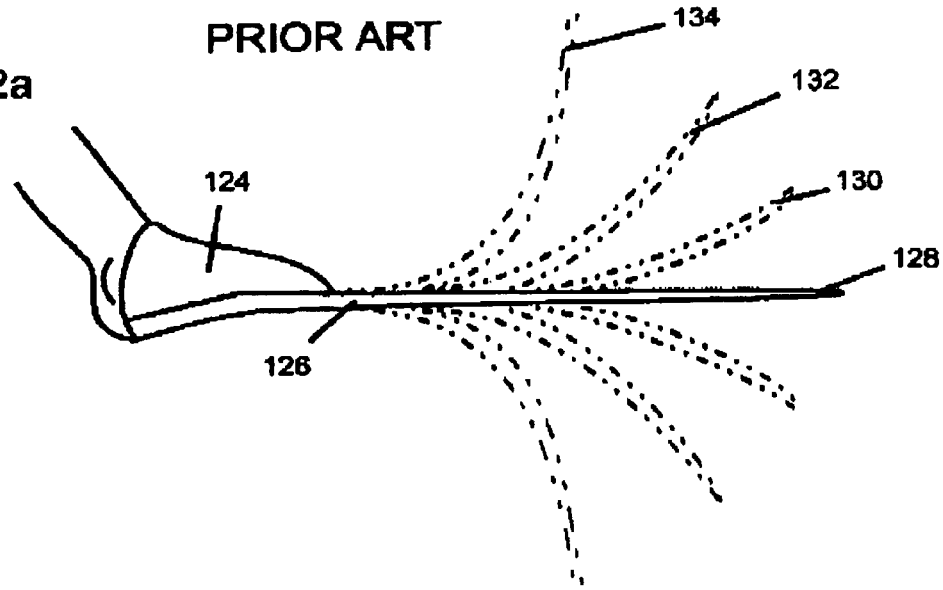
Fig 2a PRIOR ART
Figure 2B:
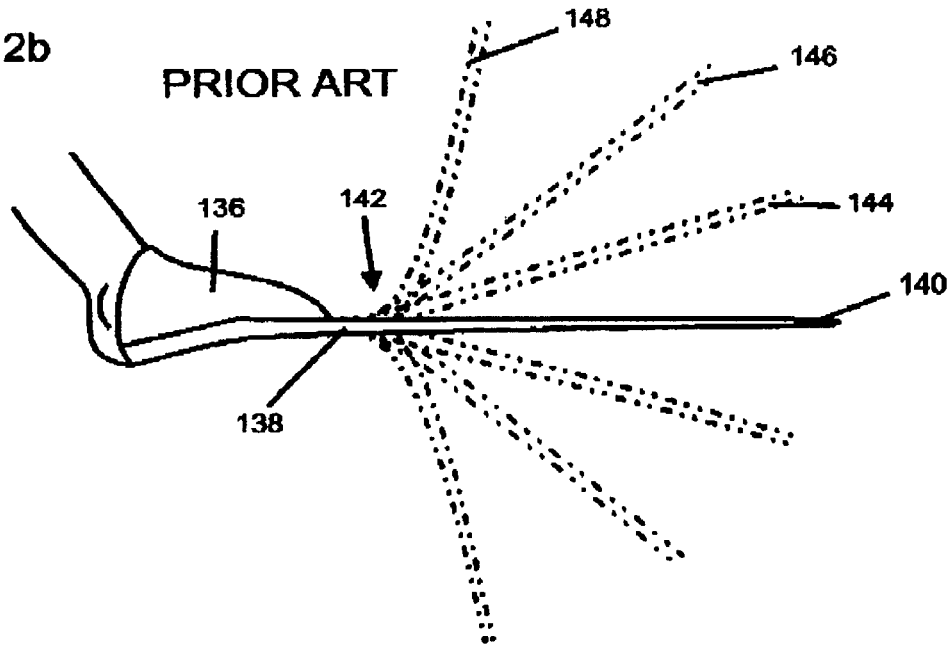
Fig 2b PRIOR ART

FIGS. 2*a* and 2*b* show side view of prior art fins that have blades that are able to bend closer to the foot pocket. FIG. 2*a* shows a foot pocket 124 connected to a blade 126 that has a neutral position 128 while at rest. A light kick blade deflection 130, a medium kick blade deflection 132, and a hard kick blade deflection 134 are shown by broken lines are created by a light kick, a medium kick, and a hard kick, respectively. If blade 126 is made resilient enough to permit blade 126 to bend to deflection 130 on a light kick, blade 126 will over deflect to deflection 132 and 134 during a medium kick and hard kick, respectively. In this example, blade 126 is seen to be relatively thin to permit bending to occur over a greater portion of the blade, however, no adequate method is used to consistent large scale blade deflections between light and hard kicks. If blade 126 is made rigid enough to not over deflect on a hard kick, blade 126 will not deflect enough during a light kick.

FIG. 2*b* shows a side view of a prior art fin having a foot pocket 136, and a blade 138 having a neutral position 140. In this prior art example, blade 138 has a flexing zone 142 that is significantly close to foot pocket 136. Such bending at zone 142 has previously been achieved by using a stiffener within the outer portion of blade 138 that originates from the free end of blade 138 and terminates at or near zone 142. Bending zone 142 has also been achieved by reducing the thickness of blade 138 near or at bending zone 142. All such prior methods for achieving bending zone 142 do not include a method for achieving consistent large blade deflections on both light and hard kicks. Broken lines show a light kick blade deflection 144, a medium kick blade deflection 146, and a heavy kick blade deflection 148. If blade 138 is made flexible enough to bend from neutral position 140 to deflection 144 during a light kick, blade 138 will over deflect to deflections 146 and 148 during a medium kick and hard kick, respectively.

Description and Operation—FIGS. 3 to 7

FIG. 3 shows a front perspective view of a prior art swim fin having a direction of kick 150 that is directed upward from this view. A foot pocket 152 is connected to a blade 154 that has a pair of longitudinal ribs 156 on both side edges of blade 154. As water pressure pushes down on the blade, a buckling zone 158 is seen to occur where the lower edge of ribs 156 bulges out under the force of compression. This occurs because stress forces of compression are exerted on the lower portions of ribs 156 from the load created on blade 154 during the kick in direction 150. Because the material in ribs 156 must go somewhere it bulges outward. This causes ribs 156 to buckle and twist over at an angle. Because this reduces the height of ribs 156 relative to the bending moment created during the kick, ribs 156 experience a significant reduction in bending resistance forward of buckling zone 158 and blade 154 collapses under the water pressure.

Many prior art swim fins employ tall and thin vertical ribs that require the use of significantly rigid materials to prevent twisting and collapsing during use. Such rigid materials prevent blade 154 from bending sufficiently during use to create good performance. FIG. 3 shows that ribs 156 will collapse if softer materials are used in an attempt to increase blade deflection.

FIG. 4 shows a side perspective view of the same prior art fin shown in FIG. 3 with cross sections taken at the lines 5—5, 6—6, and 7—7. Broken lines show a neutral position 160 and an arrow showing the direction of collapse occurring to blade 154 under pressure.

FIG. 5, FIG. 6, and FIG. 7 show cross sectional views taken along the lines 5—5, 6—6, and 7—7 in FIG. 4, respectively. In FIG. 5, ribs 156 are seen to be stabilized by foot pocket 152. In FIG. 6, ribs 156 are seen to buckle and twist. FIG. 7 shows ribs 156 as twisting further still. Because of this tendency to buckle, prior fin designs often use highly rigid materials such as EVA (ethylene vinyl acetate) which has a low degree of extensibility that is less than 5% and negligible contraction or compression range under the relatively low loads created during light kicking strokes.

Description and Operation—FIGS. 8 to 10

FIG. 8 shows a side view of a swim fin using the methods of the present invention. FIG. 8 shows a foot pocket 162 connected to a blade 164 that is being kicked in a direction of kick 166 that is directed upward. Blade 164 is seen to be deflected to a hard kick blade deflection 168 created by a hard kicking stroke. Broken lines show a medium kick blade deflection 170, a light kick blade deflection 172, and a neutral blade position 174 which are created during a medium kick, a light kick, and while blade 164 is at rest, respectively. Broken lines above neutral position 174 are positions that occur if direction of kick 166 is reversed.

Deflection 172 is seen to be a significant distance from neutral position 174 showing that high levels of blade deflection occur during a light kicking stroke. The distance between deflections 170 and 172 is relatively small when compared with the distance between deflection 172 and neutral position 174. The distance between deflections 168 and 170 is relatively small in comparison to the distance between deflections 170 and 172 as well as between deflection 172 and neutral position 174. This shows that blade 164 is experiencing large scale deflections that have a highly non-linear ratio of load (stress) to deflection (strain). Deflections 172, 170, and 168 are in a significantly tight group that is at a proportionally large distance from neutral position 174. Deflection 172 is at a sufficiently reduced angle of attack to produce efficient propulsion during light kicking strokes. Deflections 170 and 168 are also at sufficiently reduced angles of attack to produce efficient propulsion and are not over deflected to an excessively reduced angle of attack during medium and heavy kicks, respectively.

The process that governs the non-linear behavior of blade 164 has never been disclosed or known to those skilled in the art of fin design. This process is also unobvious to those skilled in the art of fin design since many of the world's top fin designers, who have been bound by confidentiality agreements and have seen my prototypes using methods of the present invention, have not even recognized that such a process existed within the prototypes. Such fin designers actually thought the blade deflected excessively and needed to be stiffer to avoid lost motion and to apply more leverage to the water. Not only was the existence of consistent large scale blade deflection unnoticed, the designers believed in previously established principles of blade design that hold that flexible blades lack speed, thrust, and power and are therefore undesirable in comparison to rigid blades that experience much smaller levels of blade deflection. Even when they looked at the geometry of the blade and ribs of my prototypes and could simultaneously feel the soft and flexible material used, they did not notice the hidden secrets and unexpected new results that can be obtained with the proper combination of material and geometry. Instead, they were puzzled by high performance characteristics created by the prototypes that were created by an unrecognized process. This is highly significant since those skilled in the art of fin making were not able to recognize and identify the methods being employed by the present invention even after examining, analyzing, testing, and swimming with a physical prototype. They could see that the prototypes created new levels of performance and ease of use, but they could not recognize the methods and processes occurring within the load bearing ribs that were responsible for many new and unexpected results. In addition, they theorized that improved performance would occur with the use of more rigid materials having less extensibility and smaller dimensions. This shows that the processes and methods disclosed in the present invention are unobvious to a skilled observer. This is because the processes and methods of the present invention contradict established teachings in the art of swim fin design. Many numerous unexpected results and new methods of use are generated and become possible by the proper recognition and exploitation of the methods disclosed in the present invention. A complete understanding of the methods, benefits, results, and new uses disclosed in below in the present invention are essential to permit such methods to be fully exploited and utilized. Without the methods and processes disclosed below, fin designers skilled in the art remain convinced that load bearing support members and ribs should be made with highly rigid materials and that flexibility should be achieved by reducing the thickness of such rigid materials. With the knowledge of the unobvious methods employed by the present invention, fins can be designed to create new precedents in high performance that will antiquate the prior art.

Description and Operation—FIGS. 9 to 10

It should be understood that the analysis disclosed below is used primarily to create an understanding of the principles and methods at work and are not intended to be the sole form of analysis used while employing the methods of the present invention. The analysis and methods disclosed below are intended to provide sufficient understanding to permit a person skilled in the art of fin design to used and understand the methods of the present invention in any desired manner. The selection of reference lines described below are intended to guide the user toward a clear understanding of the principles at work and are intended to provide one of many possible ways for analyzing, observing, and visualizing the processes at work and I do not wish to be bound by the analysis provided below. It is intended that the following disclosure permit a person skilled in the art to use empirical design methods that do not require high levels of structural analysis while also providing enough structural analysis groundwork to permit a person skilled in the art of fin design to employ more sophisticated structural analysis principles for high level fine tuning of performance if desired.

FIG. 9 shows an enlarged close up side view of the same fin shown in FIG. 8 and also having the same deflections 168, 170, and 172 created as blade 164 is kicked in direction of kick 166. Blade 164 at deflections 168, 170, and 172 are seen to have an arc-like bend. A neutral tangent line 176 is displayed by a horizontal dotted line that is above and parallel to the broken line displaying the upper surface of blade 164 while at neutral position 174. Line 176 is a reference line that shows the angle of attack of the upper surface of blade 164 when it is at rest at neutral position 174. A light kick tangent line 178 is displayed by a dotted line that is tangent to the middle portion of the upper surface of blade 164 while blade 164 is at deflection 172. A light kick reduced angle of attack 180 is displayed by a curved arrow extending between tangent lines 176 and 178. Angle 180 shows the reduction in angle of attack occurring at the middle portion of blade 164 taken at tangent line 178 as blade 164 deflects from neutral position 174 to deflection 172. A light kick radius of curvature 182 is displayed by a dotted line that is perpendicular to tangent line 178. Radius 182 extends beneath blade 164 and intersects a light kick root radius line 184 at a light kick transverse axis of curvature 186. Radius line 184 extends between axis 186 and a root portion 188 of blade 164. Radius 184 represents the radius of curvature at root 188.

A medium kick tangent line 190 is displayed by a dotted line that is tangent to the upper surface of the middle portion of blade 164 at deflection 170. A medium kick reduced angle of attack 192 is displayed by an arrow extending between tangent lines 176 and 192. Angle 192 shows the reduction in angle of attack existing at the middle of blade 164 during a medium kick. A medium kick radius line 194 is displayed by a dotted line that is normal to tangent line 190 and extends below blade 164 and terminates at a medium kick transverse axis of curvature 196. Radius line 194 intersects a medium kick root radius line 198 at axis 196. Radius line 198 displays the radius of curvature of blade 164 at root 188 and extends from root 166 to axis 196.

A hard kick tangent line 200 is displayed by a dotted line that is tangent to the upper surface of the middle portion of blade 164 at deflection 168. A hard kick reduced angle of attack 202 is displayed by an arrow extending between tangent lines 176 and 200. Angle 202 shows the reduction in angle of attack existing at the middle of blade 164 at deflection 168 during a hard kick. A hard kick radius line 204 is displayed by a dotted line that is normal to tangent line 200 and extends below blade 164 and terminates at a hard kick transverse axis of curvature 206. Radius line 204 intersects a hard kick root radius line 208 at axis 206. Radius line 208 displays the radius of curvature of blade 164 at root 188 during deflection 168 and extends from root 166 to axis 196.

It can be seen that the reduced angles of attack at the middle portion of blade 164 displayed by angles 180, 192, and 202 as well as tangent lines 178, 190, and 200, respectively, are significantly similar to each other. As the angle of attack decreases, the radius of curvature of blade 164 changes. Blade 164 is seen to have a relatively tall vertical dimension in comparison to the relatively short radii 182, 194, 204, 184, 198, and 208. The relatively tall vertical dimensions of blade 164 combines with relatively short radii of curvature and forces the upper surface of blade 164 to elongate under tension stress and forces the lower surface of blade 164 to contract under compression forces. Because of the significant vertical height in comparison to the radii of curvature, significantly high levels of elongation and, or compression must occur before blade 164 will bend. As the radius of curvature becomes smaller, the degree of elongation and compression increase dramatically and therefore the elongation and compression requirements change as well. If the loads required to enable a given material to experience the needed levels of elongation and, or compression to bend blade 164 to deflection 172 are higher than the loads created on blade 164 during specific strength of kicking stroke, then blade 164 will not deflect sufficiently during such kicking stroke. Because of the relatively large vertical dimensions of blade 164 relative to the radii of curvature, significantly soft and highly extensible materials must be used to permit blade 164 to elongate and compress sufficiently enough deflect to 172 under the relatively light loads produced during a light kicking stroke. Because such soft and highly extensible materials are very weak, the methods of the present invention provide blade 164 with sufficient cross-sectional height to regain strength through the increased thickness of blade 164. By establishing large scale deflections over a radius of curvature that is relatively small to the vertical thickness of blade 164, the material within blade 164 is forced to elongate and compress over significantly high ranges. By selecting a suitably extensible and compressible material to be used within blade 164 that has elongation and compression ranges that match the requirements set forth by the geometry and the loads created during light, medium, and hard kicking strokes, consistent large-scale deflections can be achieved throughout light, medium, and heavy kicks. When this is done properly, the fin provides new and unexpected results that dramatically improve propulsion.

FIGS. 10*a,* 10*b,* and 10*c* show a detailed close-up side view of the same blade 164 shown in FIGS. 8 and 9. In FIG. 10*a,* blade 164 is seen to have flexed from neutral position 174 to deflection 172. Tangent line 178 is seen to be perpendicular to radius line 182. Between line 178 and the upper surface of blade 164 at neutral position 174 is an arrow that displays angle 180. Blade 164 is seen to have a neutral bending axis 210 displayed by a dotted line passing through the center region of blade 164 between an upper surface 212 and a lower surface 214 of blade 164. Neutral surface 210 displays the portion of blade 164 that does not experience elongation or compression. This is also called the neutral surface since a horizontal plane exists along neutral surface 210 in which no elongation or compression occurs. A radius comparison reference line 216 is displayed by a dotted line and is seen to extend between upper surface 212 and lower surface 214 and intersects both radius 182 and neutral bending axis 210. Reference line 216 is parallel with radius 184 to display the degree of elongation and compression occurring within blade 164 at deflection 172. It can be seen that reference line 216 intersects upper surface 212 in a manner that causes the portion of upper surface 212 existing between reference line 216 and radius line 184 to have the same length as neutral surface 210. Similarly, it can be seen that reference line 216 intersects lower surface 214 in a manner that causes the portion of lower surface 214 existing between reference line 216 and radius line 184 to have the same length as neutral surface 210. As a result, reference line 216 permits the degree of elongation and compression occurring within blade 164 between radius 184 and 182 to be identified.

An elongation zone 218 exists in a substantially triangle shaped region between neutral surface 210, radius 182, reference line 216, and upper surface 212. Elongation zone 218 displays the degree of elongation occurring within the material of blade 164 as well as the volume of material that is forced to elongate over the section of blade 164 existing between radius 184 and radius 182. The triangle shaped region displayed by elongation zone 218 is seen to increase in size from neutral surface 210 toward upper surface 212. This shows that elongation increases with the vertical distance from the neutral surface and reaches a light kick maximum elongation range 220 displayed by an arrow located above upper surface 212 at elongation zone 218. Elongation range 220 shows the maximum elongation occurring in blade 164 between radius 182 and 184 as blade 164 is bent to deflection 172. It is preferred that the material used within blade 164 is sufficiently extensible to elongate over range 220 under the relatively light tensile stress applied by the bending moment created on blade 164 during a light kicking stroke.

A compression zone 222 is displayed by a triangle shaped region located between neutral surface 210, lower surface 214, reference line 216, and radius line 182. Compression zone 222 is seen to increase in size from neutral surface 210 to lower surface 214 to show that the degree of compression increases with the vertical distance from the neutral surface and reaches a maximum along lower surface 214. A light kick maximum compression range 224 is displayed by an arrow below compression zone 222 and lower surface 214. In this example, maximum compression range 224 displays the maximum compression occurring within blade 164 between radius 184 and radius 182 as blade 164 is bend from neutral position 174 to deflection 172 during a light kicking stroke. It is preferred that the material used within blade 164 is sufficiently compressible enough to contract or over range 220 under the relatively light compression load applied by the bending moment created on blade 164 during a light kicking stroke.

It should be understood that elongation and contraction within the material of blade 164 is not isolated within elongation zone 218 and compression zone 222 and zones 218 and 222 are used to display the degree of elongation and contraction that is distributed across the entire length of blade 164 between radius 182 and radius 184.

In this example in FIG. 10*a,* neutral surface 210 is located substantially in the center of blade 164. This shows that the material used in this example has similar stress (load) to strain (deflection of material) ratios in both elongation and compression. This is shown in this example to illustrate the fundamental principles and methods employed by the present invention. Because most materials are significantly easier to elongate than to compress, most materials will dissimilar stress to strain ratios in respect to elongation and compression. This will cause neutral surface to be located significantly farther away from the tension surface and closer to the compression surface rather than being located near the center of blade 164. In prior art fins, significantly rigid materials are used which do not contract significantly under the loads created during kicking strokes and the neutral bending axis exists too close to the compression side of the blade. When viewing FIG. 10*a,* such a non-contracting material would cause neutral surface 210 to occur right along lower surface 214 or an insignificant distance above it. This would cause the lower portion of reference line 216 that intersects with lower surface 214 to shift to the left so that it again intersects with both neutral surface 210 (which would now exist along lower surface 214) and radius line 182. Because reference line 216 would remain parallel to radius line 184 as reference line 216 shifts to the left, elongation zone 218 would dramatically increase in size. This would increase the length of maximum elongation range 220 as well as the volume of material forced to elongate. This is undesirable because the tensile forces applied by the bending moment created during a light kick will not be sufficient to elongate the rigid material over the newly increased range. Instead, a material may be used which is highly resilient and is able to elongate over such an increase range under the substantially low tensile applied to blade 164 by the bending moment created during a light kicking stroke. Preferably, the material used in blade 164 has a sufficiently large enough contraction range under the low loads created during a light kick to permit the neutral surface to exist a significant large distance above lower surface 214 since this will significantly reduce the loads required to bend blade 164 to deflection 172 and therefore permit deflection 172 to be efficiently reached during a light kick.

Figure 10B:
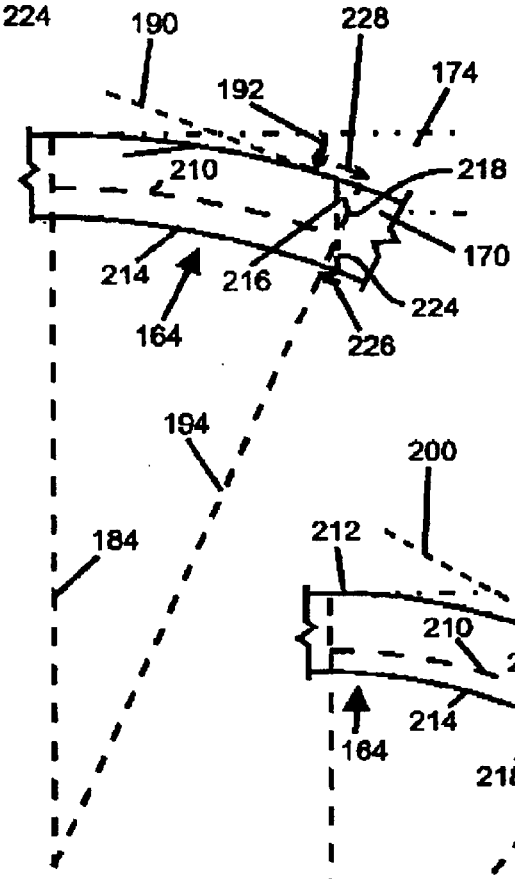

FIG. 10*b* shows blade 164 bend from neutral position 174 to deflection 170. Angle 192 exists between the upper surface of blade 164 at neutral position 174 and tangent line 190. Radius lines 194 and radius lines 198 are shorter that radius lines 182 and 184 shown in FIG. 10*a*. In FIG. 10*b*, neutral surface 210 is seen to have shifted closer to lower surface 214 than is shown in FIG. 10*a*. This occurs in FIG. 10*b* because the material in blade 164 is experiencing increased resistance to compression. Preferably, the stress to strain ratio during compression of the material in blade 164 becomes significantly less proportional as blade 164 approaches and passes deflection 172 shown in FIG. 10*a*, and becomes even less proportional as blade 164 approaches deflection 170 shown in FIG. 10*b*. In FIG. 10*b*, a medium kick maximum compression range 226 is substantially the same length as compression range 224 shown in FIG. 10*a* thereby displaying that the material within blade 164 shown in FIG. 10*b* is resisting further contraction under the compression forces created during a medium kicking stroke. In FIG. 10*b*, such resistance to compression causes neutral bending axis 210 to shift down so that the distance between neutral bending axis 210 and lower surface 214 is significantly less than the distance between neutral bending axis 220 and upper surface 212. In FIG. 10*a*, elongation zone 218 is larger than shown in FIG. 10*a* because neutral bending axis 220 has shifted closer to lower surface 214. Because the degree of strain or deformation of material in the form of elongation or compression increases with the vertical distance from the neutral surface, the downward shift of neutral bending axis 210 increases the distance between neutral bending axis 210 and upper surface 212. An arrow above elongation zone 218 displays a medium kick maximum elongation range 230 that shows the maximum elongation occurring to the material of blade 164 as blade 164 bends to deflection 170 during a medium kick. Elongation range 230 is significantly larger than elongation range 220 shown in FIG. 10*a*. This significantly increases the bending resistance of blade 164 since a the material within blade 164 must experience a significant increase in elongation along upper surface 212 in order to bend blade 164 from deflection 172 shown in FIG. 10*a* to deflection 170 in FIG. 10*b*. Angle 192 in FIG. 10*b* is only slightly larger than angle 180 shown in FIG. 10*a*, however, the elongation requirement displayed by elongation range 228 in FIG. 10*b* shows that a significant increase in load must be placed on blade 164 before blade 164 will deflect from deflection 172 in FIG. 10*a* to deflection 172 in FIG. 10*b*. Not only will significantly larger loads be required to elongate the material over this significantly increased distance, but the stress will be applied to the material at a greater distance from neutral bending axis 210 to create increased leverage on the blade because of an increase in the moment arm between neutral bending axis 210 and upper surface 212. Furthermore, the increased size of elongation zone 218 in FIG. 10*b* compared to the significantly smaller elongation zone 218 shown in FIG. 10*a* shows that in FIG. 10*b*, a significantly larger volume of material is forced to elongate in comparison to that displayed in FIG. 10*a*. Such an increase in the volume of material forced to elongate further increases bending resistance as increased loads are applied to blade 164. This method of controlling large scale blade deflections permits a predetermined angle of attack to be chosen during a light kicking stroke, and then select the cross-sectional dimensions of blade 164 and a material having sufficient elongation and compression properties that will meet or approach maximum compression requirements at such predetermined angle of attack and experience a sudden increase in bending resistance as neutral surface 210 shifts significantly closer to the compression side of blade 164 as the load to blade 164 is increased. This enables blade 164 to bend to a significantly large reduced angle of attack of attack under a light load and not over deflect during a hard kick used to reach a high speed.

Figure 10C:
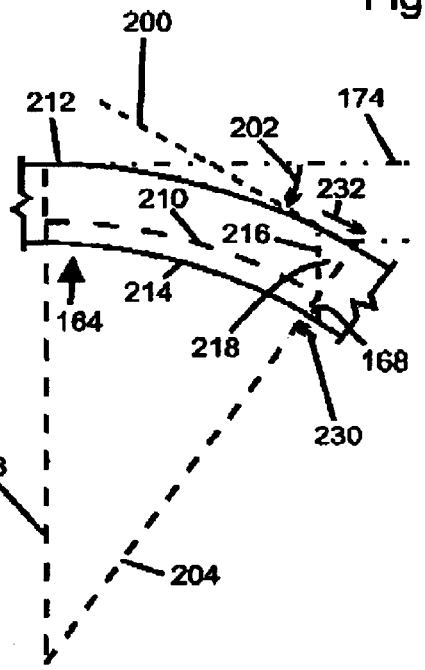

FIG. 10*c* shows a close up side view of blade 164 that is bent to deflection 168 during a hard kicking stroke. Radius lines 204 and 208 are seen to be shorter that radius lines 194 and 198 shown in FIG. 10*b*. In FIG. 10*c*, an arrow below lower surface 214 near radius line 204 displays a hard kick maximum compression range 230. Compression range 230 is seen to be significantly similar in size to compression range 226 shown in FIG. 10*b*. This is because the material along lower surface 214 is experiencing significantly large resistance to contracting any further under the compression stress applied by the bending moment applied to blade 164 during a hard kick. This causes neutral bending axis 210 to shift further down toward lower surface 214 and farther away from upper surface 212. In FIG. 10*c*, neutral bending axis 210 is seen to be significantly closer to lower surface 214 than is shown in FIG. 10*b*. This causes elongation zone 218 to be significantly larger in FIG. 10*c* than shown in FIG. 10*b*. In FIG. 10*c*, an arrow above elongation zone 218 displays a hard kick maximum elongation range 232 that is significantly larger than elongation range 228 shown in FIG. 10*b* even though angle 202 in FIG. 10*c* is only slightly larger than angle 192 shown in FIG. 10*b*. In FIG. 10*c*, the volume of material displayed within elongation zone 218, the degree to which it must elongate, and the moment arm between upper surface 212 and neutral bending axis 210 are all increased dramatically in comparison to that shown in FIGS. 10*a* and 10*b*. It can be seen that the internal forces within blade 164 change in response to the load applied. This creates a substantially large exponential increase in bending resistance as blade 164 is subjected to increased loads for producing higher swimming speeds. Because many factors combine to increase bending resistance simultaneously, bending resistance can be designed to increase dramatically once blade 164 reaches a predetermined angle of attack that is capable of producing highly efficient propulsion. When a material is selected for blade 164 that has elongation and compression ranges that create an exponential increase in stress to strain ratio within as a swimmer increases load by switching from a light kick to a medium or hard kick, the increase in bending resistance can even be more dramatic.

These methods allow an efficient angle to be achieved quickly and efficiently during a light kicking stroke and significantly maintained while using medium kicks or hard kicks to reach higher speeds. This represents a giant step forward in the art of fin design since swimmers can have significantly reduced leg strain and increased comfort and efficiency during light kicking stokes while having the ability to reach an sustain high speeds without the blade over deflecting under the increased loads created during hard kicks.

It should be understood that for different design applications, any desired angle or angles of attack may be selected then significantly maintained during use by employing the methods of the present invention. Below are some examples of blade deflection arrangements that can be designed and used. Angle 180 shown in FIG. 10*a* should be at least 10 degrees for a light kick and excellent results can be achieved when angle 180 is between 15 and 20 degrees. If desired, angle 180 can be approximately 20 degrees while angle 192 shown in FIG. 10*b* can be between 20 and 30 degrees, and angle 202 shown in FIG. 10*c* can be between 30 and 40 degrees. Angle 180 in FIG. 10*a* can be approximately 20 to 30 degrees on a light kick while angle 202 shown in FIG. 10*c* can also be made to be approximately 45 degrees on a hard kick. Preferably, angle 180 shown in FIG. 10*a* should be at least 10 degrees on a significantly light kick while angle 202 shown in FIG. 10*c* should be less than 50 degrees during high speeds.

The design process can include choosing a specific degree of blade deflection that is desired during a light kick and a specific degree of maximum deflection that is desired during a hard kick, and controlling these limits with a combination of blade geometry and elastomeric material having a significantly high elongation range and, or compression range over the specific bending stresses created within the blade material during a light kicking stroke used to achieve a significantly slow and relaxed cruising speed. Under the bending stresses created during a light to medium kicking stroke, it is preferred that elongation ranges are approximately 7–10% or greater, while compression ranges are at least 5% or greater. Further improved performance is created with elongation rates of approximately 15–20% and compression rates of approximately 10% during light to medium kicks. These significantly large elongation and compression ranges are then used in combination with cross-sectional geometry of blade 164 to create significantly low levels of bending resistance as blade 164 bends from neutral position 174 to deflection 172 during a light kick, and create a significantly large shift in neutral surface 210 toward the compression surface of blade 164 in an amount effective to create a substantial increase in bending resistance within blade 164 as blade 164 approaches and, or passes deflection 172 toward deflection 170 and 168 during medium and hard kicking strokes, respectively.

This is significant because the more rigid materials used for load bearing members in the prior art have limited elongation ranges of approximately 5% during the highest loads applied and have negligible compression or contraction ranges under the loads created during swimming. This causes prior art load bearing members to have a neutral surface that is located excessively close to the compression surface of the load bearing member during a light kick. This forces the tension surface of the load bearing members to have to elongate a significantly increased range of elongation in order for the member to bend around a transverse axis to a significantly reduced angle of attack. If a tall vertical cross-sectional dimension is used for the load bearing member, a 5% elongation range potential under extreme loads will not produce a large scale deflection during a light kick. This is why prior art load bearing members use small vertical cross sectional heights if increased blade deflections are desired. Because the neutral surface of the load bearing member is excessively close to the compression surface of the member, the neutral surface will not create a significant enough shift further toward the compression surface on harder kicks to create rapid enough change in bending resistance to enable a large scale deflection to occur on light kicks while preventing over deflection on hard kicks. The use of low elongation range materials within the members also creates a highly linear relationship between the strength of kick (load) and the degree of elongation (strain) occurring within the material. Prior art blades are therefore required to have significantly low levels of blade deflection during light kicks if over deflection is to be avoided during hard kicks.

Hooke's Law states that stress (load) and strain (elongation and, or compression) of a material are always proportional. Prior art load bearing blades and support ribs have not realized and developed an efficient method that enables the blade to avoid experiencing a highly linear relationship between blade deflection (angles of attack) and load on the blade (strength of kick) as the load changes from a light kick, a medium, and a hard kick. Although tapered blade height produces some non-linear behavior, this non-linear behavior is only seen as a swimmer increases kick strength beyond a hard kicking stroke and therefore significantly outside the useful range of swimming, and during light kicking strokes, insufficient blade deflection occurs. This is because the vertical bending of prior art blades around a transverse axis under varying loads created during light, medium, and hard strokes is significantly dependent on a highly linear and significantly unchanging relationship of lengthwise bending stress to lengthwise bending strain within the blade material (lengthwise elongation and, or compression).

The methods of the present invention permit the arrangement of the bending stress forces that are created within the material of the load bearing member during bending to experience a significantly large shift in orientation as the blade reaches a desired reduced angle of attack so that the new orientation of the stress forces existing within the load bearing member creates a significantly changed proportionality between the degree of strain to the material (elongation and, or compression) and the degree of bending experienced by the load bearing member under a given load. As blade 164 in FIGS. 10*a,* 10*b,* and 10*c* bends from position 174 to deflections 172, 170, and 168, a corresponding shift of neutral surface 210 toward lower surface 214 (the compression surface) results. The degree and rate to which neutral axis shifts toward lower surface 214 is substantially dependent on the vertical height of blade 164 and the stress to strain proportionality (often called the modulus of elasticity) and behavior of the material within blade 164 during compression and elongation created by the bending moment formed during light, medium, and hard kicks. Therefore, a combination of the vertical height of blade 164 and the elastic properties of a given material combine to create a desired shift in the position of neutral axis 210. The shift in the location of the neutral surface 210 toward lower surface 214 (the compression surface) creates a corresponding increase in the requirement for upper surface 212 (the tension surface) to elongate a proportionally further amount for a given increase in blade deflection. By properly selecting a material and vertical dimension of blade 164 that creates this process and also matches the new increase in elongation requirements established along upper surface 212 as blade 164 bends from deflection 172 to deflection 107, and from deflection 170 to deflection 168, blade 164 will experience a substantial increase in bending resistance since the material within blade 164 is substantially reaching or approaching its elastic limits in elongation and compression for the loads applied at these deflections. It the elastic limits of elongation and compression are substantially reached at deflection 164, blade 164 will not bend significantly beyond deflection 164 even if the strength of kick is increased well beyond that of a hard kick required to reach high speeds.

Because this process and relationship not been recognized, known, and utilized in the design of prior art fins, the use of more extensible materials in load bearing members of prior art fins results in the blade over deflecting during a medium and, or hard kick. This is because the proportionality of the vertical cross-sectional dimension of the load bearing member to the range of compressibility is incorrectly combined for a given strength of kick. Because prior art teachings have concluded that the use of highly extensible or highly "soft" materials for load bearing blades, members, and ribs results in the blade over deflecting during a hard kick, prior art approaches do not recognize an efficient method for solving this problem without substituting a more rigid material. Prior art designs have not recognized that highly soft materials can be used to provide load bearing support if the vertical height is sufficiently large enough to create elongation and compression requirements that significantly match the elongation and compression ranges of the soft material in an amount effective to create a change in bending resistance as the blade reaches a desired angle of attack.

Another benefit to large-scale blade deflections and significantly large elongation and compression rates is the ability to store more energy in the material of blade 164. As the material in blade 164 elongates and contracts while deflecting to significantly large reductions in angle of attack, energy is stored within the material of blade 164. The laws of physics states that the work conducted on an object is equal to the force applied to the object multiplied by the distance over which the object is moved. If the force is applied to an object but the object is not moved, then no work is done on the object. If the same force is applied to an object and the object is only moved a short distance then a small amount of work is done to the object. If the same force is applied to an object and the object is moved a greater distance, then increased work is done on the object. Because work is equal to energy, the amount of work done to an object is equal to the energy put into the object. Consequently, the work conducted to move an object that has resistance to movement from a spring-like quality equals the energy loaded into the spring in the form of potential energy. The greater the distance over which the force is applied, the greater the potential energy that is stored. Since the methods of the present invention create significantly increased movement of the load bearing material in blade 164 in the form of elongation and compression under equivalent bending stress forces created by equivalent kicking loads on prior art fins, the methods of the present invention permit significantly higher amounts of energy to be stored in the blade material during deflection. Because more potential energy is stored within the material of load bearing members employing the methods of the present invention, the energy released by the material at the end of the kicking stroke in the form of a snap is significantly higher than that of the prior art. Because more energy is stored and then released, propulsion is significantly more efficient. To maximize energy return, high memory elastomeric materials may be used such as thermoplastic rubber, synthetic rubber, natural rubber, polyurethane, and any other elastomeric material that has good memory and desirable elongation and compression ranges under the bending stresses created while generating propulsion.

Because the methods of the present invention permit high elongation and compression rates to occur while using a significantly large vertical height to blade 164, the stress forces stored in the elongated and compressed material of blade 164 are oriented at a significantly increased distance from the neutral surface over the prior art and therefore during the snapping action of blade 164, a powerful moment arm is created that pushes water back with increased efficiency due to increased leverage. Increased energy storage and release combines with increased moment arm to create a snapping force at the inversion point of each kick cycle that creates significantly strong peak bursts of propulsive force that far exceed that of any prior art fin.

Because load supporting members and ribs of prior art fins experience significantly small levels of elongation and compression under bending stresses, significantly small levels of work are done to the blade material. Because work is equal to energy, work done on an object is equal to the energy expended on the object. When work is done on an object that provides spring-like resistance to movement in the form of elongation and compression, the work done on the blade's material is proportional to the energy stored within the blade material. Because significantly low levels of work occurs within the material of prior art load bearing ribs and blades during light kicking strokes, significantly low levels of energy are stored within the material of prior art blades and ribs when such blades are deflected during a light kick. Since elongation and compression ranges on prior art load bearing members are significantly low on prior art fins during light, medium, and hard kicks, energy storage during all kicking strokes is significantly low. Because low levels of energy are stored within the material of prior art load bearing ribs and members as they are deflected, the energy returned to the water at the end of the stroke in the form of a snap back to neutral position is significantly low. When prior art blades snap back from their deflected position, the material within the load bearing members that have experienced significantly small amounts of movement in the form of elongation and compression while the blade was being deflected, then move the same small distance back to their original unstrained position. Because the return force is applied over this small distance of movement, the amount of work conducted on the water is significantly low as prior art blades return to their neutral position. Since work is equal to energy exerted on an object, the energy transferred from prior art blades to the water in the form of a snap back is significantly low.

In addition to increasing energy storage, the methods of the present invention further increase the power and efficiency of the snap back action at the end of the kick by significantly increasing the moment arm at which the material within blade 164 releases its stored energy to return blade 164 to neutral position 174 at the end of a kicking stroke. In FIGS. 10*a,* 10*b,* and 10*c,* the significantly large amount of elongated and contracted material displayed by elongation zone 218 and compression zone 222 is seen to be located a significantly large vertical distance from neutral surface 210. The permits the tension and compression forces to apply significantly increased leverage to blade 164 for more efficient and powerful snap back that is significantly more effective at accelerating water flow for increased propulsion.

The methods of the present invention that utilize significantly soft and extensible load bearing members that have sufficiently high vertical heights to prevent over deflection during a hard kick permit a combination of increased moment arm and increased energy storage to occur for unprecedented increases in snap back efficiency that far outperform prior art load bearing members. This is an unexpected result since soft materials are considered to be far too weak and therefore incapable of resisting over deflection. The increased snap back is also unexpected since the used of highly soft materials for load bearing members that do not employ the methods of the present invention are vulnerable to over deflection and therefore do not generate a sufficiently strong resistive bending moment to create a significantly strong snap back. Without sufficient vertical height, such soft load bearing members do not have sufficient moment arms and work being conducted on the material in the form of elongation and compression to establish proper energy build up or an efficient moment arm that is capable of supplying sufficient leverage required to force the blade to move large quantities of water. Because the prior art has not recognized the methods of the present invention, prior art load bearing members use significantly rigid materials with significantly low vertical height and volume to permit the rigid materials to bend under the loads created during swimming. This reduces both the energy stored within the material and the moment arm at which any stored any energy can be returned at the end of the kick to create a snap back. Because water has significantly high mass and therefore has a significantly high resistance to changes in motion, the low energy storage and small moment arms of prior art load bearing members is not efficient in accelerating water backward during a snap back motion to create significant levels of propulsion.

The methods of the present invention permit significantly soft load bearing members to create superior acceleration of water. Because compressibility is significantly related to material hardness, it is preferred that the elastomeric material used to apply the methods of the present invention has a Shore A hardness that is less than 80. The lower the durometer, the greater the compressibility and extensibility. The methods of the present invention permit exceptional performance to be achieved with significantly low durometers. Excellent results are achieved with a Shore A hardeness that is approximately 40 to 80 durometer. Smaller vertical heights are required for blade 164 when higher durometer materials are used and larger vertical heights can be used when the durometer is lower. Because larger vertical heights apply increased leverage during the snap back motion of the blade and also permit more energy to be stored and released, it is preferred that lower durometers and taller vertical heights are used for blade 164. However, if materials that have ultra-high memory at high levels of hardness are available, then exceptional performance may be achieved by using such materials with a small vertical height and a high level of hardness. Such ultra-high memory materials include Pebax, polyurethanes, nylon composites, Monprene, Isoprene, hydrated isoprene elastomers, high memory elastomers, high memory thermplastic rubbers, mixtures of elastomers and polypropylene, mixtures of elastomers and polyethylene, and ultra high memory thermoplastics. Some of these materials may offer significant elastic memory, rebound, recovery and snap-back at hardnesses ranging from a Shore A hardness of 85 to 98 durometer and ranging from a Shore D hardness of 45 to 75 durometer. These materials may be used to efficiently store energy within elongated material while minimizing product weight.

Description and Operation—FIG. 11

FIG. 11 shows seven sequential side views of the same fin shown in FIGS. 8–10 displaying the inversion portion of a kick cycle where the direction of kick changes. FIG. 11 displays the methods of the present invention that permit the blade to support a natural resonant frequency that has a significantly long wave length, large amplitude, and low frequency that substantially coincides with the frequency of a short kick cycle to create unprecedented levels of propulsive force with minimal input of energy.

FIG. 11*a* to FIG. 11*g* show that when the kicking stroke is inverted, a significantly large low frequency undulating S-shaped sine-wave is transmitted down the length of blade 164 from foot pocket 162 to a free end 234. The S-shape displayed by the wave shows that blade 164 is simultaneously supporting two opposing phases of oscillation in which one part of blade 164 is moving upward and another is moving downward. This is because blade 164 is designed to resonate on a substantially low natural frequency that is set into motion and amplified by the inversion of the direction of kick by the swimmer's foot during a kicking cycle. This low frequency wave transmission is made possible by the use of a substantially soft and extensible material that is capable of resonating on a significantly low frequency or low frequency harmonic of the swimmer's kick cycle frequency, combined with a vertical dimension that coincides with the elongation and compression ranges in a manner that prevents over deflection and creates significantly high levels of energy storage.

Figure 11A:
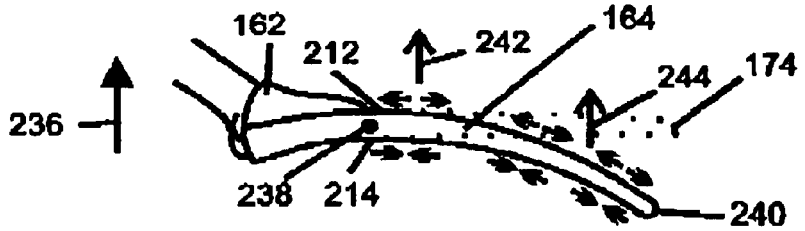

FIG. 11*a* shows the same fin shown in FIGS. 8 to 10. The fin is has an upward kick direction 236 that places blade 164 in a deflected position below neutral position 174. Blade 164 is seen to bend from near foot pocket 162 at a node or nodal point 238 that is displayed by a round dot. Node 238 is a reference point on blade 164 that shows where a reversal of phase occurs in the oscillation cycle of blade 164. Blade 164 has a free end 240 that is at the opposite end of blade 164 as foot pocket 162. The portion of blade 164 near foot pocket 162 is seen to have an upward root movement 242 that is displayed by an arrow. The portion of blade 164 near free end 240 is seen to have an upward free end movement 244 that is displayed by an arrow. Movements 242 and 244 are seen to occur in the same direction of kick direction 236. This is because blade 164 has reached its maximum level of deflection for a given kick strength being used by the swimmer. Above upper surface 212 between nodal point 248 and free end 240 are three sets of diverging arrows that indicate that the material within blade 164 along upper surface 212 has elongated from tension stress. The three sets of converging arrows below lower surface 214 show that this portion of blade 164 has contracted under compression stress. Both elongation and compression occur with significantly even distribution across the length of blade 164 and the arrows are intended to display a trend of strain within the material of blade 164 across a given area of blade 164.

Figure 11B:
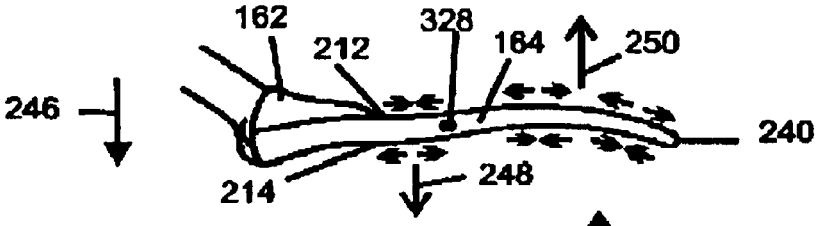

Once blade 164 is significantly deflected from kick direction 236 in FIG. 11*a,* the swimmer may reverse the kicking stroke to a downward kick direction 246 shown in FIG. 11*b.* In FIG. 10*b,* node 238 is seen to have moved closer toward free end 240 that shown in FIG. 11*a.* In FIG. 11*b,* this shows that a longitudinal wave is being transmitted down the length of blade 164. In FIG. 11*b,* the portion of blade 164 located between node 238 and foot pocket 162 has a downward root movement 248 displayed by an arrow located below lower surface 214. The portion of blade 164 between node 238 and free end 240 has an upward free end movement 250. The opposing directions of movements 248 and 250 show that blade 164 is supporting to different phases of a low frequency wave down the its length. Blade 164 between node 238 and foot pocket 162 is bending convex down while the portion of blade 164 between node 238 and free end 240 is convex up to show the formation of an S-shaped low frequency sine-wave undulation. Diverging pairs of arrows show movement of material within blade 164 in the direction of elongation and converging pairs of arrows show movement of material within blade 164 in the direction of compression.

As the kick direction 236 in FIG. 11*a* is reversed to kick direction 246 in FIG. 10*b,* the significantly high flexibility of blade 164 enables the inversion in phase of the kick cycle to create an inversion in phase of the oscillating cycle of blade 164. The significantly long elongation and compression ranges of blade 164 permit opposite phases in oscillation to exist along the length of blade 164. Because the methods of the present invention permit significantly large scale blade deflections to occur without over deflecting, wave energy is efficiently transmitted along blade 164 from foot pocket 162 to free end 240. The converging arrows beneath lower surface 214 between node 238 and free end 240 show that the material within this portion of blade 164 along lower portion 214 is compressed while being concavely curved. It can be seen that the degree of concave curvature of lower portion 214 between node 238 and free end 240 in FIG. 10*b* is significantly equal to or greater than that shown in FIG. 11*a*. This is because in FIG. 11*a*, lower surface 214 is substantially at a state of maximum deflection for a given kicking strength and as the stroke is reversed from kick direction 236 to kick direction 246 in FIG. 11*b*, the sudden change in kick direction creates a sudden increase in compression stress to lower surface 214 as the water above blade 164 near free end 240 exerts a downward resistive force opposing upward movement 250 of blade 164 near free end 240. In FIG. 11*b*, this downward resistive force applied by the water above blade 164 near free end 240 combines with the sudden downward movement 248 of blade 164 near foot pocket 162 from kick direction 246 to create a significantly increased bending moment across blade 164 between node 238 and free end 240 in comparison to the bending moment created in FIG. 11*a* between node 238 and free end 240 by kick direction 236. Because lower surface 214 in FIG. 11*a* is compressed to the point where significantly increased bending resistance is achieved, when the downward bending moment is increased from FIG. 11*a* to FIG. 11*b* between node 236 and free end 240, the increase in stress created by the increased bending moment results in only a slight increase in compression along lower surface 214 results. In FIG. 11*b*, this prevents blade 164 from buckling or over bending under the increased bending moment created as the kicking stroke is reversed and therefore the longitudinal wave is efficiently transferred down the length of blade 164 from foot pocket 162 to free end 240. This is because a significant shift in the neutral surface has occurred within blade 164 and blade 164 significantly resists further deflection between node 238 and free end 240. As a result, downward movement 248 of blade 164 between node 238 and foot pocket 162 created from kick direction 246, applies upward pivotal leverage around node 238 that is similar to a see-saw upon the outer portion of blade 164 between node 238 and free end 240. This pivotal leverage causes this outer portion of blade 164 to snap in the direction of upward movement 250 at a significantly increased rate. This is because upward movement 250 results from a combination of the release of stored energy from the deflection of blade 164 during kick direction 236 shown in FIG. 11*a*, as well as the additional leveraged energy provided by kick direction 246 in FIG. 11*b* as blade 164 pivots around node 238.

Figure 11C:
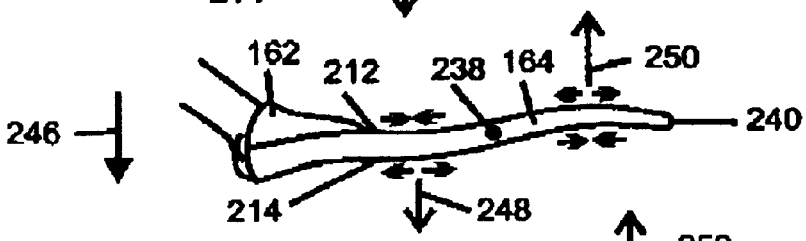

In FIG. 11*c*, the fin continues to be kicked in kick direction 246 and node 238 is seen to have moved closer to free end 240 than is seen in FIG. 11*b*. In FIG. 11*c*, blade 164 is seen to have a clearly visible S-shaped configuration that displays both opposing phases of a successfully propagated longitudinal wave having a significantly long wavelength and significantly large amplitude. In FIG. 11*c*, the portion of blade 164 between node 238 and foot pocket 162 is seen to have increased convex down curvature from downward movement 248 compared to that seen in FIG. 11*b*. In FIG. 11*c*, downward movement 248 continues to apply pivotal leverage around node 238 to the outer portion of blade 164 between node 238 and free end 240. This continues to accelerate this outer portion of blade 164 so that upward movement 250 of blade 164 gains significantly high velocity like that achieved in the cracking of a bull whip. The leverage force created around node 238 that increases upward movement 250 also creates an opposing leverage force upon the portion of blade 164 between node 238 and foot pocket 162 that pushes this part of the blade in downward direction 248. This is created as the resistance applied by water against upward movement 250 is leveraged across node 238 toward foot pocket 162. This is a benefit because it accelerates downward movement 248 of blade 164 and increases the ease of kicking the swim fin in kick direction 246. This greatly increases efficiency since the release of stored energy created within blade 164 during one stroke, assists in increasing the ease of kicking during the opposite stroke in which the stored energy is released. Because of the high energy storage within the material of blade 164 along with the resistance to over deflection created by the geometry of blade 164 and the high memory of the material, the dampening effect of water upon the wave being propagated along blade 164 is significantly resisted and the large amplitude high energy wave created along blade 164 is efficiently converted into forward propulsion.

The S-shaped sine wave transmitted along the length of blade164 is created by the input of energy by the swimmer's foot as the direction of the kicking stroke is reversed. This sends an oscillating pulse down the length of blade 164 from foot pocket 164 to free end 240. Because the methods of the present invention permit blade 164 to resonate efficiently at a natural resonant frequency that is significantly close to the frequency of kick cycles (or at least the frequency of the energy pulse created during the inversion point of the kick cycle), the frequency, amplitude, and period of the oscillating pulse transmitted down blade 164 is significantly determined by the frequency, amplitude, and period of the kicking stroke oscillation of the swimmer's foot through the water.

Figure 11D:
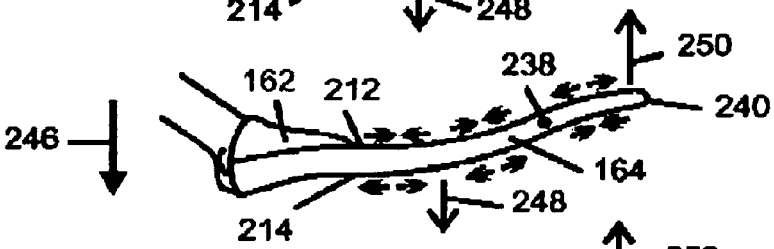

In FIG. 11*d*, node 238 is seen to be closer to free end 240 than shown in FIG. 11*c*. This shows that the undulating wave is being effectively transmitted toward from foot pocket 162 toward free end 240. In FIG. 11*d*, the portion of blade 164 between node 238 and foot pocket 162 has become significantly more deflected from the water pressure applied to lower surface 214 from downward kick direction 246. It should be understood that downward movement 248 displays the downward movement of this portion of blade 164 relative to the surrounding water due to kick direction 246. It can be seen that this portion of blade 164 between foot pocket 162 and node 238 is bending upward relative to foot pocket 162 under the exertion of water pressure created along lower surface 214 by downward movement 248.

The portion of blade 164 between node 238 and free end 240 is experiencing upward movement 250 with high levels of speed due to the whipping motion created by the efficient propagation of the longitudinal S-shaped sine wave along blade 164. Again, the speed of upward movement is significantly increased by the combination of stored energy within this outer portion of blade 164 and the pivotal leverage around node 238 that is applied by downward movement 248 near foot pocket 162. This permits the use of in phase constructive interference between the an energy pulse created during the inversion point of the stroke and the natural resonant frequency of blade 164 to significantly increase the speed, power, and efficiency of the snap back quality created by a high memory blade at the end of a kicking stroke.

Figure 11E:
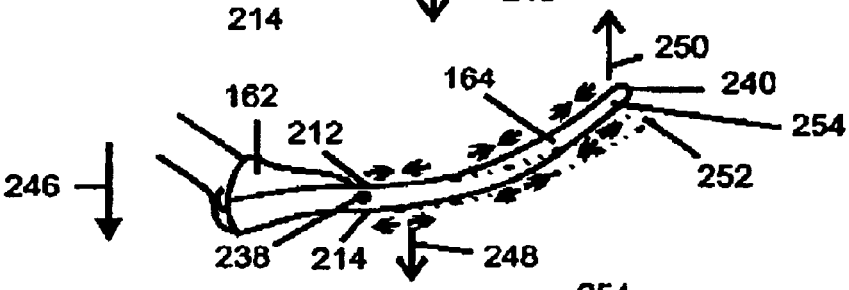

In FIG. 11*e,* free end 240 has snapped as the peak of the wave within blade 164 passes though free end 240 and node 238 is seen to form on blade 164 near foot pocket 162 because of the pivotal movement occurring in blade 164 near foot pocket 162. It should be understood that the use of node 238 and its relative positions on blade 164 are to assist communicating the general operation principles employed by the methods of the present invention and are not intended to be absolute. Any number of nodes or node positions may be used while employing the methods of the present invention. Nodes may have ranges of movement or may be significantly stationary depending on the application, particular design, and use of varying interference patterns and harmonic resonation.

In FIG. 11*e,* free end 240 is seen to still have upward movement 250 and has passed by a standard kick deflection 252 to a wave induced deflection 254. Standard deflection 252 is the degree of deflection created only from resistance of water pressure against blade 164 during a given kick strength. Deflection 254 is the added degree of deflection that is created by the combination of the water pressure applied to blade 164 during a given kick strength plus the added deflection provided by the undamped wave energy transmitted down blade 164 as the wave creates a whipping motion near free end 240. The momentum of the high-speed wave energy carries blade 164 to deflection 252. This causes additional compression to occur along upper surface 212, which is displayed by pairs of converging arrows above upper surface 212. This also causes additional elongation to occur along lower surface 214, which is displayed by diverging pairs of arrows below lower surface 214. The additional elongation and compression creates additional storage within blade 164 that is greater than that would occur without the contributed energy of the longitudinal S-shaped wave transmitted along blade 164 that is shown in FIGS. 11*b* to 11*e*. Because the methods of the present invention significantly prevent blade 164 from over deflecting under the loads created during kicking strokes used while swimming, wave induced deflection 254 in FIG. 11*e* is not excessively deflected and is significantly close to standard deflection 252. However, the energy storage is significantly increased because the continued shift of the neutral surface within blade 164 toward upper surface 212 (the compression surface in this example) enables significantly increased levels of elongation to occur along lower surface 214 (the tension surface in this example) without creating a an increase in blade deflection that is linearly proportional to the increased elongation. Instead, the shift in the neutral surface creates a highly non-linear proportional relationship that controls and prevents excessive blade deflection while maximizing energy stored in the form of highly elongated and compressed material within blade 164. Because excessive blade deflection is avoided, blade 164 remains at a highly efficient angle of attack for creating efficient propulsion. In addition, the increased levels of energy are stored within blade 164 to create a significantly stronger snap back than would have occurred without the addition of the wave energy utilized by the present invention. Because the oscillation created by the swimmer's foot at the inversion point of the kicking stroke significantly coincided with the natural resonant frequency range of blade 164, the energy of the kicking oscillation combined with the resonant frequency of blade 164 to create an in phase constructive addition of wave amplitudes to create a significant increase in the overall amplitude of the oscillation of blade 164. This increase in blade amplitude occurs with minimal input of kicking energy because of the resonant capabilities of blade 164. Because over deflection of 164 is controlled by the methods of the present invention, wave energy is stored within blade 164 while maintaining orientations that are capable of generating efficient propulsion.

Figure 11F:
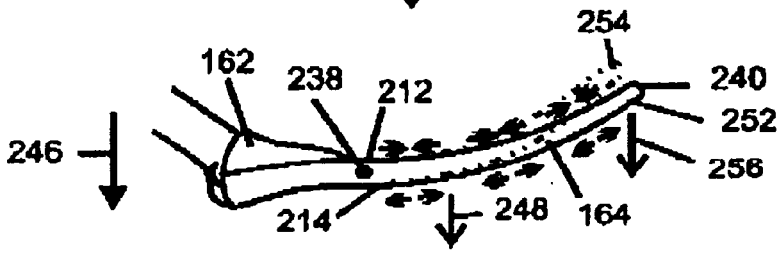

The capability of the present invention to prevent over deflection permits the wave amplitude to reach limits imposed by a sudden increase in bending resistance by the shift of the neutral surface so that the wave is able to "bounce" against this limit and begin a reversal in phase to start a kick in the other direction. This is shown in FIG. 11*f* where free end 240 has snapped in a downward free end movement 256 from wave induced deflection 254 to standard kick deflection 252 as the fin is continued to be kicked in downward kick direction 246. Because of this forward snapping motion created from the extra stored energy attained from wave induced deflection 254, downward movement 256 of blade 164 near free end 240 is significantly faster than downward movement 248 of blade 164 near foot pocket 162. This significantly increases the driving force of blade 164 used to create propulsion since the energy of this snapping motion of blade 164 near free end 240 displayed by downward movement 256 is combined with the energy generated by downward direction of kick 246. This creates a powerful downward blade oscillation that requires minimal input from the swimmer's foot while employing downward kick direction 246. The increased oscillation speed of blade 164 at downward movement 256 enables the swimmer to apply less downward force from the foot and leg in kick direction 246 than would be required if the added energy from wave induced deflection 254 was not generated.

Figure 11G:
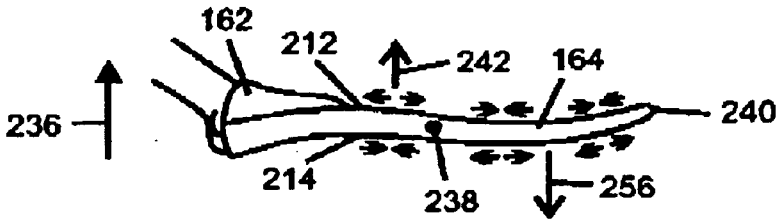

In FIG. 11*g,* the kicking stroke is inverted to restore kick direction 236 and upward root movement 242 shown in FIG. 11*a*. In FIG. 11*g,* node 238 is seen to move closer toward free end 240 than seen in FIGS. 11*e* and 11*f*. In FIG. 11*g,* the portion of blade 164 between node 238 and free end 240 is seen to continue moving with downward movement 256 as the portion of blade 164 between node 238 and foot pocket 162 is moving in upward direction 242. An S-shaped sine wave type longitudinal wave is seen to travel down blade 164 from foot pocket 162 to free end 240. Again, upward movement 242 creates a pivotal leverage around node 238 to increase the speed of downward movement 256 of blade 164 near free end 240. This leveraged increase in speed in movement 256 near free end 240 combines with the speed created by the acceleration of this portion of blade 164 from the increased energy attained from wave induced deflection shown in FIG. 11*e*.

This shows that once again the frequency of the energy pulse created by the inversion in the kicking stroke from downward kick direction 246 shown in FIG. 11*f* to upward kick direction 236 shown in FIG. 11*g,* is applied in phase with frequency of the sine wave generated along blade 164 that is shown to be formed in FIGS. 11*a* to 11*f*. This causes constructive wave interference that enables the input of kicking energy to be significantly synchronized with the natural resonant capabilities of blade 164 so that energy can be continuously added to a system at a high rate of efficiency and a low rate of energy loss. Because the inversion of the kicking stroke to kick direction 236 in FIG. 11*f* adds energy and speed to downward movement 256 of blade 164 near free end 240, this portion of blade 164 will have significantly high speed and momentum that will carry it below the deflection shown by standard kick deflection 214 shown in FIG. 11*a*. This causes blade 164 to store more energy and "bounce" back with increased energy and speed from the increased deflection limit reached as the kicking stroke is inverted again. Because the energy of kicking is continually added in phase with the natural resonant frequency capabilities of blade 164, high speeds can be achieved with significantly reduced levels of energy. The efficiency of propulsion is so significant using the methods of the present invention that swimmers are able to significantly reduce kicking energy once they reach a certain speed so that they are just adding enough energy to keep blade 164 oscillating. In order to maintain slow speed, swimmers find they must reduce kicking energy as they increase speed so that they do not continue to accelerate above their desired cruise speed by a continued input of the same kicking energy. This is an unexpected result has never been anticipated by the prior art. Without being directly informed of this specific process that is occurring, fin designers who are skilled in the art of fin design who have seen prototypes using methods of the present invention while under confidentiality agreements have not been able to identify the processes that are responsible for this unusual performance characteristic. Furthermore, such uniformed experts in the art of fin design continue to suggest that the performance of the prototypes shown to them can be improved further by using stiffer materials in the load bearing members and eliminating the use of significantly soft materials within such load bearing members. This shows that the hidden processes and methods disclosed by the present invention are unobvious and require the disclosure presented in this specification so that those skilled in the art may fully utilize and exploit these methods and processes so that the performance of oscillating hydrofoils can be increased to unprecedented levels The S-shaped sine wave transmitted down the length of blade 164 occurs at a sufficiently fast rate down the length of blade 164 that its presence is unnoticed by those who have not informed of this process. Even though the pulse occurs at a significantly low frequency, it is significantly high enough to avoid being noticed to the naked eye during use. The pulse created by the inversion of each kick transfers a fast whipping motion that does not draw attention to a sinusoidal pattern and overtly appears as a standard snap back. The gradual progression of flex positions of the sinusoidal wave shown in FIGS. 11*a* to 11*g* happen at a sufficiently fast rate of transition so that blade 164 seem to just be bending up and down. This makes this process unnoticeable and unobvious to a person skilled in the art of fin making who has not been instructed to look for and observe this hidden behavior and new unexpected result. Furthermore, because no prior art has effectively propagated a substantially large low frequency pulse within a substantially soft load bearing member that substantially occurs in phase with the swimmer's kicking oscillation (or at least the pulse created during the inversion of the kick cycle), the concept of reinforced in phase oscillation amplification is unknown, unexpected, unanticipated, and unobvious to those skilled in the art of fin design. Because prior art designs employ significantly rigid materials having significantly low elongation and compression ranges over the loads created during kicking strokes, prior art have not anticipated that softer materials having significantly larger elongation and compression ranges under the loads created during kicking combined with strategic vertical height of the load bearing members, can create the numerous unexpected results disclosed by the present invention. In addition to not anticipating such unexpected benefits, no method existed in the prior art for enabling significantly soft materials to be used in a manner that permit load bearing members to have significantly large scale blade deflections during light kicks and also prevent such load bearing members from over deflecting during a hard kick.

If stiff materials are used the resonant frequency is too high to effectively transmit and support large amplitude low frequency waves that have a sufficiently large enough wave length to form opposing phases of oscillation existing simultaneously along the length of blade 164. Just as loose piano wire resonates on a relatively low frequency and a taught piano wire resonates on a relatively high frequency, highly softer materials support lower frequencies while more rigid materials support higher frequencies. Because prior art fins attempt to use significantly rigid materials within load bearing ribs and blades, the natural resonant frequency of the blade is significantly too high to substantially match the kicking frequency of the swimmer. When softer materials are used, the intended purpose and benefits should be understood as well as the proper methods for creating the desired results. If the vertical dimensions of rail 164 are too small or too large and do not sufficiently match the elongation and compression ranges of the material used in blade 164, blade 164 will over deflect or under deflect, respectively.

Because the methods of the present invention permit over deflection to be avoided along blade 164 while also creating significantly increased levels of energy storage using large moment arms, blade 164 is able to efficiently transmit a significantly large amplitude S-shaped longitudinal sine wave that efficiently opposes the damping effect of the surrounding water. Since the methods of the present invention provide sufficient low frequency resonance, energy return, and leverage to be applied to the water in an amount effective to significantly reduce the damping resistance of water, the wave energy is effectively transferred to the water to create high levels propulsion.

The methods of the present invention permit the kicking frequency of the swimmer to be sufficiently close enough to the resonant frequency of blade 164 so that a large amplitude standing wave is created on blade 164. Because the resonant frequency of blade 164 is significantly close to the kicking frequency, the swimmer is easily able to deliver kicking strokes that occur in phase and reinforce the resonant oscillation of blade 164. This allows kicking energy to be added in phase with the resonant frequency of blade 164 so that the amplitude of the resultant standing wave is significantly increased. To maintain speed, the swimmer only needs to add enough energy to the oscillating system to overcome the damping effect of the surrounding water so that the standing wave is maintained at desired amplitude. This enables blade 164 to have significantly large oscillation range while the swimmer employs minimum effort and minimum leg motion. Various speeds can be achieved by varying the kicking amplitude and frequency to create in phase reinforced standing waves at various harmonics of the natural resonant frequency of blade 164. To increase oscillating frequency of blade 164, the swimmer can reduce the kick range and increase the frequency of the kicking strokes. Because the methods of the present invention permit blade 164 to resonate on a frequency that is significantly close to the range of kicking frequencies used by a swimmer employing a relatively small kick range, blade 164 will significantly adjust to harmonics of the kicking frequency and amplitude to continue the phenomenon of in phase constructive wave interference where blade 164 experiences significantly increased levels of oscillatory motion for a given amount of kick energy applied during swimming. This enables the swimmer to not need to know how or why the blade is working in order to achieve good results. All the swimmer needs to know is to use a relatively small kick range and that an increase or decrease in speed is achieved by kicking more frequently or less frequently within the same small kicking range, respectively. This makes the fin easy to use and no understanding of wave theory is required and there is no need to make conscious efforts to synchronize the kicking cycle to match the resonant behavior of the blade. Instead, the resonant behavior of the blade significantly adjusts to the kicking cycles of the swimmer that is using a significantly small kick. Testing shows that swimmers do not visually see or physically senses that any unusual resonant induced process is occurring and only notice that the fins produce excellent speed and acceleration with minimal effort and completely relaxed leg muscles. Since blade resonance occurs at significantly low frequencies and amplitudes that coincide with the range of kick frequencies and amplitudes of a swimmer, the resonant behavior is so subtle and smooth that it is completely unnoticed by the swimmer. Because no conscious effort is required while swimming with fins using the methods of the present invention, and because the active use of these methods occurs without the swimmer knowing that these methods and processes are occurring, the methods and processes of the present invention are unnoticed and unobvious.

Swimmers can be instructed to maximize performance by merely adjusting the size of their substantially small kick range and the number of kicks as desired to experience a wide range of comfort, speed, and efficiency that can be continually adjusted as desired. Although the swimmers notice a wide variety of extraordinary performance characteristics by employing such subtle variations in their kick range and number of kicks used, they remain unaware that these numerous favorable variations in performance are occurring from achieving a wide variety of harmonic resonant patterns that are made possible by the hidden methods of the present invention.

Description and Operation—FIG. 12

FIG. 12 shows a side view of sequence of seven different stroke positions a, b, c, d, e, f, and g of the kick cycle of a prior art swim fin having a highly flexible load bearing blade that permits high levels of blade deflection to occur during light kicking strokes, but lacks the methods of the present invention and therefore exhibits high levels of lost motion, wasted energy, and poor propulsion.

The kicking cycle shown in FIG. 12 shows both vertical movements of the fin from kicking and forward movements created from propulsion. The kicking cycle is seen to have a kick range 258 and a blade sweep range 260, both of which are displayed by horizontal broken lines. Kick range 258 is seen to have a lower kick limit 262 and an upper sweep limit 264. Sweep range 260 is seen to have a lower blade sweep limit 266, and an upper blade sweep limit 268.

In stroke position a, an arrow next to the foot shows that the foot is moving downward. The arrow below the fin in position a shows that the blade is fully bent under the load created during a light kicking stroke and is moving downward with the swimmer's foot. The fin has reached lower limit 262 of kick range 258 and is ready to reverse its kicking direction. Because the blade has bent to this large blade deflection during a light kick and does not use the methods of the present invention, the blade has little bending resistance and minimal energy storage. This causes the blade to have significantly low driving power for propulsion during the down kick and significantly poor snap back power during the inversion part of the stroke.

In position b, the arrow next to the foot shows that the swimmer has inverted the kick to an up stroke. The arrow below the blade shows the blade is moving downward and is seen to have reached a neutral or undeflected blade position. This is because the relatively weak snap back of the blade creates a slow snap back speed is substantially equal to the upward movement of the foot during the upstroke.

In position c, the foot is moving upward and the blade is moving downward and is finally reaching its fully deflected position for a light kick. The free end of the blade in positions a, b, and c, are seen to stay substantially near lower sweep range 266. This is because high levels of lost motion are occurring in which propulsion is lost as the blade inverts its angle of deflection. Propulsion is poor because energy is used up bending the blade rather than pushing the diver forward. Because no methods are used to store high levels of energy while the blade is bending, the energy used to bend the blade is lost and therefore cannot be efficiently recovered with a substantial snap back at the end of a kick. Because methods have not been developed that store high levels of energy in substantially weak and soft load bearing members, the snap back energy of such fins is excessively low. Without an efficient method to remedy this severe problem, prior art fins use significantly rigid materials for generating snap back from load bearing members. Because such materials have small elongation and compression ranges, energy storage is significantly limited and insufficient blade deflections occur during light kicks.

During the occurrence of lost motion, the foot covers a large vertical distance where the blade does not produce significant propulsion and therefore energy is wasted. Because highly flexible prior art blades suffer from such high levels of lost motion and because prior art design methods and principles lack a method for sufficiently reducing this undesirable side effect, prior art fins avoid the use of high deflection flexible blades and instead employ significantly rigid materials which exhibit minimal deflection during a light kick.

In position d, the foot and blade are both moving upward since the blade is fully deflected under the load of a light kick. Propulsion is finally achieved between position c and position d since the blade has stopped deflecting and is able to create propulsion. This propulsion is significantly low because the blade has no methods for providing sufficiently high bending resistance for the swimmer to push water backward. Any increase in kicking strength creates a significantly higher deflection in the blade that creates energy loss and over deflection to an excessively low angle of attack for creating propulsion. In position d, the prior art fin has reached upper kick limit 264 and is ready to invert stroke direction.

As the kicking stroke moves from position a to position d, the energy expended during the kicking motion is only utilized between position c and position d. Most of the stroke is wasted inverting the deflection of the blade. Prior art fin design principles teach that utilizing more rigid materials and minimizing the amount of blade deflection created during each stroke can reduce lost motion. This produces poor energy storage and high levels of leg strain. Because prior art fins using stiff materials still incur significantly high levels of lost motion between strokes, scuba dive certification courses and dive instructors teach student divers to use a significantly large kick range with stiff straight legs in order to maximize vertical blade movement after the blade is fully deflected. This creates large movements of large hip and thigh muscles while pushing against a blade that is creating large amounts of drag from being oriented at an excessively high angle of attack. This is highly inefficient since smaller blade deflections mean that less water is being pushed backward and more water is being pushed upward and downward. The lack of efficient propulsion in prior art fin designs exists because the methods of the present invention have not been previously known.

In position e, the foot is moving downward and the blade is pivoting upward as the direction of the kicking stroke is inverted. The horizontal orientation of the blade shows that the blade has reached its neutral resting position and is producing no propulsion.

In position f, the foot is moving downward and the blade is moving upward and is finally reaching its fully deflected orientation under the load of a light kick. The significantly low movement of the free end of the blade between position e and f shows that high levels of lost motion exist on the beginning of the down stroke.

In position g, both the blade and the foot are moving downward and have reached lower kick limit 262 and the stroke ready to be inverted. Propulsion is substantially limited and occurs between position f and g while energy is wasted during most of the down stroke.

The large kick range 258 creates large vertical leg movements and produces poor propulsion as seen by the limited horizontal forward movement of the swimmer's foot. Blade sweep range 260 is seen to be significantly smaller than kick range 258. This shows that the total distance over which the blade deflects is significantly smaller than the distance the swimmer has to move the feet. Looking back at the prior art fins shown in FIGS. 1 and 2, it at first falsely appears that the deflections of the blade created by various degrees of flexibility is causing the blade to travel a significantly larger distance than the distance traveled by the foot during use. This is not so since the drawings in FIGS. 1 and 2 do not show the actual relative vertical movements of the deflecting blade within the surrounding water while the swimmer is suspended in the water. Because of the damping effect of water, prior art blades which have been deflected from a neutral resting position to a deflected position during use, will act like a highly damped spring and therefore the blades will only spring back to a neutral blade position and will not spring past this neutral position. This prevents the maximum possible blade sweep range from being larger than the range of sweep that can be achieved by the free end of a non-flexed blade that is incurred for a given amount of leg and ankle pivoting. Because prior art fins create high levels of drag and have significantly low levels of energy storage applied across significantly small moment arms, the speed of snap back is significantly low under water. As a result, the greater the degree of flexibility of prior art fins, the smaller the sweep range of the blade and the greater the lost motion. Because no prior method exists for overcoming this problem of flexible blades, prior art fins use relatively rigid blades to minimize blade deflection and maximize sweep distance for a given amount of leg movement. Such stiff fins force the swimmer to use substantially large kick ranges, experience a substantial loss of propulsion from lost motion as the blade deflects between strokes, and incur high levels of muscle strain while overcoming high levels of drag after the blade is fully deflected. Although prior art flexible blades can reduce muscle strain, excessive lost motion, poor energy storage, poor snap back, low bending resistance, and over deflection during hard kicks prevents such fins from performing well. Because prior fin design principles lack efficient methods for overcoming these major problems, prior art fins produce significantly poor performance whether stiff or flexible materials are used within the load bearing members of prior art fins.

Description and Operation—FIG. 13

FIG. 13 shows five sequential side view a to e of a fin having a significantly flexible blade that employs the methods of the present invention. The kicking cycle shown in FIG. 12 shows both vertical movements of the fin from kicking and forward movements created from propulsion. The kicking cycle is seen to have a kick range 270 and a blade sweep range 272, both of which are displayed by horizontal broken lines. Kick range 270 is seen to have a lower kick limit 274 and an upper sweep limit 276. Sweep range 272 is seen to have a lower blade sweep limit 278, and an upper blade sweep limit 280. The side views of kick positions a, b, c, d, and e show that kicking range 270 is substantially small in comparison to blade sweep range 272. This is made possible because the methods of the present invention permit a load bearing blade or load bearing member to support a resonant frequency or low frequency harmonic that is sufficiently close to the amplitude and frequency (or period) of the shock wave transmitted down the length of the blade as the direction of kick is inverted. This causes low frequency harmonic resonance to occur within the load bearing in phase with the shock wave and in an amount effective to significantly amplify the amplitude of the shock wave as it travels down the length of the load bearing member toward the free end of the fin. Because the amplitude of resonance increases as the supported harmonic resonant frequency becomes lower, the methods of the present invention utilize substantially soft and resilient materials in a manner that permits them to support a significantly low frequency harmonic so that the amplitude of the shock wave is significantly increased.

In kick position a of FIG. 13, the large arrow below the swimmer's foot shows that the foot is moving downward. The downward directed arrows below the blade show that this portion of the blade is moving downward. The fin has reached lower kick limit 274 is has become deflected under the load of water pressure created during a light kick. The downward directed arrow below the free end of the blade show that is portion of the blade is starting to move slightly forward. Because the methods of the present invention permit the energy used to deflect the blade to a significantly reduced angle of attack to be efficiently stored within significantly large volumes of substantially elongated and compressed high memory material, and because bending resistance builds up at a high rate after reaching a desired large-scale deflection, large amounts of potential energy are stored within the blade shown in position a.

As stated before, swimmers only need to be told to use small kicking strokes and do not need to be aware of what processes occur in order for them to use fins employing the present methods. By increasing the speed of kicking strokes used within a small kicking range, dramatically high levels of acceleration and speed can be achieved. Extraordinarily high bursts of speed can be achieved by continuously inverting the direction of the kicking stroke as fast as possible over the smallest kick range possible. The highest speeds can be achieved inverting the kicking stroke as soon as the blade has become sufficiently deflected for the swimmer to begin feeling a slight amount of resistance or even invert the kick before the blades are fully deflected. This is counterintuitive to experienced divers and swimmers since prior principles teach that resistance needs to be established to push off of before propulsion can be achieved. Such prior principles also teach that the inversion portion of a stroke creates lost motion in which no propulsion is gained and energy is wasted. This shows that unobvious, new and unexpected results occur while the underlying processes that make such results possible are unobvious as well.

In position b, the large arrow above the foot shows that the direction of kick has been inverted from a down stroke in position a, to an up stroke in position b. In position b, it can be seen that the reversal in stroke direction creates an energy pulse or shock wave down the length of the blade from the foot pocket to the free end of the blade. Because the methods of the present invention permit the blade to naturally resonate on a low frequency harmonic of this longitudinal shock wave, the amplitude or wave height is significantly amplified by the resonant qualities of the blade. The arrows above the rail near the foot pocket show that this portion of the blade is moving upward with the swimmer's foot. The downward arrows below the free end of the blade show that this portion of the blade is moving downward in the opposite direction of the kicking stroke. This is because the high levels of energy stored within the deflected blade shown in position a is being released to create a snap back motion, which is being further propelled by the large amplitude low frequency wave that is being transmitted down the length of the blade.

Because of the significantly high extensibility, compressibility, memory, and non-linear deflection characteristics provided by the methods of the present invention, there is a significant delay in time between applying a load and establishing a corresponding resistive bending moment within the blade. This delay results from the time that it takes to elongate and compress the material within the blade in a direction that is normal to the blade's cross section, and also results from the time it takes to create a sufficiently large enough shift in the neutral axis of the blade toward the compression surface of the blade to create a significant increase in bending resistance. This delay in time between loading and deflection increases toward the free end of the blade. When the blade is kicked in first direction to create a delayed first blade deflection, a reversal in kick direction to a second kick direction creates an opposite blade deflection that originates near the foot pocket and travels toward the free end at a delayed rate. Because the first blade deflection occurs at a significantly delayed rate, the second oppositely blade deflection can be generated near the foot pocket while the first blade deflection is still occurring near the free end of the blade. This creates an S-shaped wave down the length of the blade that creates a whip like snapping motion. It is preferred that this delay in time is substantially similar to either the period of a single kicking stroke (one half of a full kick cycle), or the period of the inversion portion of each kicking stroke, or the period of the shock wave generated as the direction of kick is inverted. It should be understood that the period of the shock wave pulse transmitted down the blade can be much shorter than that of a single kicking stroke as long it occurs sufficiently in phase with the snap back motion of the fin to significantly increase the energy, speed, and amplitude of the snap back motion. It is preferred, but not required, that the harmonic of the blade's resonant frequency that is supported and amplified by the resonant qualities of the blade, occur substantially in phase with the inversion portion of the kick cycle so that the snap back near the free end of the blade occurs with greater speed, amplitude, and a shorter period than it would experience without the in-phase harmonic resonance of the blade.

In position b of FIG. 13, the simultaneously opposing blade deflections are seed to occur along the length of the blade. Although the foot movement was inverted at lower kick limit 274 in position a, in position b the free end of the blade is seen to be moving passed limit 270 and continuing toward lower blade sweep limit 278. This is because of the addition of in phase wave addition. The snap back energy stored in position a is being released in position b in a manner that is in phase with the reversed direction of kick and the lengthwise wave along the blade that is supported and amplified by a low frequency harmonic of the blade's natural resonant frequency. This creates a synergistic effect that greatly increases the amplitude, speed, and energy of the sweeping motion of the blade created by a kicking motion.

In position c, the foot has reached upper kick range 276 and the free end of the blade is approaching lower blade sweep limit 278. The foot is moving upward, the blade is highly deflected and the direction of kick is ready to be reversed. The delay in time of blade deflection is seen as the root portion of the blade near the foot pocket is moving upward and the free end of the blade is still moving downward.

In position d, the direction of kick has been reversed. The free end of the blade shown in position d has moved a significantly large distance from that shown in position c. This is significantly large in proportion to the distance the foot has moved from position c to position d. This shows that the free end of the blade shown in position d is moving at a significantly high speed even though the input of energy is minimal.

In positions e, the downward directed kick has reached lower kick limit 274 and the free end of the blade is moving upward toward upper blade sweep limit 280. It can be seen that the blade is significantly more deflected than that shown in position a. This is because the deflection seen in position a occurred before harmonic resonance is achieved. Because harmonic resonance is occurring in position b through e, the blade extends significantly beyond kick range 270 to a larger blade sweep range 280. In alternate embodiments, the accumulation of harmonic resonant wave energy can be used to efficiently overcome the damping effect of water and the drag coefficient of the blade so that the sweep range is significantly increased over that experienced by prior art blades.

In positions b through e, it can be seen that the methods of the present invention permit the root portion of the blade to oscillate in the opposite direction as the free end of the blade. This shows that a standing wave is achieved with a nodal region existing substantially between these two blade portions. The standing wave is seen to occur in substantially in phase with the kicking strokes being used. This allows the swimmer to continually add energy to the blade oscillations in a manner that reinforces and adds energy to the standing wave. It is well known that if a standing wave is generated on a harmonic of an objects resonant frequency, substantially small inputs of energy that are applied to the object in phase with the oscillation of the standing wave can create dramatically large increases in the amplitude of the standing wave. This phenomenon has been known to be a problem that can destroy bridges and other large structures, however, it has not previously been known that this phenomenon can be used and exploited to create increased efficiency and propulsion on swim fin blades and oscillating propeller blades.

In addition to providing this process of harmonic resonance of flexible blades, the deflection control methods of the present invention provides exceptional control of this process. This is because the methods of the present invention that enable large-scale blade deflections to occur on a light stoke while limiting excessive deflection on a hard stroke permit blade deflection limits to be set. When the blade approaches the predetermined deflection limits, a significant shift of the positioning of the neutral surface occurs that creates a sudden increase in bending resistance that stops further movement of the blade. Because this process occurs exponentially in a smooth manner, there is no "clicking" sound or sensation to irritate the user. The exponential increase in bending resistance is smooth and is similar to the exponential increase in resistance experience by a person reaching the fully deflected of a trampoline while jumping. Because the present invention provides efficient methods for limiting blade deflection, the use of harmonic resonance is controlled and prevents the blade from over deflecting from the added wave energy. The increased wave amplitude capabilities of harmonic resonance are substantially trapped and controlled by the blade deflection limits. This allows the user to reverse kick direction as desired. When the oscillating blade reaches the desired blade limit, the wave "bounces" off the limit set by the suddenly increased bending resistance of the blade so that the wave is deflected back in the other direction. The user can control this occurrence by purposefully changing the kick direction during use. If the direction of kick is changed, the blade moves toward the oncoming wave so that the wave collides with blade deflection limit in less time. This also permits the user to add energy to the "bounce back" effect of the wave by adding energy to the impact by increasing the speed and strength of the kicking motion. This causes an increase in wave energy as the wave reflects in the opposite direction after impact. The user can choose once again to quickly reverse the kick direction immediate after this impact and reflection of wave energy so that the blade sweep limit on the other stroke is moved toward the recently reflected oncoming wave for another energy building impact. The shorter the time period between kick inversions, the greater the number of blade reflections and the greater the oscillating frequency of the blade movement. This process results in standing wave induced snap back motions that create dramatic increases in the speed of the blade through the water. The longer the time between kick inversions, the lower the frequency of blade oscillations and the slower the swimming speed. Because blade deflection limits are efficiently achieved by the methods of the present invention, the user can easily and unknowingly control the complex resonant processes occurring within the blade by merely varying the kick range and the number of kicks to create any desired level of speed. The blade limits permitted by the present invention permit the user to consistently control the resonant processes over a wide variety of swimming speeds. Because methods of the present invention are so smooth and efficient, the swimmer remains completely unaware of any such complex processes and is able to fully enjoy the benefits without detailed education of the process. The main reasons for the detailed disclosure provided in this specification is to inform the designers of swim fins and oscillating hydrofoils to understand and put to use these methods and processes so that the performance these products can be significantly increased.

The methods of the present invention also permit more effective acceleration of water to be achieved during the snap back of the blade through the water. Increased elongation and compression ranges are used to store energy within significantly high volumes of high memory elastomeric material so that superior energy return is applied by the blade against the water during the snap back of a deflected blade. Because large rates of elongation and compression occur as the blade deflects to significantly large-scale deflections, large amounts of work are done to the material and this work is efficiently stored as potential energy. During the snap back, the elongated and compressed high memory material attempts to regain its unstrained orientation. The elongated material contracts and the compressed material expands. If the blade is snapping back from a downward blade deflection, the elongated material within the upper portion of the blade will apply leverage to pull lengthwise on the blade to create a leveraged bending moment that pulls upward on the deflected blade. At the same time, the compressed material along the lower portion of the blade pushes lengthwise along this portion of the blade to create a leveraged upward bending moment on the blade. The combination of pushing and pulling forces applied at increased heights above the neutral surface of a high memory material creates significant improvements in snap back efficiency. Because the recovering elongated and compressed material apply pulling and pushing forces, respectively over significantly long ranges of material movement which power the movement of the blade over a significantly long distance, the blade pushes against the water for a significantly long distance with a significantly constant recovery force. Because energy was efficiently stored over significantly long distances of material elongation and compression under the force generated by a light kick, the force applied during the snap back motion is applied to the water over a significantly long distance. This creates a significantly increased terminal velocity to the water at the end of the snap back. The high amplitude oscillation of the standing wave shown in FIG. 13 creates additional acceleration of water since the increased amplitude extends the distance over which the propulsion force is applied to the water.

Description and Operation—FIGS. 14 to 26

FIG. 14 shows a perspective view of a swim fin being kicked upward and the blade is seen to have a significantly large vertical thickness that is substantially consistent across the width of the blade. A blade 282 is attached to a foot pocket 284. Blade 282 is being kicked upward in a direction of kick 286 and is deflected under the exertion of water pressure.

FIG. 15 shows a cross-sectional view taken along the line 15—15 in FIG. 14. Blade 282 is seen to have a rectangular cross section. In this embodiment, blade 282 is a single load bearing member and can have any desirable cross sectional shape that has sufficient vertical dimensions to achieve the methods of the present invention. Alternate cross sectional shapes include oval, diamond, ribbed, corrugated, scooped, channeled, angled, V-shaped, U-shaped, multi-faceted, or any other suitable shape that can be used in conjunction with the methods of the present invention. In alternate embodiments, longitudinal channels, variations in thickness, or ribs may be used in any desired configuration across the cross section of blade 282. Such ribs, channels, or variations in thickness or channels may be formed out the same material used in blade 282, or may be formed out of multiple materials having various levels of consistency.

Blade 282 is seen to have a consistently thick cross section. This provides blade 282 with high distribution of bending stresses that can provide highly efficient spring characteristics. The substantially large volume of elastomeric material used in blade 282 provides blade 282 with a substantially large amount of mass that permits it to have high levels of momentum when resonating on large amplitude low frequency harmonics of its natural resonant frequency. This can create a high momentum to drag ratio. Because harmonic resonance enables large amplitude standing waves to be maintained with relatively small inputs of energy, high levels of momentum can provide blade 282 with the ability to overcome a significant amount of the damping effect created by the drag coefficient of blade 282. The high mass and volume also offers increased low frequency resonance. If the material has a specific gravity that is significantly close to that of water, or salt water, blade 282 will feel significantly weightless underwater while providing high levels of efficiency from a high spring constant, low internal damping, low frequency harmonic resonance, and controlled blade deflections.

FIG. 16 shows a cross-sectional view taken along the line 16—16 in FIG. 14. The thickness of this portion of blade 282 is less that the thickness shown in FIG. 15. In FIG. 16, the reduced thickness of blade 282 occurs because the load on blade 282 is greatest near foot pocket 286 and is lowest near the free end of blade 282. This is because the moment arm of the water pressure on blade 282 decreases toward the free end of blade 282. The degree of taper used in blade 282 from foot pocket 286 to the free end of blade 282 can occur in any desired manner. It is preferred that the degree of taper does not cause the outer portion of blade 282 to become excessively thin. Preferably, the outer portion of blade 282 remains sufficiently thick enough to not over deflect during a hard kick. It is also desired that the bending resistance near the free end of blade is sufficiently high to permit a significantly large amount of bending stress to be distributed over a significantly large portion of blade 282 so that a desired radius of bending curvature can be achieved. This increases leverage upon blade 282 so that high levels of elongation and compression occur where vertical thickness is substantially large. This maximizes energy storage, the surface area of blade 282 that is oriented at a desired angle of attack, the ability to control blade deflections, and the ability to support large amplitude harmonic resonance.

The cross-sectional views permit the overall cross-sectional dimensions, or section modulus of load bearing members to be discussed in regards to the methods of the present invention. In previous sections of this specification, for purposes of simplification discussions have been initially limited to the relationship of the vertical dimensions of a load-bearing blade to the elongation and compression capabilities of the material used within the blade. Overall cross sectional dimensions are important because the creation of a bending moment on a beam creates bending stresses of tension and compression that are applied in a direction that is normal to the cross section of the beam. The greater the cross sectional volume, the greater the number of individual "fibers" (or infinitesimally small lengthwise elements of a given material) that are stressed during bending. The greater the number of "fibers" for a given load on the beam, the greater the distribution of stress across the cross section and the lower the stress per fiber. The smaller the cross section, the greater the stress per fiber for a given load. As stated previously, the greatest stresses occur at the greatest vertical distance above and below the neutral surface of the beam. Because of this, vertical height is significantly important to the methods of the present invention.

As the cross sectional width is increased for a given cross sectional height, bending resistance is increased because of the increased number of lengthwise fibers. It was previously mentioned that a given desired maximum angle of attack from an elastomeric load bearing member by matching the elongation and compression ranges required by the vertical dimension of the load bearing member as it bends around a specific radius of curvature to the desired angle of attack with a material that can meet those requirements under the loads applied. The same process is used, except that now the cross sectional width and shape are included into the combination. The greater the cross sectional width, the greater the distribution of the bending stresses over a given cross section. This reduces the stress per fiber and therefore reduces the strain (deformation) of each fiber in the form of elongation and, or compression. In order for a load bearing member having a larger widthwise cross sectional dimension to achieve the same blade deflection under the same load (such as that created during a light kicking stroke) while the vertical blade height remains constant, the material used within the member must be more extensible and, or compressible. This is to permit the fibers to elongate and, or compress more under the newly reduced bending stresses.

Another option is to reduce the vertical dimensions of blade 282 so that the increased bending resistance created by the increased width is compensated by a reduction in vertical height. If this is to occur, sufficient vertical height must be used in combination with the elongation and compression ranges of the material to permit the neutral axis to experience a sufficient shift toward the compression surface to create a significant increase in the bending resistance as blade 282 approaches or passes the desired angle of attack during a particular kick strength.

FIG. 17 shows a perspective view of a fin being kicked in an upward kick direction 288. A blade 290 is seen to have a longitudinal load bearing rib 292 located on each side of blade 290 as well as along the center axis of blade 290. Each load bearing rib 292 extends from a foot pocket 294 toward a free end 296 of blade 290. Blade 290 is deflected from being kicked in upward kick direction 288. The embodiment shown in FIGS. 17 to 19 uses less material across the widthwise dimension of blade 290 and therefore can have a taller vertical height if desired. By placing more material at a greater vertical height from the neutral surface of each rib. Blade 290 is seen to have a membrane portion 298 that extends between each load bearing rib 292. Membrane 298 can either be made from a highly resilient material or a significantly rigid material. If a significantly rigid material is used for membrane 298, it is preferred that membrane 298 is relatively flexible significantly near foot pocket 294 so that a substantial amount of deflection occurs to the beginning half of blade 290 during use so that substantial levels of energy storage occur within each load bearing rib 292 along the beginning half of blade 290 near foot pocket 294. It is preferred that load bearing ribs 292 bear the load created by the exertion of water pressure during kicking strokes so that the methods of the present invention are significantly able to be utilized.

FIG. 18 shows a cross-sectional view taken along the line 18—18 in FIG. 17. Load bearing ribs 292 are seen to have a substantially oval cross sectional shape. The oval shape is significantly wide in comparison to its height in order to provide vertical stability and resistance to twisting or buckling under the strain created during swimming. The oval shape is beneficial since the rounded upper and lower surfaces can permit a certain degree of twisting along the length of ribs 292 to occur during use without creating a sudden decrease in vertical dimension. It is preferred that if some twisting does occur during use, such twisting does not cause a change in the vertical height of ribs 292 that is significant enough to create a decrease in bending resistance along the length of ribs 292 in a manner that can interfere with the methods of the present invention. A reduction in the vertical height of ribs 292 created by excessive twisting reduces the degree to which the material within ribs 292 must elongate and, or compress during use. It is preferred that suitable design steps are taken to insure that the vertical height of each rib 292 relative to the neutral surface remains sufficiently constant during use that the bending methods of the present invention are able to be maximized. By providing a significantly rounded cross sectional shape and significantly large width to height ratios, ribs 292 can offer significantly high levels of stability and high levels of performance.

The cross sectional view shown in FIG. 18 displays that membrane 298 passes through the middle section of ribs 292. If membrane 298 is made from a substantially extensible material, then this method of attaching membrane 298 to ribs 292 provides a mechanical bond that can reinforce a chemical bond. Holes can exist within membrane 298 at the connection points between ribs 292 and membrane 298 so that during the molding process, the material within ribs 292 can flow through the holes in membrane 298 in order to form a stronger mechanical bond. Any desirable combinations of mechanical and, or chemical bonds may be used.

If membrane 298 is made of a material that is relatively rigid and has significantly low levels of extensibility, the presence of membrane 298 in the middle portion of ribs 292 may cause ribs 292 to have reduced elongation along the tension surface of ribs 292. The compression surface will still compress and reach a maximum compressed state that can be used to limit blade deflection and store energy. However, after the neutral axis within ribs 298 shifts toward the compression surface of ribs 298, the height of membrane 298 above the neutral axis within ribs 292 will determine the amount of elongation along membrane 298 required to create further bending. The degree to which the material within membrane 298 can elongate under the load applied to blade 290 during use will determine how much further ribs 292 can deflect under an increased load. As a result, the extensibility of a given material used for membrane 298 within ribs 292 can be used to control and limit blade deflections. If the height of the tension surface of ribs 292 above the neutral surface within ribs 292 is sufficiently high, the tension surface of ribs 292 may become fully elongated before significant stress is applied to membrane 298.

FIG. 19 shows a cross-sectional view taken along the line 19—19 in FIG. 17. Ribs 292 are seen to be smaller at this portion of blade 290 and have achieved a more round cross sectional shape. If membrane 298 is made from a relatively material, then the outer portions of ribs 292 can be more oval and less round since the rigidity of membrane 298 can provide sufficient support to these outer portions of ribs 292 so that they do not twist significantly during use. If membrane 298 is made from a highly resilient material, ribs 292 are preferred to be significantly round near this portion of ribs 292. This is because if significant twisting occurs to ribs 292 at this outer portion of the blade, such a round shape permits the vertical height above and below the neutral surface to be significantly maintained. The rounded shape also provides constant symmetry about the centroidal axis so that if any twisting does occur, ribs 292 do not experience a significant change in symmetry relative to the neutral surface and therefore do not become unstable and are able to maintain significantly high levels of structural integrity.

In alternate embodiments of the cross sectional views shown in FIGS. 18 and 19, the upper portion of ribs 292 existing above membrane 298, can be made out of a different material than the lower portion of ribs 292 existing below membrane 298. The use of two different materials, or the same material having different levels of hardness, extensibility, or compressibility above and below membrane 298 can permit blade 290 to exhibit different deflection characteristics on opposing strokes. For instance, if the material within lower portion of ribs 292 is more compressible than the material within the upper portion of ribs 292, then blade 290 will deflect more when blade 290 is deflected in a downward direction than when kicked in an upward direction.

FIG. 20 shows an alternate embodiment of the cross sectional view shown in FIG. 18, in which blade 290 has a series of load bearing ribs 293 that have a significantly half round cross-sectional shape and extend above and below membrane 298. Three load bearing ribs 293 are seen on the upper surface of blade 290 and two load bearing ribs 293 are seen on the lower surface of blade 290. The size of ribs 293 located below membrane 298 are seen to be larger than the size of ribs 293 located above membrane 298. This arrangement is only one of many possible arrangements of ribs 293 that employ the methods of the present invention. Any desired configuration, size, combinations of size, combinations of materials, or cross sectional shape can be used for ribs 293 while employing the methods of the present invention. The two larger size ribs 293 located below membrane 298 can be designed to significantly balance the volume of material located in the three smaller ribs 293 located above membrane 298. The larger vertical height within ribs 293 below membrane 298 permits increased stress to be applied to the material within them. The increased width of the larger ribs 293 below membrane 298 provides additional stability so that the increased stress forces created by their vertical height does not cause them to buckle or twist significantly during use. It is preferred that load bearing ribs 293 provide the majority of load bearing support for blade 292 and that membrane 298 is therefore significantly supported by load bearing ribs 293.

The alternate embodiment shown in FIG. 20 can be used to create different blade deflection limits on the up stroke or down stroke if this is desired. This can be an advantage if the angle between foot pocket 294 and blade 290 at rest is such that only a relatively small deflection is desired on one stroke in order to achieve a significantly reduced angle of attack relative to the movement between the fin and the water during use, while the resting angle of blade 290 requires that a substantially large blade deflection is required on the opposite stroke. Variations in elongation compression ranges can be created by providing different load bearing rib geometry on either side of blade 290. If desired, ribs 293 can exist only on the upper surface or only on the lower surface. This can further enable blade 290 to have large variations in deflection characteristics on opposing strokes.

FIG. 21 shows a perspective view of an another alternate embodiment of a swim fin having a blade 310 kicked in an upward kick direction 312 while employing the methods of the present invention. Blade 310 has a significantly large longitudinal load bearing rib 314 is located along each side edge of a membrane 315. Ribs 314 extend from a foot pocket 316 to a free end 318 of blade 310.

FIG. 22 shows a cross-sectional view taken along the line 22—22 in FIG. 21. In this embodiment, membrane 315 and ribs 314 are made from the same highly extensible material. This is a strong advantage because foot pocket 316, ribs 314, and membrane 315 can be molded in one step from one material. This is because it is preferred that ribs 314 are made from a substantially soft, compressible, and extensible material in order to employ the methods of the present invention. These same material qualities offer excellent comfort when used to make foot pocket 216.

Because the vertical dimension of membrane 315 is seen to be substantially small, the vertical dimensions of ribs 314 can be increased to provide increased requirements for elongation and compression along the upper and lower portions of ribs 314. The lower the number of ribs 314 and the thinner or more flexible the material of membrane 315 used for a given material, the greater the vertical height that can be achieved within each rib 314. Ribs 314 are seen to have a vertically oriented oval cross sectional shape. This places more material at a greater vertical distance from the neutral surface within ribs 314 and therefore increases amount of elongation and compression that must occur to the material within ribs 314 for a given large-scale blade deflection. Because ribs 314 in this view are significantly close to foot pocket 316, the vertical structure of foot pocket 316 provides vertical stability to the portions of ribs 314 that are significantly close to foot pocket 316. This vertical stability provided by the structure of foot pocket 316 permits ribs 314 to have a smaller horizontal cross sectional dimension for a given vertical dimension for a given material being used. This vertical stability becomes significantly reduced as ribs 314 extend away from foot pocket 316 toward free end 318. Because of this, it is preferred that the cross sectional shape of ribs 314 becomes less vertically oval and more round as ribs 314 extend from foot pocket 316 to free end 318.

FIG. 23 shows a cross-sectional view taken along the line 23—23 in FIG. 21. The cross sectional shape of ribs 314 in FIG. 23 is seen to have a less oval shape than shown in FIG. 22. This is to provide ribs 314 with a larger width to height ratio so that twisting is significantly reduced and buckling is avoided. The rounded upper and lower surfaces of ribs 314 prevent the vertical height above and below the neutral surface, or the height of the major axis relative to bending, from becoming significantly reduced if a small amount of twisting occurs along the length of rib 314. It can be seen that the width of ribs 314 remains significantly constant between FIG. 23 and FIG. 24 while a reduction in height occurs at the same time. This permits ribs 314 to gain increased vertical stability as they extend from foot pocket 316 to free end 318 while also experiencing a decrease in bending resistance that corresponds to the reduced leverage that is exerted upon ribs 314 as ribs 314 extend from foot pocket 316 to free end 318. This same manner of tapering occurs between FIGS. 23 and 24. FIG. 24 shows a cross-sectional view taken along the line 24—24 in FIG. 21. Ribs 314 are seen to be significantly round and have a high degree of stability. Because the ratio of width to height of ribs 314 is significantly increased from foot pocket 316 to free end 318, bending resistance is gradually reduced toward free end 318 so that ribs 314 do not over deflect during a hard kick. This is because the volume of material within ribs 314 remains significantly large toward free end 318 and therefore bending resistance also remains significantly large enough to prevent over deflection during a hard kick. The high level of vertical stability along ribs 314 permit significantly high ranges of elongation and compression to occur within the material of ribs 314 so that the methods of the present invention can be utilized and exploited.

FIG. 25 shows an alternate embodiment of the cross-sectional view shown in FIG. 22, which uses a round load bearing rib 320 on either side of membrane 315. FIG. 26 shows an alternate embodiment of the cross-sectional view shown in FIG. 23, which uses round load bearing ribs 320. FIG. 27 shows an alternate embodiment of the cross-sectional view shown in FIG. 24, which has round load bearing members that are larger than ribs 314 shown in FIG. 23. In this embodiment, ribs 320 taper in both width and height from foot pocket 316 to free end 318. The substantially round shape of ribs 320 provide excellent vertical stability and the significantly large cross sectional volume provides the ability to efficiently store large quantities of energy with a low damping effect due to the distribution of bending stresses to a greater quantity of lengthwise fibers. In this example, the tapering in vertical cross sectional height in ribs 320 is significantly less than that shown by ribs 314 in FIGS. 22 to 24. In FIG. 27, ribs 320 are larger near free end 318 so that the volume of material in ribs 320 is significantly high so that increased bending resistance occurs near free end 318 in comparison to that achieved in FIG. 24. In FIGS. 25 to 27, ribs 320 experience a reduction in volume from foot pocket 316 to free end 318 in an amount effective to permit a substantially even distribution of bending stress across the lengths of ribs 320 from foot pocket 316 to free end 318 in comparison to the loads applied.

Description and Operation—FIGS. 28 to 35

FIG. 28 shows a top view of a swim fin. In FIG. 28, a shoe member 400 is secured to a blade member 402 in any suitable manner. Blade member 402 has a blade free end portion 404 and a blade root portion 406 adjacent shoe member 400. A load-bearing rib member 408 is seen to be secured to blade member 402 adjacent each outer side edge of blade member 402; however, rib member 408 may be secured in any manner to any portion of blade member 402. Each rib member 408 having a rib root portion 410 and a rib free end portion 412. Rib members 408 having a bending zone 414 adjacent root portion 410. A first quarter portion 416 of blade member 402 is seen between a first quarter imaginary line 418 and shoe member 400. A first half portion 420 of blade member 402 is seen between a first half imaginary line 422 and shoe member 400.

The embodiment shown in FIG. 28 uses the same design and operation principles described in the previous embodiments of the present invention described in the above description; however, a significant portion of the flexing is arranged to occur significantly close to shoe member 400. Ribs 408 are seen to have a reduced transverse dimension near root 410. Such reduced transverse dimension reduces the bending resistance of ribs 408 by reducing the sectional modulus of ribs 408 to create bending zone 414 due to an increase in flexibility. Such a reduction in bending resistance is preferably arranged adjacent root portion 410 so that most of the flexing of blade 402 and ribs 408 occurs along first half 420 of blade member 402. The reduction in transverse dimension of ribs 408 may also be arranged to permit the majority of flex zone 414 to occur along first quarter 416 of blade member 402. Flex zone 414 is seen to exist along first quarter 416 of blade member 402; however, flex zone 414 may be of any size, may exist along any desired portion of ribs 408, may occur along any length of ribs 408, and may occur in any degree increased flexibility.

FIG. 29 shows a side view of the same swim fin shown in FIG. 28 while flexing during a kicking stroke. In FIG. 29, the swim fin is being kicked in a direction of kick 424. Flex zone 414 is seen to identify a zone of increased flexibility in ribs 408 located adjacent foot pocket 400 and root 410 of ribs 408. Ribs 408 have a rib attacking surface 426 and a rib lee surface 428. Blade 402 and ribs 408 are seen to be deflected under water pressure created by kick direction 424 to a light kick deflected position 430 from a neutral position 432 shown by broken lines. Light kick deflected position 430 is created when kick direction 424 is kicked with a substantially light kicking force such as used to achieve a slower cruising speed while swimming. A neutral tangent line 424 is shown by a dotted line above neutral position 432. A light kick deflection line 434 is shown by a dotted line above light kick deflected position 430. A curved arrow extending from neutral tangent line 424 to light kick tangent line 436 identifies a predetermined light kick deflection angle 438.

A hard kick deflected position 440 of rib 408 is shown by broken lines below light kick deflected position 430. Hard kick deflected position 430 is created when kick direction 424 occurs with a substantially hard kicking force to achieve a significantly faster swimming speed. A hard kick tangent line 442 is shown by a dotted line above hard kick deflected position 440. An arrow extending between neutral tangent line 434 and hard kick tangent line 442 identifies a predetermined hard kick deflection angle 444.

An imaginary root radius line 446 is displayed by a dotted line extending vertically through the swim fin toward a light kick transverse axis of curvature 448. An imaginary light kick forward position radius line 450 is displayed by a dotted line extending through the swim fin toward light kick axis 448. An imaginary neutral position reference line 452 is shown by a dotted line intersecting forward radius line 450. A light kick neutral surface position 454 is displayed by a dotted line through the middle of rib 408 that extends to the intersection of reference line 452 and forward radius line 450. Light kick neutral surface position 454 displays the position of the neutral surface within rib 408 in which zero elongation and zero compression exists while bending.

A light kick attacking surface elongation zone 456 exists in the region between reference line 452, forward radius line 450, and light kick neutral surface position 454. The size of elongation zone 456 displays that a significantly large amount of material has experienced significant elongation as the swim fin flexes to light kick position 430. A light kick compression zone 458 is exists in the region between reference line 452, forward radius line 450, and light kick neutral surface position 454. The size of compression zone 458 shows that a significant amount of material has become compressed while the swim fin flexes to light kick position 430. A light kick attacking rib surface elongation range 460 is displayed by an arrow that shows the amount of elongation occurring along the attacking surface of rib 408 within flex zone 414 existing between radius lines 446 and 450. A light kick lee surface compression range 462 is displayed by an arrow that shows the amount of elongation occurring along the lee surface of rib 408 within flex zone 414 existing between radius lines 446 and 450.

It is preferred that the material used to make ribs 408 have a Shore a hardness between 40 and 95 durometer. Materials having a Shore A hardness between 75 and 95 durometer would preferably have a very high modulus of elasticity so that the material can experience significant levels of elongation and compression under the relatively light load conditions created during a relatively light kicking stroke used to reach cruising speeds while swimming. Preferably, relatively high memory materials should be used such as Hytrel, Pebax, rubber, polyurethanes, Monprene, thermoplastic rubber, thermoplastic elastomers, or any other suitable high memory material.

An initial neutral surface position 464 existing as rib 408 just begins to bend is shown by a dotted line above position 454. Light kick neutral surface position 464 is seen to be significantly below initial position 454, thereby showing that position of the neutral surface has shifted toward the lee surface of rib 408. As discussed in the preceding descriptions above, this is achieved by setting light kick compression range 462 of the material to experience a sudden increase in resistance to further compression as the swim fin is deflected significantly close to the predetermined light kick deflection angle 438 identified by tangent line 436. A hard kick neutral surface position 466 is shown by a dotted line below position 454. This shows the further shift in the position of the neutral surface within rib 408 as the swim fin is deflected to hard kick deflected position 440 with a predetermined hard kick deflection angle 444. Neutral surface positions 454, 464 and 468 are superimposed upon rib 408 while it is in light kick deflected position 430 for illustrative and simplification purposes so that the relative shift in position can be seen. The shift in the neutral surface from position 464 to 452 creates a sudden increase in bending resistance within rib 408 as it reaches deflected position 430. The further shift in the neutral surface from position 452 to 466 creates a further increase in bending resistance within rib 408 as it reaches hard kick deflected position 440.

The significantly large shift in the neutral bending surface within rib 408 permits a significantly large deflection to occur during a light kicking stoke with only a proportionally small increase in the deflection to occur during a hard kicking stroke. The flex limiting methods of the present invention permit light kick deflection angle 438 to be significantly large while hard kick deflection angle 444 represents a proportionally small increase in deflection in comparison to deflection angle 438. The user is able to maintain highly consistent blade deflections whether the force of the kicking stroke is significantly light or significantly hard.

From the drawings, it can be seen that the focused bending zone 414 existing between radius lines 446 and 450 experiences a majority of the bending occurring in the swim fin. Bending zone 414 has a predetermined length, which can be any desirable length. Deflection angle 438 combines with the length of bending zone 414 to determine the length of radius lines 446 and 450 as well as the location of axis 448. The vertical height of rib 408 determines the size of elongation range 460 and compression range 462 for a given deflection angle. The deflection angles used and the elongation and compression ranges used can be selected from any of the variations described in the above description.

Figure 30:
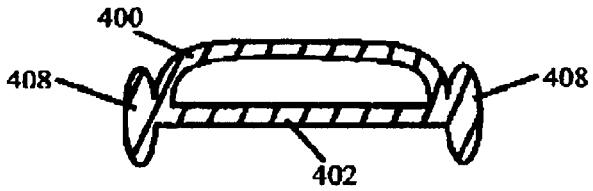
Figure 31:
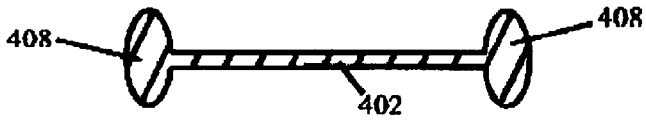
Figure 32:
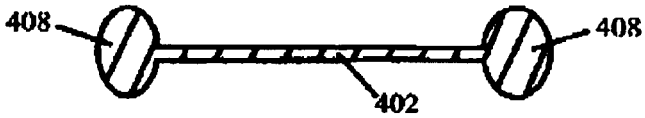

FIGS. 30 to 34 show cross sectional views of the fin shown in FIG. 29 taken along the lines 30—30, 31—31, 32—32, 33—33, and 34—34, respectively. FIG. 30 shows that ribs 408 are significantly narrower in FIG. 30 than in FIG. 31. FIG. 32 shows that ribs 408 are significantly wider along the line 31—31 in FIG. 29 than along the line 30—30 in FIG. 29. Ribs 408 in FIG. 30 are seen to have a reduced transverse dimension compared to that shown in Fib 31. In FIG. 30, the reduced transverse dimension decreases bending resistance by reducing the sectional modulus of ribs 408. This increases the flexibility of ribs 408 to cause focused bending to occur adjacent root 410. Because vertical height of ribs 408 remains significantly large in FIG. 30 compared to FIG. 31, elongation range 460 in FIG. 29 is significantly large. This maximizes the energy stored in elongation and compression for a significant increase in "snap back" at the end of the kicking stroke for a significant increase in performance.

Figure 33:
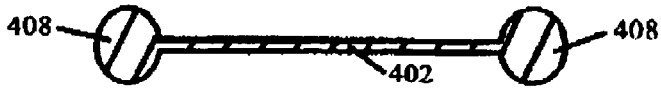
Figure 34:
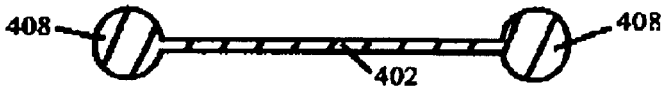

Review of FIGS. 32 to 34 shows that the transverse dimension of ribs 408 remains relatively constant between FIGS. 32 to 34. This permits bending zone 414 to be focused near foot pocket 400.

FIGS. 35*a* and 35*b* show a side perspective view of the swim fin shown in FIGS. 28 and 29 during the inversion portion of a kick cycle. In FIG. 35*a,* the swim fin is in a downstroke position 477 that has a direction of kick 468 showing the fin is in the downstroke phase of the kicking cycle. The swim fin at downstroke position 477 has been moved downward from a kick stroke inversion position 470 displayed by broken lines in which the swim fin is at the inversion portion of a kick cycle where the swim fin changes kick direction from an upstroke to a downstroke. Inversion position 470 displays that the swim fin forms an S-shaped wave 472 at the inversion portion of the kicking stroke cycle. As the kick direction in position 470 is inverted to kick direction 468, the swim fin is seen to form an inverted S-shaped wave 474. While the swim fin forms inverted S-shaped wave 474, arrows show that a free end portion movement 476 is occurring in an upward direction and a root portion movement 478 is occurring in a downward direction.

By showing both inversion portion 470 and downstroke position 477, the viewer is able to see that S-shaped wave 472 and inverted S-shaped wave 474 together form a standing wave. A nodal point 480 in the standing wave occurs at the position along the swim fin in which position 470 and position 477 intersect. The focused hinging at bending zone 414 increases the area of the swim fin that can participate in the forming a standing wave and can increase the efficiency of the standing wave.

FIG. 35*b* shows the same swim fin in FIG. 35*a* in which ribs 408 and blade 402 are made with increased flexibility in order to make the standing wave be more pronounced.

FIG. 36 shows a side view of a prior art swim fin. A blade member 482 is secured to a shoe member 484. Rib members 486 are secured to the side edges of blade member 482. Blade member 482 as an attacking surface 488, a lee surface 490, and a free end portion 492. Blade member 482 is flexible and forms a scoop-like shape along attacking surface 488. This type of prior swim fin attempts to use the scoop-like shape of attacking surface 482 to channel water toward free end 492. The swim fin is being kicked in a downward kick direction 494 and turbulence 496 is seen forming adjacent lee surface 490. Much of the water is seen to spill in an outward sideways around ribs 486 toward the induced drag vortices of turbulence 496 and very little water is actually channeled toward free end 492. Turbulence 496 creates stall conditions which significantly reduce the ability for the swim fin to generate lift. As a result, propulsion is poor and drag is high.

FIG. 37 shows the same prior art swim fin shown in FIG. 36 with the swim fin being kicked toward the viewer. In FIG. 37, the swim fin is being kicked toward the viewer so that attacking surface 488 can be observed. Outward sideways flow conditions 498 are displayed by arrows adjacent attacking surface 488. Outward sideways flow conditions 498 show that much of the water flowing along attacking surface 488 flows in an outward sideways manner rather than toward free end 492. Free end 492 is curved since the flexibility of blade member 482 permits a scoop-like shape to form between ribs 486 during use. The broken line in front of free end 492 is the position of free end 492 when the swim fin is at rest.

FIG. 38 shows cross sectional view taken along the line 38—38 of the prior art fin shown in FIG. 37. In FIG. 38, blade member 482 is arched to form a scoop-like or channel-like contour along attacking surface 488. Outward sideways flow conditions 498 show that water is spilling in an outward manner around ribs 486. Turbulence 496 is above lee surface 490 creates high levels of drag and stall conditions which reduce performance.

FIG. 39 shows a perspective side view of a swim fin of the present invention. In FIG. 39, a shoe member 500 is secured to a blade member 502. Blade member 502 has rib members 504 secured to blade member 502 adjacent the outer side edges of blade member 502. Blade member 502 having an attacking surface 506, a lee surface 508, and a free end portion 510. The swim fin is being kicked in a downward kick direction 512. Blade member 502 is sufficiently flexible to form a scoop-like or channel-like contour along attacking surface 506. An attacking surface flow 514 is displayed by an arrow flowing beneath attacking surface 506. A lee surface flow 516 is displayed by an arrow flowing over lee surface 508. A lee surface flow separation 518 is displayed by curled arrows shows the formation of an eddy-like vortex formation along lee surface 508 during this kicking stroke.

In FIG. 39, ribs 504 are seen to experience a significant amount of bending around a transverse axis near shoe member 500 so that blade member 502 and ribs 504 are oriented at a significantly reduced angle of attack around a transverse axis. The angle of deflection exhibited by blade member 502 and ribs 504 is seen to be significantly large relative to a neutral blade position 524 displayed by broken lines beneath blade member 502 and ribs 504. The methods for achieving this bend and various desirable deflection angles and ranges may be chosen as desired from the above description. Because the angle of attack is significantly reduced, lee surface flow separation is seen to be significantly smaller in size compared to turbulence 496 shown in FIG. 36 for a prior art fin. This permits the swim fin in FIG. 39 to create significantly reduced levels of drag. In FIG. 39, blade member 502 and ribs 504 are seen to be at a significantly reduced angle of attack around a transverse axis in an amount effective to permit lee surface flow separation to be sufficiently small enough to permit lee surface flow 516 to flow in a substantially smooth manner above separation 518 and lee surface 508. In FIG. 39, lee surface flow 516 is seen to curl around rib 504 then over separation 518 and then become reattached to lee surface 508 adjacent free end portion 510. Preferably, this occurs in a sufficiently smooth manner to create a lifting force 520 displayed by an arrow above lee surface 508. Lifting force 520 has a forward component of lift 522, which extends in a horizontal direction and assists in propelling the swimmer forward. Attacking surface flow 514 is seen to flow in a substantially lengthwise manner along attacking surface 506. Because outward sideways flow is reduced, more water flows toward free end 510 for increased propulsion. Preferably, attacking surface flow 514 will have a slight inward directed movement as it flows toward free end 510; however, straight flow toward free end 510 or even a significant reduction in any outward sideways directed flow along attacking surface 506 may be created as well for significant improvements in performance over the prior art.

FIG. 40 shows the same swim fin shown in FIG. 39 as viewed from underneath with the swim fin being kicked toward the viewer. Ribs 504 and blade member 502 are seen to have deflected away from neutral position 524 shown by broken lines in front of free end 510. A flex zone 526 is seen along ribs 504 near foot pocket 500. Ribs 504 are seen to have reduced transverse dimension adjacent flex zone 526 and employs bend controlling methods of the present invention.

FIG. 41 shows cross sectional view taken along the line 41—41 in FIG. 40 while being kicked in kick direction 512 as shown in FIG. 39. In FIG. 41, blade member 502 has flexed to form a longitudinally directed scoop-like or channel-like contour between ribs 504 and along attacking surface 506. Lee surface 508 is seen to have a substantially convex contour, which is preferably curved but may also be faceted. The channel-like contour of attacking surface 506 encourages attacking surface flow 516 to flow toward the center axis of blade 502. The convex shape lee surface 508 permits blade 502 to be oriented at a reduced angle of attack along a lengthwise axis. This reduced angle of attack along a lengthwise axis of lee surface 508 combines with the large scale deflection of ribs 504 and blade 502 to a lengthwise reduced angle of attack around a transverse axis as shown in FIG. 39 to create substantially smooth and attached flow conditions above lee surface 508.

In FIG. 41, attacking surface flow 514 and lee surface flow 516 are shown to move in an inward manner from ribs 504 and are also moving toward the viewer and originate behind line 41—41 in FIG. 40. In FIG. 41, attacking surface flow 514 and lee surface flow 516 are shown as starting behind line 41—41 in FIG. 40 so that their lengthwise and inward directed paths can be observed from the cross sectional view shown in FIG. 41. In FIG. 41, lee surface flow 514 is seen to flow around ribs 514, over lee surface flow separation 518 and become re-attached to lee surface 508 adjacent the center axis of blade member 502. Lee surface flow 516 is seen to flow in a substantially smooth and attached manner above lee surface 508. Adjacent ribs 518, lift vectors 528 are shown by an angled arrow directed in an upward and outward angle. Lift vectors 528 are substantially perpendicular to the direction of lee surface flow 516 at the location shown. Lift vectors 528 have a horizontal component of lift 529 and a vertical component of lift 530. Horizontal component 529 applies an outward transverse force to blade 502 and ribs 504 relative to this view and vertical component 530 applies an upward vertical force to blade 502 and ribs 504 relative to this view. Closer to the central axis of blade 502, lift vectors 531 are displayed by arrows that extend in an upward and outward direction that is substantially perpendicular to lee surface flow 516 at this position above blade member 502. Lift vectors 531 have a horizontal component of lift 532 and a vertical component of lift 533.

When the direction of these vectors are seen from the view shown in FIG. 41 with the knowledge that blade 502 and ribs 504 are inclined at a significant deflection around a transverse axis as shown in FIG. 39, then it can be understood that vertical components of lift 530 and 533 are oriented at a forward inclination relative to the desired direction of movement for the swimmer. In other words, vertical components of lift 530 and 533 shown in FIG. 41 are substantially parallel to the direction of lifting force 520 shown in FIG. 39. Just has lifting force 520 has a related forward component of lift 522 that creates forward propulsion as shown in FIG. 39, in FIG. 41 vertical components of lift 530 and 533 also have forward components to these vectors that are determined by the overall deflection angle of ribs 504 and blade member 502 around a transverse axis as shown in FIG. 39. For this reason, significantly large deflection angles near shoe member 500 as shown in FIG. 39 combined with a substantially convex lee surface contour as shown in FIG. 41 can allow lee surface flow 516 to occur in a sufficiently smooth and attached manner to produce significantly strong lift vectors which have a significant forward directed component. This can significantly increase the propulsive force generated by the swim fin.

The methods of the present invention permit a major improvement over the prior art scoop-type swim fin shown in FIGS. 36 to 38. Lee surface separation 518 in FIGS. 39 to 41 is seen to significantly smaller that turbulence 498 in FIGS. 36 and 38. This permits the fin shown in FIGS. 39 to 41 to exhibit significantly reduced levels of drag. Also, this reduction in turbulence in FIGS. 39 to 41 is seen to occur in an amount effective to permit lee surface flow 516 to flow in a sufficiently smooth and attached manner to create significantly strong lifting forces to increase forward propulsion. As seen in the prior art fin of FIGS. 36 to 38, turbulence 496 is too large to permit significant levels of lift to form. Also, the strong vortices of turbulence 496 in FIGS. 36 to 38 is seen to draw the flow along attacking surface 488 in an outward sideways manner to create significantly strong outward sideways flow conditions 498. In FIGS. 39 to 41, attacking surface flow 514 has significantly reduced levels of outward sideways directed flow. Preferably, the scoop-like contour of attacking surface 506 is sufficiently deep enough to permit attacking surface flow 514 to flow in an inward converging flow direction; however, any depth of may be used. Also, it is preferred that lee surface flow separation 518 is sufficiently reduced enough to avoid drawing significantly large amounts of water around ribs 504 in an outward sideways direction from attacking surface 506 toward lee surface 508.

In FIG. 41, significantly smooth flow above lee surface 508 is achieved with a combination of blade 502 being oriented at a significantly reduced lengthwise angle of attack around a transverse axis as shown in the side view of FIG. 39 while also having a significantly deep scoop-like contour along attacking surface 506 which provides a reduced angle of attack along a transverse direction. In FIG. 41, blade member 502 has flexed away from an unloaded blade orientation 534 to form a longitudinally directed scoop-like or channel-like contour between ribs 504 and along attacking surface 506. The distance between unloaded blade orientation 534 and the actual flexed position of blade 502 during use defines a predetermined depth of scoop 536, which is displayed by a vertical double-ended arrow. A predetermined transverse blade dimension 538 is displayed by a horizontal double-ended arrow, which identifies the overall width of the swim fin taken at the line 41—41 in FIG. 40. It is preferred that predetermined depth of scoop 536 is at least 10% of predetermined transverse dimension 538 while blade 502 is experiencing a deflection 1*f* at least 20 degrees during a relatively light kicking stroke. The resulting improvement in smooth flow conditions can greatly reduce drag and kicking effort while increasing propulsion efficiency. It is preferred that a significantly large portion of the deflection of blade 502 occurs within the first half of the overall length of blade 502. Excellent results occur when a major portion of the blade deflection is arranged to occur within the first quarter of the overall blade length or substantially near shoe member 500. Such a deflection of at least 20 degrees can be measured from a tangent to the lengthwise alignment of ribs 504 or blade 502 at the midpoint of the overall length of blade 502. The deflection can be measured relative to neutral position 524 shown in FIG. 39 existing when the swim fin is at rest. Also, the deflection angle, or the reduced angle of attack around a transverse axis may be measured relative to the direction of intended travel. Excellent results may be achieved with providing blade 502 or ribs 504 with a deflection of at least 30 degrees during a light kicking stroke. It is also preferred that depth of scoop 536 is al least 5% of transverse dimension 538 of blade 502 existing between ribs 504. Preferably, depth of scoop 536 is at least 5% of transverse dimension 538 at the three quarters of the overall length of blade 502 toward free end 510. Excellent results can also occur when depth of scoop 536 is at least 10%, at least 15%, at least 20% or at least 30% of transverse dimension 538 at the midpoint of the overall length of blade 502. Alternatively, depth of scoop 536 may be at least 5%, at least 10%, at least 15%, at least 20%, at least 30%, at least 40%, or at least 50% of transverse dimension 538 in the outermost quarter of the overall length of blade 502 near free end 510 (three quarters of the blade length toward free end 510). With sufficient reduced angle of attack around a transverse axis and sufficient energy storage within the load bearing material, depth of scoop 536 may be reduced, minimized, or even eliminated if desired. Preferably, depth of scoop 536 is arranged to be sufficient to encourage substantially smooth flow conditions to occur above lee surface 508. It is preferred that ribs 504 and blade 502 are arranged to form a substantially unobstructed flow path sufficient to encourage relatively smooth flow conditions to form above lee surface 508. By encouraging smooth flow conditions to occur along an angled flow path that has both lengthwise and transverse flow components can permit lift forces to be efficiently generated while drag forces are and kicking resistance are significantly reduced.

FIG. 42 shows a side view of an alternate embodiment swim fin. The fin can be similar to any of the embodiments described in the above description while the load bearing rib is preferably arranged to provide flexing near the foot pocket that creates non-linear large scale deflections. A shoe member 540 is secured to an elastomeric flexible rib portion 542 and a relatively stiffer rib portion 544 s secured to flexible rib portion 542. A relatively stiffer rib base 546 is seen within flexible rib portion 542 near shoe member 540. The swim fin is seen to have a root portion 548 near shoe member 540 and a free end portion 550 spaced from root portion 548 and shoe member 540. Stiffer rib base 546 is secured to flexible rib portion 542 near root 548 with a series of mechanical bonds 552 shown by dotted lines. Mechanical bonds may be one or more vertical spaces, holes, tubes, recesses, gaps, or orifices within stiff rib base 546 into which the material of flexible rib portion 542 may flow during fabrication to form a mechanical bond. Any suitable mechanical bond and, or chemical bond may be used to connect shoe member 540 to flexible rib 542.

Stiffer rib portion 544 may be secured to flexible rib portion 542 with mechanical and, or chemical bonds in any desirable manner. In FIG. 42, stiffer rib portion 544 is secured to flexible rib 542 with a series of mechanical bonds 554 shown by dotted lines. Bonds 554 may be one or more vertical spaces, holes, tubes, recesses, gaps, or orifices within stiffer rib portion 544 into which, the material used to make flexible rib portion 542 flows during fabrication in order to enhance the strength of the connection. However, any desirable mechanical and, or chemical bond may be used.

The swim fin is being kicked upward with a direction of kick 556 and ribs 542 and 544 are seen to be deflected from a neutral position 558, shown by broken lines, to a deflected position 560. A deflected position tangent line 562 is shown by a dotted line above deflected position 560 and a neutral position tangent line 564 is shown by a dotted line above neutral position 558. A focused bending zone 566 is seen to exist along a predetermined length of flexible rib portion 542 between stiffer rib base 546 and stiffer rib portion 544. A predetermined deflection angle 568 is displayed by an arrow extending between neutral tangent line 564 and deflected tangent line 562. Deflection angle 568 may be arranged to be at any of the angles or ranges of angles described in the above description. The bend in focused bending zone 566 is determined largely by the predetermined length of bending zone 566 as well as the predetermined degree of blade deflection created by deflection angle 568. It is preferred that flexible rib portion 542 is sufficiently more flexible than stiffer rib portion 544 so that a major portion of the bending along the swim fin occurs near root 548. A root radius line 570 is displayed by a dotted line intersecting rib portion 542 near root 548 and extending below flexible rib portion 542. A forward radius line 572 is displayed by a dotted line intersecting flexible rib portion 542 near the forward portion of flex zone 566. Radius lines 570 and 572 have a predetermined radius length that is significantly determined by the predetermined length of bending zone 566 as well as the predetermined degree of blade deflection created by deflection angle 568. Radius lines 570 and 572 show that flexible rib portion 542 is flexing around a transverse axis.

A vertical reference line 574 is shown by a dotted line intersecting radius 572 and a deflected neutral surface position 576, also shown by a dotted line. Flexible rib portion 542 has a rib attacking surface 578 and a rib lee surface 580. An elongation range 582 existing along rib attacking surface 578 within flex zone 566 is displayed by an arrow above rib attacking surface 578. An arrow below lee surface 580 displays a compression range 584 that exists along rib lee surface 580 within flex zone 566. As described in the above description, the predetermined length of radius lines 570 and 572 are determined by predetermined deflection angle 568 and the predetermined length of flex zone 566. In turn, the predetermined length of radius lines 570 and 572 combine with the predetermined vertical dimension of rib 542 to determine the degree of elongation range 582 occurring within rib attacking surface 578 and the degree of compression range 584 occurring within rib lee surface 580. Any degree or range of elongation and, or compression described in the above description may be used in this embodiment. It is preferred that deflected neutral surface position 576 is shifted toward rib lee surface 580 during a harder kicking stroke in an amount effective to create a proportionally large increase in elongation range 582 if deflection angle 568 is exceeded. Preferably, this will be arranged to occur in an amount effective to permit deflection angle 568 to be significantly consistent during light, medium, and hard kicking strokes.

Also, in alternate embodiments, the upper portion of foot pocket 540 would be preferably made with the same relatively flexible material as flexible rib portion 560. This allows flexible rib portion 560 to be obtained by injection of the upper portion of foot pocket 540 during the same step in the injection molding process. In this case, any portions of the swim fin that are relatively stiffer than the flexible material used in foot pocket 540 and flexible rib portion 560 would be preferably made in a single step and then foot pocket 540 and flexible rib portion 560 would be molded onto the more rigid material during a second injection step and the flexible material would preferably be bonded to the more rigid material with thermal-chemical adhesion. In alternate embodiments, relatively stiffer rib 544 and, or stiffer rib base 546 could have at least one edge-to-edge chemical bond with flexible rib portion 560 instead relatively stiffer rib 544 and stiffer rib base 546 existing within relatively flexible rib 560. Also, stiffer rib base 546 and stiffer rib 544 could be connected to each other in any suitable manner which allows rib base 546 and rib 544 to be injection molded in the same step so that production time and costs can be produced. Preferably, stiffer rib base 546 and stiffer rib portion 544 are made with a thermoplastic material and a more flexible thermoplastic material is used to make foot pocket 540 and flexible rib portion 560, which is bonded to stiffer rib base 546 and stiffer rib portion 544.

FIG. 43*a* shows a cross section taken along the line 43—43 in FIG. 42. The cross-sectional view of flexible rib portion 560 in FIG. 43*a* shows that rib attacking surface 578 and rib lee surface 580 have a relatively rounded shape that is relatively broad in widthwise dimension and preferably characterized by having a "full radius". Curved rib side portions 586 are seen to have a relatively convex curved contour. Side portion 586 is preferred to be slightly curved.

The cross-section of rib 542 is preferred to have a substantially oval shape defmed by a relatively rounded convex contour adjacent rib attacking surface 578 and rib lee surface 580 together with side portions 586 having a relatively curved, slightly curved, straight, or substantially straight vertical contour.

FIG. 43*b* shows an alternate embodiment of the cross section shown in FIG. 43*a*. Relatively straight rib side portions are seen along the side of rib 560. The portions of rib 560 adjacent to rib attacking surface 578 and rib lee surface 580 are seen to be relatively wide and rounded, preferably with a full radius of curvature. Alternatively, any desired cross sectional shape may be used as well. Examples of such alternative cross sectional shapes may include rectangular, triangular, diamond-shaped, I-beamed, U-shaped, V-shaped, H-shaped, corrugated, ridged, hollow, semi-hollow, vented, or any other desired shape.

Figure 44:
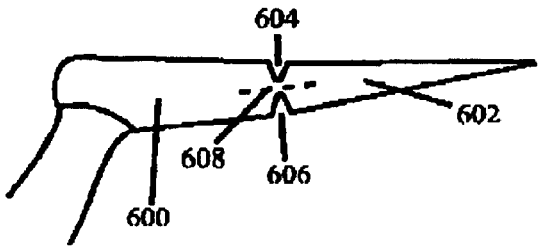
Fig 44 PRIOR ART
Figure 45:
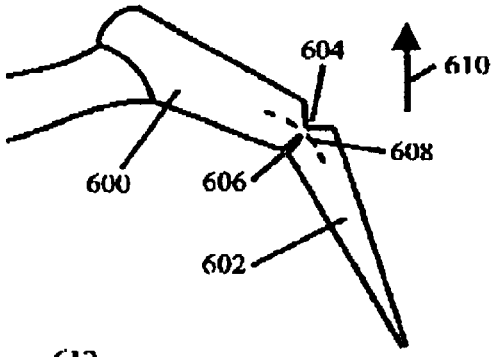
Fig 45 PRIOR ART

Description and Operation—FIGS. 44 to 45

Figure 46:
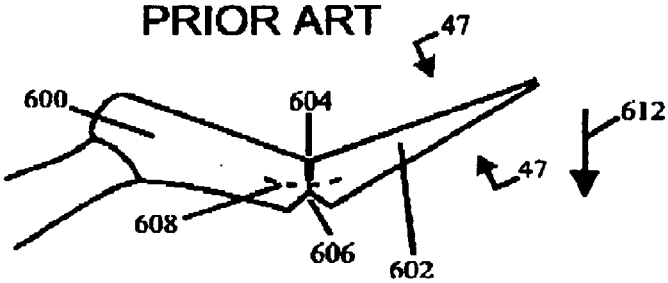
Fig 46 PRIOR ART
Figure 47:
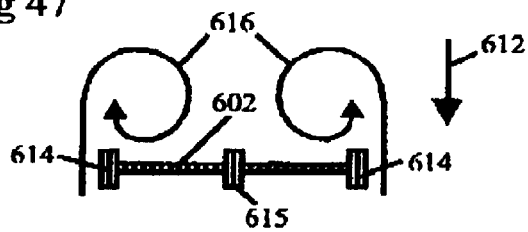
Fig 47 PRIOR ART

FIG. 44 shows a side view of a prior art swim fin shown in U.S. Pat. No. 3,082,442 to Cousteau et al (1963). The swim fin is seen to have a foot pocket 600, a blade 602, a lower surface notch 604, an upper surface notch 606, and fabric strip 608 within the blade in between notches 604 and 606. FIG. 45 shows the same swim during use and having an upward kick direction 610. Blade 602 is seen to have pivoted downward under the influence of kick direction 610. Notch 606 is seen to have pivoted shut to prevent blade 602 from pivoting further. Cousteau et al describes that the closing of notch 602 in this manner allows the sidewalls of notch 604 to come into contact with each other and act as stops to limit the maximum deflection of the blade. FIG. 46 shows the same swim fin during use and having a downward kick direction 612. Blade 602 is seen to have pivoted upward and notch 604 has pivoted shut so that the sidewalls of notch 604 contact each other to act as stops to limit the maximum deflection of the blade. FIG. 47 shows a cross sectional view taken along the line 47—47 in FIG. 46 during downward kick direction 612. FIG. 47 shows that blade 602 has outer side ribs 614 and a central rib 615. In FIG. 47, blade 602 is seen to retain a flat orientation during use and induced drag vortices are seen to form above the lee surface of blade 602 during use.

FIG. 48 shows a side view of swimmer using a pair of prior art swim fins as disclosed in U.S. Pat. No. 4,775,343 to Lamont (1988). In between a foot pocket 618 and a blade 620 there are a series of lower surface notches 622 and a series of upper surface notches 624. The upper swim fin is experiencing an upstroke kick direction 626 and the lower swim fin is experiencing a downstroke kick direction 628. Lamont describes that notches 622 close during down stroke 628, which is describes as "the power stroke", so that the side walls of notches 624 come into contact with each other and act as stops to limit the maximum deflection of blade 620. Similarly, notches 622 are intended to close during up stroke 626. FIG. 49 shows a cross sectional view taken along the line 49–49 in FIG. 48. In FIG. 49, blade 620 is seen to have outer side ribs 630 and central ribs 632. Blade 620 is seen to maintain a flat orientation during use and induced drag vortices 634 are seen to form above the lee surface of blade 602. The fin shown in FIGS. 48 and 49 was brought to market as the "Gorilla" fin and the "SeaWing" by one of the world's largest scuba manufacturers, which later took these fins off the market a few years ago by the manufacturer due to only moderate performance and relatively low sales volume. While the Gorilla fin had relatively rounded notches in which the side walls of the notches did not contact each other to act as stops and was also made of Pebax, one of the highest memory thermoplastics known, the blade was not arranged to deflect to a sufficiently reduced angle of attack during a light kicking stroke, energy storage within the fin material was not maximized, turbulence and drag was high, and no process or method was known or utilized for achieving a dramatic improvement in performance. The fact that the fin did not do well on the market, received only moderate performance evaluations from independent testing facilities, and was later abandoned and withdrawn from the market shows that an essential method or process for achieving a dramatic improvement in performance was unknown and unobvious to the design engineers for one of the world's largest and most prestigious diving equipment manufacturers.

Figure 50:
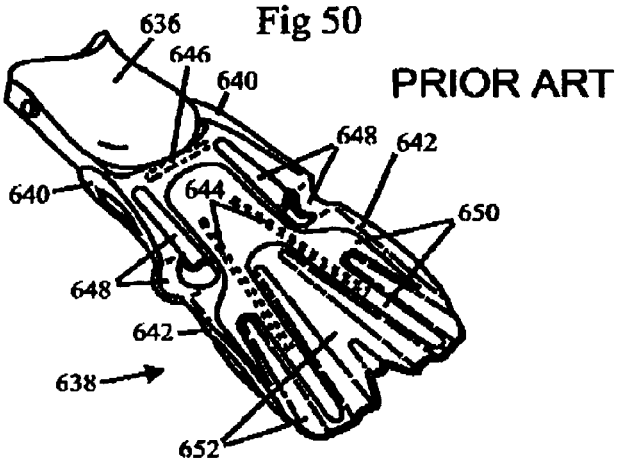
Figure 51:
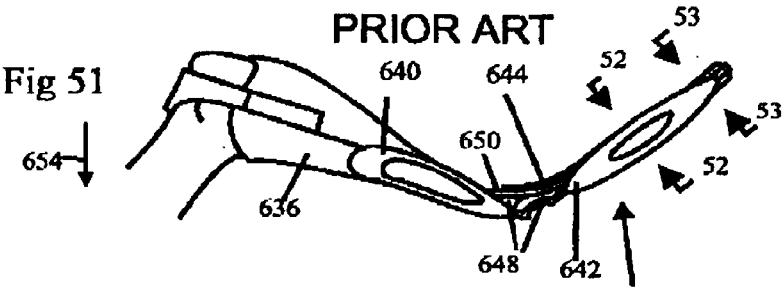
Figure 52:
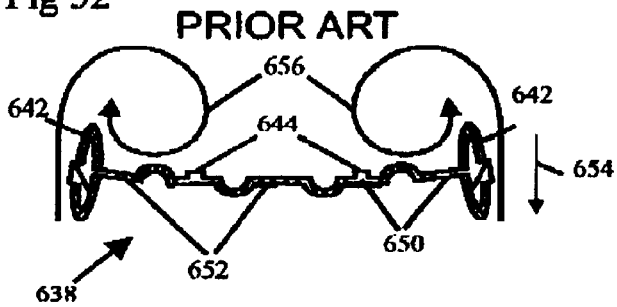
Figure 53:
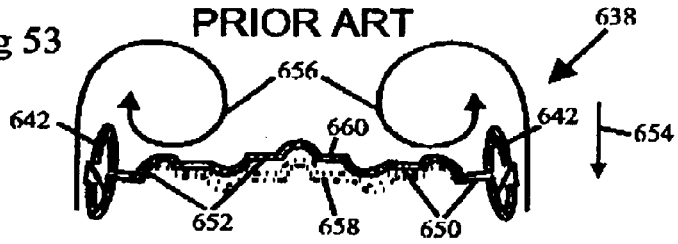

FIG. 50 shows a prior art swim fin called the Volo, which includes features disclosed in U.S. Pat. No. 6,126,503 to Viale et al (2000). The fin has a foot pocket 636, a blade 638, root portion side ribs 640, outer side ribs 642, central ribs 644, a hinge 646, flexible members 648, a rigid blade portion 650, and a flexible blade portion 652. FIG. 51 shows a side view of the same prior art swim fin shown in FIG. 50 while experiencing a downstroke kick direction 654. Flexible members 648 act as a stopping device to prevent further deflection of blade 638 by expanding from a loose condition to an expanded condition. FIG. 52 shows a cross sectional view taken along the line 52—52 in FIG. 51, which is taken at a position along the length of blade 683 that is about three quarters out along the length of the blade toward the tip of blade 683 while the swim fin is being kicked in direction 654. In FIG. 52, blade 638 is seen to have a relatively flat orientation between ribs 642 during use at this position. The structure of blade 638 is not arranged to bow significantly under during use and induced drag vortices 656 form above the lee surface of blade 638 as water spills around the sides of blade 638. FIG. 53 shows a cross sectional view taken along the line 53—53 in FIG. 51 near the extreme tip of blade 638. In FIG. 53, blade 638 is seen to have flexed from a neutral position 658 to a flexed position 660. The difference between neutral position 658 and flexed position 660 is very small and the transverse orientation of blade 638 between ribs 642 remains significantly flat and induced drag vortices 656 are formed. The arrangement of ribs 644, ribs 642, rigid blade portion 650 and flexible blade portion 652 are arranged in a manner which causes blade 638 to experience only minimal flexing along a transverse direction near the extreme outer tip of the swim fin while the majority of blade 638 remains significantly flat along a transverse direction under the exertion of water pressure. No methods are used to reduce turbulence and establish smooth flow in a significantly transverse direction.

FIG. 54 shows a side view of an alternate embodiment swim fin using the methods of the present invention. The swim fin has a foot pocket 662 and a blade 664. Blade 664 is in a neutral blade position 665, which exists when the swim fin is at rest. Blade 664 has an upper surface 666, a lower surface 668, a root portion 670, a free end 672, an upper cutout 674, and a lower cutout 676. A dotted line below the sole of foot pocket 662 is a sole alignment line 678. A dotted line above upper surface 666 is a neutral position tangent line 680 that shows the alignment of blade 664 while at rest. Sole alignment line 678 and tangent line 680 are seen to be at an angle to each other while the fin is at rest. This angle is preferably between 10 and 30 degrees; however, any desired angle could be used, including a zero angle. As the swim fin experiences a kick direction 681 during a light kicking stroke, blade 664 experiences a light kick deflection 682 to a light kick deflected position 684 displayed by broken lines. A light kick tangent line 686 shows the lengthwise alignment, or angle of attack of blade 664. During a hard kick, blade 664 experiences a hard kick deflection 688 to a hard kick deflected position 690 having a reduced angle of attack displayed by a hard kick tangent line 692.

FIGS. 55 and 56 show a close up side view of the swim fin shown in FIG. 54, which illustrates the processes used in combination with the reduced thickness provided by notches 674 and 676. FIG. 55 shows blade 664 pivoting relative to notches 674 and 676 during a light kicking stroke. Notches 674 and 676 form a flexible region 700. Flexible region 700 has an elongation surface region 704 and a compression surface region 706. A neutral position radius line 708 is displayed by a dotted line that is perpendicular to neutral position tangent line 680. A light kick deflection radius line 710 is displayed by a dotted line that is perpendicular to light kick tangent line 686. A neutral position vertical reference line 712 is displayed by a broken line that is parallel to neutral position radius line 700 and also intersects radius line 710. At the intersection of radius 710 and reference line 712 is a light kick neutral surface position 714 displayed by a broken line. Neutral surface position 714 is a location of zero elongation and zero compression within flexible region 700. An elongation range 716 is displayed by an arrow above elongation surface 704. An elongation range 717. A compression range 718 is displayed by an arrow below compression surface 706.

FIG. 56 shows the same close up side view shown in FIG. 55 while blade 664 is experiencing hard kick deflection 688 and has reached hard kick deflected position 690 having a reduced lengthwise angle of attack displayed by hard kick deflection line 692. A hard kick radius line 720 is shown by a dotted line that is perpendicular to tangent line 692. A hard kick compression range 722 is displayed by an arrow below compression surface 706. Because the load bearing material within flexible region 700 has been arranged to have a predetermined compression range limit and because the geometry of flexible region 700 has preferably been arranged to cause such a predetermined compression range limit to be used up during a light to moderate kick, the material along compression surface 706 is unable to experience any significant amount of further compression under the increased load of a hard kicking stroke. As a result, hard kick compression range 722 is substantially similar to light kick compression range 712. This causes neutral position vertical reference line 712 to intersect hard kick radius line 720 at a location within flexible zone 700 that is significantly close to compression surface 706. Since the neutral surface must pass through this same point of intersection, a hard kick neutral surface position 724 is also seen to be significantly close to compression surface 706. Hard kick neutral surface position 724 is seen to be significantly closer to compression surface 706 than light kick neutral surface position 714 shown in FIG. 55. In FIG. 56, the downward shift in the neutral surface to hard kick neutral surface position 724 causes elongation surface 704 to experience a hard kick elongation range 726. A hard kick elongation zone 728 is displayed by a triangular shaped area below hard kick elongation range 726. Hard kick elongation range 726 and hard kick elongation zone 728 show the quantity of total elongation that is distributed within the load bearing material in flexible zone 700 in between radius lines 708 and 720. Hard kick elongation range 726 and hard kick elongation zone 728 are both significantly larger than light kick elongation range 716 and light kick elongation range 717 shown in FIG. 55.

While FIG. 55 shows that there is a proportionately large increase in elongation during a hard kick, FIG. 54 shows that there is proportionately small difference between light kick deflection 682 and hard kick deflection 688. This shows that the methods of the present invention can allow a swim fin to achieve large scale blade deflections to a predetermined significantly reduced angle of attack during a light kicking stroke to provide increase propulsion efficiency while also allowing the blade to significantly maintain such an efficient reduced angle of attack during a hard kick without having the blade over deflect under increased load to an excessively reduced angle of attack that is no longer capable of generating efficient propulsion. At the same time, the methods of the present invention allow potential energy to be stored within significantly elongated high memory material for increase snap back or returned kinetic energy at the end of the inversion portion of a kicking stroke. The faster the recovery at the inversion portion of the kicking stroke, the greater the efficiency due to reduced lost motion and maximized amount of propulsion delivery. Because the methods of the present invention permit significantly consistent predetermined large scale deflections to occur for increased efficiency during use while also Exponentially increasing elongation for only a proportionately small increase in deflection, increased energy is stored within the load bearing material in elongation zone 728, which is released in a high kinetic energy snap-back at the inversion portion of the kicking stroke. This allows the blade to snap-back quicker and with more return energy during hard kicking strokes, while at the same time the range of motion of the blade is limited by the exponential increase in bending resistance created by the shift of the neutral surface toward compression surface 706. This allows substantially consistent large scale blade deflections to occur while maximizing the storage and release of energy for maximizing snap-back to greatly improve efficiency and propulsion.

The shape of notches 764 and 676 shown in FIGS. 54 to 56 may be varied in any desirable manner. For instance, they may be U-shaped, V-shaped, rectangular, rounded, cornered, tapered, hollowed, elongated, deep, shallow, wide, narrow, ribbed, serrated, corrugated, undulated, or any other shape or configuration. A series of notches along the length of the blade may also be used to create a plurality of pivotal sections or areas of increased flexibility. The longitudinal dimension of flexible region 700 may be any desired length. The shorter the longitudinal length, the smaller the radius of curvature of the resultant bend which allows blade 664 to reach a significantly large scale deflection to significantly reduced angles of attack during light or hard kicking strokes. The shorter the radius of curvature occurring along flexible region 700, the greater the degree of elongation. As a result, a decrease in the longitudinal dimension of flexible region 700 can allow the vertical dimension of region 700 to be reduced without significantly changing the characteristics of the load bearing material. If the longitudinal dimension is reduced and the vertical dimension remains constant, then the load bearing material must be modified to have an increased modulus of elasticity in order to reach the desired blade deflections. Similarly, if the longitudinal dimension of flexible region 700 is increased, the radius of curvature shall increase along with a resultant reduction in elongation and therefore, either the modulus of elasticity of the material should be reduced to increase bending resistance or the vertical dimension should be increased in order create an increase in elongation. Using a series of notches along the length of blade 664 which have a relatively short longitudinal dimension is treated similarly to having a single notch, which has a relatively long longitudinal dimension. The elastic modulus can be modified by using a modified load bearing material having a variation in stress to strain curves, or by changing the durometer or hardness of an elastic material that has a relatively high modulus of elasticity. The greater the memory of the material, the greater the ability for the material to store and then release energy in the form a snapping motion during the inversion portion of a kicking cycle. For high durometer materials, light kick compression range 718 can be at least 1% while light kick elongation range 716 can be at least 3%. When materials are used that have a significantly high modulus of elasticity, light kick elongation range 716 can be at least 5% and hard kick elongation range 726 shown in FIG. 56 can be at least 5%. It is preferred that hard kick elongation range be at least 10% when increased snap back is desired. By increasing light kick elongation range 716 in FIG. 55 or hard kick elongation range 726 in FIG. 56, energy storage and return can be greatly increased while using a high memory material having a high modulus of elasticity within the load bearing portion of flexible region 700. Elongation ranges 716 or 726 can be arranged to be at least 7%, at least 10%, at least 20%, at least 30%, and at least 40% to produce excellent results. Excellent results can also occur when hard kick elongation range 726 in FIG. 56 is arranged be at least 50% or higher, or even substantially near 100% or higher.

In FIGS. 54 to 56, it is preferred that light kick deflection 682 is at least 20 degrees and hard kick deflection 688 is at least 20 degrees. Fore excellent results, deflections 682 and 688 may also be arranged to be at least 20 degrees and at least 30 degrees, at least 25 degrees and at least 30 degrees, at least 30 degrees and at least 30 degrees, at least 30 degrees and at least 40 degrees, at least 20 degrees and less than 50 degrees, at least 20 degrees and less than 40 degrees, at least 20 degrees and less than 30 degrees, at least 30 degrees and less than 50 degrees, and at least 30 degrees and not substantially greater than 50 degrees, respectively. To increase the blade deflection angle, the vertical thickness of flexible region 700 may be reduced, the longitudinal dimension of flexible region 70 may be increased, the durometer of the load bearing material may be reduced, the modulus of elasticity of the load bearing material within flexible portion 700 may be increased, or the flexibility of blade 664 in front of flexible region 700 may be increased. Any combination of these can occur. To reduce the deflection angle of blade 664, the opposite may be done. Also, elongation ranges and degree of exponential increase in bending resistance can be increased by increasing the modulus of elasticity of the load bearing material within flexible region 700, which can increase deflection angles, while also taking structural steps to reduce deflection angles. Such structural steps include reducing the longitudinal dimension of flexible zone 700,), increasing the vertical dimension of flexible zone 700, or increasing the transverse dimension of flexible zone 700, or any combination thereof. To permit relatively stiffer high memory materials to be used within flexible zone 700, which have a higher Shore hardness durometer and, or a reduced elastic modulus (stress to strain curve), the vertical dimension of flexible zone 700 may be reduced, the longitudinal dimension of flexible zone 700 may be increased, additional flexible regions such as region 700 may be added along the length of blade 664, or the transverse dimension of flexible region 700 may be reduced, or any combination of these adjustments thereof. Adding additional flexible regions along the length of blade 664 that are similar to region 700 has a similar effect to increasing longitudinal dimension of a single flexible region such as region 700. By using multiple flexible regions such as region 700 along a predetermined length of blade 664, the longitudinal dimension of each flexible zone may remain relatively small so that the bending radius is relatively small within each flexible zone and therefore elongation and memory storage is maximized. This can allow a smaller vertical dimension to be used within each flexible zone and the overall weight of the swim fin can be reduced.

Blade 664 may be arranged to be relatively rigid or may be arranged to be made sufficiently flexible to permit an S-shaped wave to be generated along the length of blade 664 during the inversion phase of a kicking stroke cycle. Preferably, blade 664 is sufficiently flexible to generate such an S-shaped wave such as shown in FIGS. 11, 13, and 35 since this can greatly increase efficiency and top end propulsion speed. Flexible portion 700 shown in FIGS. 54 to 56 can be arranged to be sufficiently flexible to significantly increase the amplitude of such an S-shaped wave by establishing a pivotal node near foot pocket 662. In alternate embodiments, at least one additional flexible zone may be added along the length of blade 664 to create at least one other pivotal node a predetermined distance from foot pocket 662 that is farther out on blade 664 in order to further increase the efficiency of creating and S-shaped wave or an equivalent or similar pattern of two opposing oscillation phases occurring simultaneously during the inversion phase of a kicking stroke. In alternate embodiments, any desired method of creating regions of increased flexibility at any position or positions along the length of a swim fin blade may be used as well. This would include the use of more flexible materials.

Although a cross-sectional view is not shown for the embodiment in FIGS. 54 to 56, any desired cross sectional shape can be used. In addition, any of the cross sectional shapes and configurations shown or described in the preceding description or drawings may be used in combination with the embodiments shown if FIGS. 54 to 56. For example, blade 664 shown in FIGS. 54 to 56 could the side view of a load bearing rib or the side view of a relatively planar blade. In the case of blade 664 being a load bearing rib, a plurality of ribs could exist with a relatively thinner blade in between such ribs. The thinner blade could be free of any notches or could have notches as well. Any ribs could be the only portion that has notches and such notches could extend close to the level of the blade, extend all the way to the surfaces of the blade, or could extend below the surfaces of the blade. The notches could also be spaces between a series of longitudinal ribs existing along the length of the blade. When scoop-like configurations are used such as shown in FIGS. 39 to 41, it is preferred that flexible region 700 shown in FIGS. 54 to 56 store high levels of energy in the form of elongation and, or compression as well as exhibit exponential increases in bending resistance to act as a stopping device before 676 or 674 can become closed during use. However, in alternate embodiments using notches to create flexible zone 700 or similar flexible zones within the first half of the blade to create a blade deflection of at least 20 degrees during a relatively light kicking stroke, while also combining a scoop-like cross sectional shape such as shown in FIG. 41 having a depth of scoop 536 that is at least 10% of transverse blade dimension 538 at the three quarter blade position near free end 510 during use, the energy storage and exponential increase in bending resistance can be neglected and excellent results can still occur. Also, when using such a blade deflection of at least 20 degrees starting near the root portion and also using a depth of scoop 536 shown in FIG. 41 that is at least 10% of transverse blade dimension 538 at the three quarter blade position near free end 510 during use, the notches can be arranged to close to provide a stopping device and superior performance over the prior art is achieved due to reduced induced drag vortex formation, improved smooth flow over the lee surface of the blade, reduced spilling of water around the sides of the blade, and increased lift from the achievement of better attached flow conditions. In other alternate embodiments which include a blade that pivots to a reduced angle of attack of at least 15 degrees around a transverse axis located within the first half of the blade and preferably near the foot pocket while also and also using a depth of scoop 536 shown in FIG. 41 that is at least 10% of transverse blade dimension 538 at the three quarter blade position near free end 510 during use, any suitable pivotal connection may be used along with any suitable stopping device. Results with these configurations can be further improved by providing a reduced angle of attack of at least 20 degrees or even 30 degrees while such a depth of scoop is at least 10% at the three quarter blade position. Greater depths of scoop including at least 15%, at least 20%, at least 30% can also improve performance. The greater the portion of the overall blade length having a depth of scoop that is at least 5% or greater of the transverse blade dimension, the greater the resulting performance.

Summary, Ramifications and Scope

Accordingly, the reader will see that the methods of the present invention can permit significantly extensible materials to be used as load bearing structures to create significantly consistent large-scale blade deflections as well as to create a standing wave along the length of the hydrofoil blade that occurs in harmonic resonance with the natural resonant frequency of the blade and the oscillating frequency of the reciprocation propulsive strokes. The methods of the present invention permit both slow cruising speeds and high speeds to be achieved with high efficiency. The methods of the present invention permit the natural resonant frequency of the hydrofoil blade to be tailored to resonate on the input frequency of the reciprocating propulsive strokes so that the free end portion of the hydrofoil blade experiences amplified oscillation for increased efficiency and propulsion. The methods of the present invention also allow focused bending zones to be formed that increase energy storage and release in the form of an increased snap back motion at the inversion phase of a reciprocating stroke cycle.

Although the description above contains many specificities, these should not be construed as limiting the scope of the invention but as merely providing illustrations of some of the presently preferred embodiments of the invention. For example, although the methods of the present invention were described in the above description for use in swim fins, these same methods can be used in any type of hydrofoil device to create improved performance and efficiency. Many variations on the structures and methods of the present invention may be used without departing from the spirit of the present invention. For example, the cross-sectional shape of the elongated load bearing members does not have to be rounded. Instead, the cross-sectional shape or the overall shape can be multi-faceted, rectangular, hollow, semi-hollow, diamond shaped, ribbed, knobbed, chamfered, beveled, convoluted, corrugated, grooved, notched, prolate, rhomboid, turbinate, vermiculate, volute, split, recessed, or any desired cross-sectional shape or overall shape that can be arranged to create the desired results. Also, any desirable blade features may be added or subtracted without detracting from the spirit of the present invention. Embodiments and variations can be combined in any desirable manner. Any desirable material or combinations of materials may be used such as thermoplastics, elastomeric thermoplastics, polyurethanes, rubbers, elastomers, composite materials, room temperature elastomers, vulcanized elastomers, metals, fabrics, woven materials, carbon materials, laminated materials, or any other suitable material. Preferably, materials will have significantly high recovery and memory for enhanced performance. In embodiments using a scoop-like cross section, the scoop-like shape can be permanently molded into the shape of the blade so that the desired flow conditions resulting from a significantly reduced angle of attack around a lengthwise axis in combination with the scoop shape are arranged to work efficiently on at least one stroke phase of a reciprocation propulsion stroke. Alternatively, very deep scoops having a depth of scoop that is at least 20% of the transverse blade dimension can be permanently molded on either one or both surfaces of the blade. This can be achieved with very tall side rails that rise above one surface or both surfaces of the blade to a height above a given surface that is at least 20% of the width of the blade at a given portion of the blade. Taller heights can be used as well to create permanent depths of scoops that are at least 30% of the blade width while simultaneously providing a lengthwise reduced angle of attach of at least 20 degrees. Such permanent scoop-like shapes can have curved, rounded, cornered, faceted, or angled configuration, or any other desired configuration.

Also, any of the embodiments of the present invention that are shown in the drawings or described in the description may have a transverse configuration, orientation or shape that is relatively flat, curved, rounded, cornered, channeled, scooped, ribbed, ridged, corrugated, thin, thick, vented, hollowed, holed, grooved, split, tapered, angled, chamfered, or any other desired configuration. The above drawing figures and description regarding the present invention share many of the same methods and operation principles. All such methods, operation principles, characteristics, arrangements, variations and alternate embodiments of the above description may be used in any manner or combination and are hereby incorporated by reference for use in any embodiment. Any of the embodiments can be made with a foot pocket that has a soft thermoplastic material along its upper portion and a stiffer thermoplastic material along its lower portion (or vice versa) and any of the stiffer parts of the blade or ribs may be made with the same stiffer material used to make the lower portion of the foot pocket and any of the more flexible portions of the blade or ribs may be made with the same more flexible thermoplastic material as the upper portion of the foot pocket during the same phase of injection molding that the upper portion of the foot pocket is made, and the more flexible thermoplastic blade and, or rib portions can be secured to the less flexible blade and, or rib portions with a thermal-chemical bond. Any other suitable method of manufacture may be used as well.

For use on reciprocating propulsion hydrofoils on marine vessels, less extensible materials or even inextensible materials may be chosen to provide desired resonant frequencies and performance parameters. On such vessels, any material or hydrofoil configuration may be used as long as the primary methods of matching hydrofoil resonant frequency to the oscillating frequency of the reciprocating propulsion motion in an amount effective to create a standing wave and constructive wave addition through harmonic resonance.

Thus, the scope of the invention should be determined by the appended claims and their legal equivalents, rather than by the examples given.

I claim:

1. A method for improving a swim fin, comprising:

(a) providing a foot attachment member;

(b) providing an active portion connected to said foot attachment member and forming a substantially forward extension of said foot attachment member, said active portion having a root portion adjacent to said foot attachment member and a blade free end portion remote from said root portion and said foot attachment member, said active portion having a predetermined longitudinal dimension between said root portion and said blade free end portion, said active portion having a longitudinal midpoint between said root portion and said free end portion, said active portion having a first half portion between said root portion and said midpoint, said active portion having a three quarter position that is located midway between said midpoint and said free end portion;

(c) providing a hinging region disposed within said first half of said active portion, said hinging region being a region of increased flexibility within said swim fin, said active portion having a pivoting blade portion forward of said hinging region, said hinging region being arranged to permit said pivoting blade portion to pivot around a transverse axis to a deflection of at least 10 degrees from a neutral position to a deflected position under a relatively light load condition such as created during a relatively light kicking stroke used to achieve a relatively slow swimming speed, said hinging region having a tension surface portion capable of experiencing an elongation range of at least 3% during said deflection, said tension surface portion being made with an elastic material capable of permitting said tension surface to experience an elastic recovery from said elongation range at the end of a kicking stroke, said elastic recovery being sufficient to snap said pivoting blade portion back from said deflected position toward said neutral position at the end of a kicking stroke; and (d) providing said active portion with sufficient transverse flexibility to bow between said outer side edges from an unbowed position at rest to a bowed position during use to form a bowed three quarter position concave scooped channel along said attacking surface at said three quarter position, said bowed three quarter position concave scooped channel having a predetermined three quarter position depth of scoop between said unbowed position and said bowed position that is at least 5% of said predetermined transverse dimension at said three quarter position, said active portion having sufficient longitudinal flexibility along said predetermined longitudinal dimension to permit said active portion to form a substantially S-shaped wave alone said predetermined longitudinal dimension during an inversion phase of a reciprocating kick stroke cycle.

2. The method of claim 1 wherein said hinging region is a region of reduced cross section.

3. The method of claim 1 wherein said hinging region is a region of reduced transverse dimension.

4. The method of claim 1 wherein said hinging region is a region of reduced vertical thickness.

5. The method of claim 1 wherein said deflection is not less than 15 degrees.

6. The method of claim 1 wherein said deflection is not less than 20 degrees.

7. The method of claim 1 wherein said deflection is not less than 30 degrees.

8. The method of claim 1 wherein said deflection is not less than 20 degrees and not substantially greater than 50 degrees.

9. The method of claim 1 wherein said deflection is not less than 30 degrees and not substantially greater than 50 degrees.

10. The method of claim 1 wherein said elongation range is not less than 5% during said deflection.

11. The method of claim 1 wherein said elongation range is not less than 7% during said deflection.

12. The method of claim 1 wherein said elongation range is not less than 10% during said deflection.

13. The method of claim 1 wherein said elongation range is not less than 15% during said deflection.

14. The method of claim 1 wherein said elongation range is not less than 5% during under a relatively high load condition such as created during a relatively hard kicking stroke used to achieve a relatively fast swimming speed.

15. The method of claim 1 wherein said elongation range is not less than 10% during under a relatively high load condition such as created during a relatively hard kicking stroke used to achieve a relatively fast swimming speed.

16. The method of claim 1 wherein said elongation range is not less than 15% during under a relatively high load condition such as created during a relatively hard kicking stroke used to achieve a relatively fast swimming speed.

17. The method of claim 1 wherein said elongation range is not less than 20% during under a relatively high load condition such as created during a relatively hard kicking stroke used to achieve a relatively fast swimming speed.

18. The method of claim 1 wherein said hinging region has a compression surface portion capable of experiencing a compression range of at least 1% during said deflection.

19. The method of claim 1 wherein said of hinging region has a compression surface portion capable of experiencing a compression range of at least 3% during said deflection.

20. The method of claim 1 wherein said hinging region has a compression surface portion capable of experiencing a compression range of at least 5% during said deflection.

21. The method of claim 1 wherein said hinging region has a compression surface portion capable of experiencing a compression range of at least 7% during said deflection.

22. The method of claim 1 wherein said hinging region has a compression surface portion capable of experiencing a compression range of at least 10% during said deflection.

23. The method of claim 1 wherein said hinging region has a compression surface portion capable of experiencing a compression range of at least 3% under a relatively high load condition such as created during a relatively hard kicking stroke used to achieve a relatively fast swimming speed.

24. The method of claim 1 wherein said hinging region has a compression surface portion capable of experiencing a compression range of at least 5% under a relatively high load condition such as created during a relatively hard kicking stroke used to achieve a relatively fast swimming speed.

25. The method of claim 1 wherein said hinging region has a compression surface portion capable of experiencing a compression range of at least 10% under a relatively high load condition such as created during a relatively hard kicking stroke used to achieve a relatively fast swimming speed.

26. The method of claim 1 wherein said hinge region is formed by at least one cutout notch region within said active portion.

27. The method of claim 1 wherein said active portion has a compression surface portion relative to said deflection, said hinge region is formed by a curved tension surface cutout adjacent to said tension surface portion and a curved compression surface cutout adjacent to said compression surface portion.

28. The method of claim 1 wherein said active portion has a compression surface portion and said hinge region has a neutral bending surface, said hinging region is arranged to enable said neutral bending surface to shift toward said compression surface during in an amount sufficient to create a significant increase in bending resistance within said flexible rib region under a relatively high load condition such as created during a relatively hard kicking stroke used to achieve a relatively high swimming speed.

29. The method of claim 28 wherein said relatively high load condition creates a high load deflection, said increase in bending resistance is sufficient to permit the difference between said high load deflection and said deflection to be less than said deflection.

30. The method of claim 28 wherein said hinging region has a compression surface relative to said deflection, said hinging region having a compression surface cutout adjacent said compression surface, said increase in bending resistance being sufficient to prevent said compression surface notch from closing under said relatively high load condition.

31. The method of claim 1 wherein said hinging region is a region of increased bending.

32. The method of claim 1 wherein said hinging region is made with a relatively flexible themoplastic material connected to said active portion with thermal-chemical adhesion created during a phase of an injection molding process.

33. The method of claim 1 wherein said hinging region is made with a relatively flexible themoplastic material and said active portion is made with a relatively stiffer thermoplastic material, said relatively flexible thermoplastic material being connected to said relatively stiffer thermoplastic material with thermal-chemical adhesion created during a phase of an injection molding process.

34. The method of claim 1 wherein said hinging region is made with a relatively flexible themoplastic material and said active portion is made with a relatively stiffer thermoplastic material, said relatively flexible thermoplastic material being connected to said relatively stiffer thermoplastic material with a mechanical bond.

35. The method of claim 1 wherein said hinging region has a relatively short lengthwise dimension.

36. The method of claim 1 wherein said active portion includes an elongated rib member, said hinging region being a region of reduced transverse rib dimension within said elongated rib member.

37. The method of claim 1 wherein said active portion includes an elongated rib member, said hinging region being a region of increased rib flexibility within said elongated rib member.

38. The method of claim 37 wherein said region of increased rib flexibility is a region of reduced cross section within said elongated rib member.

39. The method of claim 37 wherein said region of increased rib flexibility is made with a relatively elastic thermoplastic material connected to said elongated rib member with thermal-chemical adhesion created during a phase of an injection molding process.

40. The method of claim 1 wherein said substantially S-shaped wave is arranged to form a substantially S-shaped standing wave during relatively small amplitude reciprocating strokes.

41. The method of claim 40 wherein said longitudinal flexibility is arranged to be sufficiently flexible to permit said S-shaped standing wave to form with significantly low levels of kicking resistance.

42. The method of claim 41 wherein said hinging region includes a region of reduced cross section.

43. The method of claim 41 wherein said hinging region includes a region of reduced transverse dimension.

44. The method of claim 41 wherein said hinging region includes a region of reduced vertical thickness.

45. The method of claim 41 wherein said deflection is not less than 15 degrees.

46. The method of claim 41 wherein said deflection is not less than 20 degrees.

47. The method of claim 41 wherein said deflection is not less than 30 degrees.

48. The method of claim 41 wherein said deflection is not less than 20 degrees and not substantially greater than 50 degrees.

49. The method of claim 41 wherein said deflection is not less than 30 degrees and not substantially greater than 50 degrees.

50. The method of claim 41 wherein said elongation range is not less than 5% during said deflection.

51. The method of claim 41 wherein said elongation range is not less than 7% during said deflection.

52. The method of claim 41 wherein said elongation range is not less than 10% during said deflection.

53. The method of claim 41 wherein said elongation range is not less than 15% during said deflection.

54. The method of claim 41 wherein said elongation range is not less than 5% during under a relatively high load condition such as created during a relatively hard kicking stroke used to achieve a relatively fast swimming speed.

55. The method of claim 41 wherein said elongation range is not less than 10% during under a relatively high load condition such as created during a relatively hard kicking stroke used to achieve a relatively fast swimming speed.

56. The method of claim 41 wherein said elongation range is not less than 15% during under a relatively high load condition such as created during a relatively hard kicking stroke used to achieve a relatively fast swimming speed.

57. The method of claim 41 wherein said elongation range is not less than 20% during under a relatively high load condition such as created during a relatively hard kicking stroke used to achieve a relatively fast swimming speed.

58. The method of claim 41 wherein said hinging region has a compression surface portion arranged to experience a compression range of at least 1% during said deflection.

59. The method of claim 41 wherein said hinging region has a compression surface portion arranged to experience a compression range of at least 3% during said deflection.

60. The method of claim 41 wherein said hinging region has a compression surface portion arranged to experience a compression range of at least 5% during said deflection.

61. The method of claim 41 wherein said hinging region has a compression surface portion arranged to experience a compression range of at least 3% under a relatively high load condition such as created during a relatively hard kicking stroke used to achieve a relatively fast swimming speed.

62. The method of claim 41 wherein said hinging region has a compression surface portion arranged to experience a compression range of at least 5% under a relatively high load condition such as created during a relatively hard kicking stroke used to achieve a relatively fast swimming speed.

63. The method of claim 41 wherein said hinging region has a compression surface portion arranged to experience a compression range of at least 10% under a relatively high load condition such as created during a relatively hard kicking stroke used to achieve a relatively fast swimming speed.

64. The method of claim 41 wherein said hinge region is formed by at least one cutout notch region within said active portion.

65. The method of claim 41 wherein said hinge region is formed by a curved tension surface cutout adjacent to said tension surface and a curved compression surface cutout adjacent to said compression surface.

66. The method of claim 41 wherein said hinge region has a compression surface portion and said hinge region has a neutral bending surface, said hinging region is arranged to enable said neutral bending surface to shift toward said compression surface in an amount sufficient to create a significant increase in bending resistance within said flexible rib region under a relatively high load condition such as created during a relatively hard kicking stroke used to achieve a relatively high swimming speed.

67. The method of claim 66 wherein said relatively high load condition creates a high load deflection, said increase in bending resistance is sufficient to permit the difference between said high load deflection and said deflection to be less than said deflection.

68. The method of claim 66 wherein said hinging region has a compression surface having a compression surface notch-shaped cutout, said increase in bending resistance is sufficient to prevent said compression surface notch-shaped cutout from closing under said relatively high load condition.

69. The method of claim 41 wherein said hinging region is made with a relatively flexible thermoplastic material connected to said active portion with thermal-chemical adhesion created during a phase of an injection molding process.

70. The method of claim 41 wherein said hinging region is made with a relatively flexible thermoplastic material and said active portion is made with a relatively stiffer thermoplastic material, said relatively flexible thermoplastic material being connected to said relatively stiffer thermoplastic material with thermal-chemical adhesion created during a phase of an injection molding process.

71. The method of claim 41 wherein said active portion includes an elongated rib member, said hinging region being a region of reduced transverse rib dimension within said elongated rib member.

72. The method of claim 41 wherein said active portion includes an elongated rib member, said hinging region being a region of increased rib flexibility within said elongated rib member, said region of increased rib flexibility is made with a relatively elastic thermoplastic material connected to said elongated rib member with thermal-chemical adhesion created during a phase of an injection molding process.

73. The method of claim 41 wherein said active portion is made with a highly elastic material arranged to permit said S-shaped wave to undulate substantially from said root portion toward said blade free end portion with a significantly strong snapping force during said inversion phase of said reciprocating kick stroke cycle.

74. The method of claim 40 wherein said blade free end portion has an oscillating amplitude and said standing wave is sufficient to create an amplification in said oscillating amplitude of said blade free end portion.

75. The method of claim 1 wherein said blade free end portion experiences a free end oscillation amplitude during said reciprocating kick stroke cycle, said reciprocating kick stroke cycle has a predetermined kicking stroke frequency range and said S-shaped wave has a predetermined undulating resonant frequency, said predetermined undulating resonant frequency is arranged to be sufficiently close to said predetermined kicking stroke frequency range to permit forced resonance to occur so as to create an increase in said free end oscillation amplitude.

76. The method of claim 75 wherein said longitudinal flexibility is arranged to permit said S-shaped wave to form under significantly low levels of kicking effort.

77. The method of claim 1 wherein said S-shaped wave permits said free end portion to snap back from said deflected position toward said neutral position with increased speed.

78. The method of claim 41 wherein said predetermined depth of scoop is not less than 7% of said predetermined transverse dimension.

79. The method of claim 41 wherein said predetermined depth of scoop is not less than 10% of said predetermined transverse dimension.

80. The method of claim 41 wherein said predetermined depth of scoop is not less than 20% of said predetermined transverse dimension.

81. The method of claim 41 wherein said predetermined depth of scoop is not less than 30% of said predetermined transverse dimension.

82. The method of claim 41 wherein said predetermined depth of scoop is not less than 40% of said predetermined transverse dimension.

83. The method of claim 41 wherein said flexibility of said pivoting blade portion is sufficient to permit said longitudinal midpoint of said active portion to bow between said outer side edges and form a midpoint longitudinal scoop shaped contour having a predetermined midpoint depth of scoop that is at least 5% of said predetermined transverse dimension.

84. The method of claim 41 wherein said foot attachment member has a toe portion and said hinging region is adjacent to said toe portion.

85. The method of claim 41 wherein said foot attachment member has a flexible portion made with a relatively flexible thermoplastic material, said active portion having a stiffer portion made with a relatively stiffer thermoplastic material, said hinging region being made with said flexible thermoplastic material of said flexible portion of said foot attachment member during the same phase of injection molding used to create said flexible portion of said foot attachment member.

86. The method of claim 85 wherein said relatively flexible thermoplastic material is connected to said relatively stiffer thermoplastic material with a thermal-chemical bond.

87. The method of claim 85 wherein said active portion includes at least one flexible portion made with said relatively flexible material of said foot attachment member, said at least one flexible portion being connected to said relatively stiffer thermoplastic material with thermal-chemical adhesion.

88. The method of claim 87 wherein said at least one flexible portion is at least one rib member.

89. The method of claim 41 wherein said hinging region has a sufficiently large enough cross section to substantially prevent said hinging region from buckling excessively during said light kick deflection.

90. The method of claim 41 wherein said hinging region has a sufficiently large transverse dimension to substantially prevent said hinging region from buckling excessively during said light kick deflection.

91. The method of claim 41 wherein said hinging region includes a load bearing member having a cross sectional shape selected from the group consisting of round, rounded, partial round, half round, oval, partial oval, half oval, rectangular, and multi-faceted.

92. The method of claim 41 wherein said pivoting blade portion has a lee surface relative to relative motion between said pivoting blade portion and the surrounding water, and said predetermined depth of scoop is sufficient to create a reduction in turbulence along said lee surface.

93. The method of claim 41 wherein said swim fin has a stopping device capable of limiting said deflection within a predetermined deflection range.

94. The method of claim 93 wherein a stopping device is disposed within said active portion adjacent to said hinging region, said stopping device being capable of limiting said deflection within a predetermined deflection range.

95. The method of claim 94 wherein said stopping device includes a compression surface portion of said hinging region which is arranged to experience a predetermined amount of compression during use.

96. The method of claim 94 wherein said predetermined deflection range is between 10 degrees and 30 degrees.

97. The method of claim 94 wherein said predetermined deflection range is between 20 degrees and 30 degrees.

98. The method of claim 94 wherein said predetermined deflection range is between 20 degrees and 50 degrees.

99. The method of claim 41 wherein said hinging region has a compression surface during said deflection, said hinging region having at least one notch-shaped cutout adjacent said compression surface, said compression surface being able to experience a compression range of at least 1% during said deflection, said compression surface being made with an elastic material capable of experiencing a compression surface recovery from said compression range at the end of a kicking stroke, said recovery being sufficient to increase said snap from said deflected position back toward said neutral position at the end of a kicking stroke.

100. The method of claim 1 wherein said hinging region has a sufficiently large enough cross section to substantially prevent said hinging region from buckling excessively during said light kick deflection.

101. The method of claim 1 wherein said hinging region includes an elongated rib member having a sufficiently large enough transverse dimension to substantially prevent said elongated rib member from buckling excessively during said light kick deflection.

102. The method of claim 1 wherein said hinging region includes a load bearing member having a cross sectional shape selected from the group consisting of round, rounded, partial round, half round, oval, partial oval, half oval, rectangular, and multi-faceted.

103. The method of claim 1 wherein said pivoting blade portion has a lee surface relative to a kicking stroke and said pivoting blade portion having sufficient flexibility to bow during use to form a longitudinal scoop shaped channel having a predetermined depth of scoop, said predetermined depth of scoop being sufficient to create a reduction in turbulence adjacent to said lee surface.

104. The method of claim 1 wherein a stopping device is disposed within said active portion adjacent to said hinging region, said stopping device being capable of limiting said deflection within a predetermined deflection range.

105. The method of claim 104 wherein said stopping device includes a compression surface portion of said hinging region which is arranged to experience a predetermined amount of compression during use.

106. The method of claim 104 wherein said predetermined deflection range is substantially between 20 degrees and 30 degrees.

107. The method claim 104 wherein said predetermined deflection range is between 15 degrees and 50 degrees.

108. The method of claim 1 wherein said elastic recovery is able to create a significant reduction in lost motion at the inversion portion of a kicking stroke cycle, said reduction in lost motion being sufficient to create an increase in maximum swimming speed.

109. A method for providing a swim fin comprising:

(a) providing a foot attachment member;

(b) providing an active portion connected to said foot attachment member and forming a substantially forward extension of said foot attachment member, said active portion having a root portion adjacent to said foot attachment member and a free end portion remote from said root portion and said foot attachment member, said active portion having a predetermined longitudinal dimension between said root portion and said free end portion, said active portion having a longitudinal midpoint between said root portion and said free end portion, said active portion having a first half portion between said root portion and said midpoint, said active portion having a three quarter position that is located midway between said midpoint and said free end portion, said active portion having sufficient longitudinal flexibility along said predetermined longitudinal dimension to permit said first half portion of said active portion to flex around a transverse axis to a deflection of at least 10 degrees, said active portion having outer side edges and a predetermined transverse dimension between said outer side edges, said active portion having a lee surface and an attacking surface relative to relative movement between said active portion and the surrounding water; and (c) providing said active portion with sufficient transverse flexibility to bow between said outer side edges from an unbowed position at rest to a bowed position during use to form a bowed three quarter position concave scooped channel along said attacking surface at said three quarter position, said bowed three quarter position concave scooped channel having a predetermined three quarter position depth of scoop between said unbowed position and said bowed position that is at least 5% of said predetermined transverse dimension at said three quarter position, said longitudinal flexibility being sufficient along said predetermined longitudinal dimension to permit said active portion to form a substantially S-shaped wave along said predetermined longitudinal dimension during an inversion phase of a reciprocating kick stroke cycle.

110. The method of claim 109 wherein said foot attachment member has a toe portion, and a hinging region is disposed within said active portion adjacent to said toe portion, said hinging region being a region of increased flexibility within said active portion.

111. The method of claim 109 wherein said predetermined three quarter position depth of scoop is not less than 10% of said predetermined transverse dimension.

112. The method of claim 109 wherein said predetermined three quarter position depth of scoop is not less than 20% of said predetermined transverse dimension.

113. The method of claim 109 wherein said predetermined three quarter position depth of scoop is not less than 30% of said predetermined transverse dimension.

114. The method of claim 109 wherein said predetermined three quarter position depth of scoop is not less than 40% of said predetermined transverse dimension.

115. The method of claim 109 wherein said active portion has a midpoint region located at said longitudinal midpoint, said flexibility of said active portion is sufficient to permit said midpoint region of said pivoting blade region to experience bowing between said outer side edges from a midpoint unbowed position to a midpoint bowed position to form a midpoint longitudinal scoop shaped contour having a predetermined midpoint depth of scoop that is at least 5% of said predetermined transverse dimension at said longitudinal midpoint of said active portion.

116. The method of claim 109 wherein said deflection is not less than 20 degrees.

117. The method of claim 109 wherein said deflection is not less than 30 degrees.

118. The method of claim 109 wherein said deflection is not less than 20 degrees during a relatively light load condition such as created during a relatively light kicking stroke used to achieve a relatively slow swimming speed, and said deflection is not substantially greater than 30 degrees during a relatively high load condition such as created during a relatively hard kicking stroke used to achieve a relatively high swimming speed.

119. The method of claim 109 wherein said deflection is not less than 15 degrees during relatively light load condition such as created during a relatively light kicking stroke used to achieve a relatively slow swimming speed, and said deflection is not substantially greater than 50 degrees during a relatively high load condition such as created during a relatively hard kicking stroke used to achieve a relatively high swimming speed.

120. The method of claim 109 wherein a stopping device is disposed within said active portion adjacent to said hinging region, said stopping device being capable of limiting said deflection within a predetermined deflection range on at least one stroke.

121. The method of claim 120 wherein said predetermined deflection range is between 20 degrees and 50 degrees.

122. The method of claim 110 wherein said region of increased flexibility is a region having a reduced cross section.

123. The method of claim 110 wherein said region of increased flexibility is a region of reduced transverse dimension.

124. The method of claim 110 wherein said region of increased flexibility is a region of reduced vertical dimension.

125. The method of claim 110 wherein said region of increased flexibility includes at least one vertical notch in said active portion.

126. The method of claim 110 wherein said region of increased flexibility includes a plurality of vertical notches in said active portion.

127. The method of claim 110 wherein said region of increased flexibility includes a flexible thermoplastic material connected to said active portion with thermal-chemical adhesion created during a phase of an injection molding process.

128. The method of claim 110 wherein said region of increased flexibility includes an elastic member having a tension surface capable of experiencing an elongation range of at least 3% during said deflection.

129. The method of claim 110 wherein said region of increased flexibility includes an elastic member having a tension surface capable of experiencing an elongation range of at least 5% during said deflection.

130. The method of claim 110 wherein said region of increased flexibility includes an elastic member having a tension surface capable of experiencing an elongation range of at least 10% during said deflection.

131. The method of claim 109 wherein said foot attachment member has a toe portion and said transverse axis is adjacent to said toe portion.

132. The method of claim 109 wherein said region of increased flexibility includes an elastic member having a tension surface capable of experiencing an elongation range of at least 3% during said deflection, said elastic member being made with an elastic material capable of experiencing an elastic recovery from said elongation range at the end of a kicking stroke, said elastic recover sufficient to permit said active portion to snap back from said deflected position toward said neutral position.

133. The method of claim 132 wherein said elastic recovery is sufficient to reduce lost motion during said inversion phase.

134. The method of claim 109 wherein said S-shaped wave is sufficient to create a reduction in lost motion during said inversion phase portion of a reciprocating kick stroke cycle.

135. The method of claim 109 wherein said S-shaped wave is capable of forming a standing wave along said predetermined longitudinal dimension of said active portion during rapid repetitive kick stroke inversions.

136. The method of claim 109 wherein said active portion has a tension surface portion capable of experiencing an elongation range of at least 3% and said active portion having a compression surface portion capable of experiencing a compression range of at least 1% during said deflection, said deflection occurring under a relatively light load condition such as created during a relatively light kicking stroke used to achieve a relatively slow swimming speed.

137. A method for providing a swim fin, comprising:

(a) providing a foot attachment member having a toe region;

(b) providing a active portion connected to said foot attachment member, said active portion having outer side edges, an active portion and a lee surface relative to relative motion between said active portion and surrounding water, a root portion adjacent to said foot attachment member and a free end portion spaced from said root portion and said foot attachment member, said active portion having a predetermined length between said root portion and said free end portion, said active portion having a longitudinal midpoint between said root portion and said free end portion, said active portion having a first half portion between said root portion and said midpoint, said active portion having a three quarter length position that is located midway between said midpoint and said free end portion;

(c) providing said active portion with a hinging region located adjacent to said toe region, said hinging region being capable of permitting said first half of said active portion to pivot around a transverse axis to a deflection of at least 10 degrees from a neutral position to a deflected position under a relatively light load condition such as created during a relatively light kicking stroke used to achieve a relatively slow swimming speed;

(d) providing said active portion with two elongated stiffening members connected to said active portion adjacent to said outer side edges, said active portion having sufficient transverse flexibility at said three quarter position to experience bowing between said elongated stiffening members from an unbowed position at rest to a bowed position under said relatively light load condition, said bowing sufficient to form a bowed concave scoop-shaped channel along said attacking surface at said three quarter position; and (e) providing said hinging region with an extensible tension surface portion, said hinging region being arranged to flex around a bending radius sufficient to enable said extensible tension surface portion to experience an elongation range of at least 3% during said deflection, said active portion having sufficient longitudinal flexibility along said predetermined length to permit said active portion to form a substantially S-shaped wave along said predetermined length during an inversion phase of a reciprocating kick stroke cycle.

138. The method of claim 137 wherein said extensible tension surface portion is made with an elastic material capable of experiencing an elastic recovery from said elongation range, said elastic recovery being sufficient to snap said active portion back from said deflected position toward said neutral position at the end of a kicking stroke.

139. The method of claim 137 wherein said extensible tension surface portion is made with a relatively flexible thermoplastic material, said active portion having a stiffer portion made with a relatively stiffer thermoplastic material, said relatively flexible thermoplastic material being connected to said relatively stiffer thermoplastic material with thermal-chemical adhesion created during a phase of an injection molding process.

140. The method of claim 139 wherein said foot attachment member has a flexible portion made with said relatively flexible thermoplastic used for said extensible tension surface portion, said flexible portion of said foot attachment member being molded simultaneously with said extensible tension surface portion during said phase of said injection molding process.

141. The method of claim 137 wherein said extensible tension surface portion is made with a relatively flexible thermoplastic material, said active portion has a blade member made with a relatively stiffer thermoplastic material, said blade member having opposing surfaces, said relatively flexible thermoplastic material being molded onto at least one of said opposing surfaces of said blade member and connected to said blade member with a chemical bond created during said phase of an injection molding process.

142. The method of claim 137 wherein said deflection is not less than 15 degrees.

143. The method of claim 137 wherein said deflection is not less than 20 degrees.

144. The method of claim 137 wherein said deflection is between 20 degrees and 30 degrees.

145. The method of claim 137 wherein said deflection is not less than 20 degrees under said relatively light load condition and said deflection is not greater than 30 degrees under a high load condition such as created during a relatively hard kicking stroke used to achieve a relatively high swimming speed.

146. The method of claim 137 wherein said deflection is not less than 20 degrees under said relatively light load condition and said deflection is not greater than 40 degrees under a high load condition such as created during a relatively hard kicking stroke used to achieve a relatively high swimming speed.

147. The method of claim 137 wherein said deflection is not less than 20 degrees under said relatively light load condition and said deflection is not substantially greater than 50 degrees under a high load condition such as created during a relatively hard kicking stroke used to achieve a relatively high swimming speed.

148. The method of claim 137 wherein said longitudinal flexibility is arranged to permit said S-shaped wave to form during when relatively light kicking strokes are used during said reciprocating kick stroke cycle.

149. The method of claim 137 wherein said bowed concave scoop-shaped channel is sufficiently concave to significant increase the water channeling capacity of said active portion.

150. The method of claim 149 wherein said bowed concave scoop-shaped channel along said attacking surface form a sufficiently convex contour along said lee surface to reduce the formation of turbulence along said lee surface.

151. The method of claim 150 wherein said convex contour along said lee surface is able to create a reduction in pressure within the water flowing adjacent said lee surface.

152. The method of claim 150 wherein said convex contour along said lee surface is able to create convex curved flow conditions within the water flowing adjacent to said lee surface.

153. The method of claim 137 wherein said active portion has a predetermined transverse dimension between said outer side edges and said bowed concave scoop-shaped channel has a predetermined depth of scoop that is at least 5% of said predetermined transverse dimension at said three quarter position of said active portion.

154. The method of claim 137 wherein said active portion has a predetermined transverse dimension between said outer side edges and said bowed concave scoop-shaped channel has a predetermined depth of scoop that is at least 10% of said predetermined transverse dimension at said three quarter position of said active portion.

155. The method of claim 137 wherein said active portion has a predetermined transverse dimension between said outer side edges and said bowed concave scoop-shaped channel has a predetermined depth of scoop that is at least 20% of said predetermined transverse dimension at said three quarter position of said active portion.

156. The method of claim 137 wherein said active portion has a predetermined transverse dimension between said outer side edges and said bowed concave scoop-shaped channel has a predetermined depth of scoop that is at least 30% of said predetermined transverse dimension at said three quarter position of said active portion.

157. The method of claim 137 wherein said active portion has a predetermined transverse dimension between said outer side edges and said bowed concave scoop-shaped channel has a predetermined depth of scoop that is at least 40% of said predetermined transverse dimension at said three quarter position of said active portion.

158. The method of claim 137 wherein said elongation range is at least 5%.

159. The method of claim 137 wherein said elongation range is at least 10%.

160. The method of claim 137 wherein said active portion has a stopping device capable of limiting said deflection to a predetermined maximum deflection.

161. The method of claim 160 wherein said predetermined maximum deflection range is not substantially greater than 20 degrees.

162. The method of claim 160 wherein said predetermined maximum deflection range is not substantially greater than 30 degrees.

163. The method of claim 160 wherein said predetermined maximum deflection range is not substantially greater than 50 degrees.

164. The method of claim 160 wherein said stopping device is created by arranging said active portion to experience a non-linear increase in bending resistance if said relatively light load condition is exceeded during use.

165. The method of claim 164 wherein said non-linear increase in bending resistance is created by arranging said hinging region to have a compression surface portion capable of experiencing a predetermined compression range capable of experiencing a non-linear increase in resistance to further compression when said predetermined compression range is exceeded.

166. The method of claim 137 wherein said transverse axis is adjacent to said toe region.

167. The method of claim 137 wherein said hinging region has at least one load bearing member having a sufficient transverse dimension to substantially prevent said at least one load bearing member from buckling excessively during said deflection.

168. The method of claim 167 wherein said at least one load bearing member is at least one elongated load bearing rib.

169. The method of claim 137 wherein said longitudinal S-shaped wave is sufficient to create an increased snapping motion during the inversion phase of a reciprocating kicking stroke cycle.

170. The method of claim 137 wherein said active portion is made with a sufficiently elastic material to permit said longitudinal S-shaped wave to create an amplified oscillation adjacent said free end portion.

* * * * *